United States Patent [19]

Komorita et al.

[11] Patent Number: 4,863,840

[45] Date of Patent: Sep. 5, 1989

[54] SILVER HALIDE COLOR PHOTOGRAPHIC LIGHT-SENSITIVE MATERIAL COMPRISING A SPECIFIC COMBINATION OF COLOR COUPLERS

[75] Inventors: Kazuo Komorita; Kaoru Onodera, both of Odawara, Japan

[73] Assignee: Konishiroku Photo Industry Co., Ltd., Tokyo, Japan

[21] Appl. No.: 2,982

[22] Filed: Jan. 13, 1987

[30] Foreign Application Priority Data

Jan. 20, 1986 [JP] Japan ..... 61-9791

[51] Int. Cl.[4] ..... G03C 1/46; G03C 7/26; G03C 7/32; G03C 7/34

[52] U.S. Cl. ..... 430/505; 430/551; 430/553; 430/546; 430/558

[58] Field of Search ..... 430/505, 551, 558, 553, 430/546

[56] References Cited

U.S. PATENT DOCUMENTS

| | | | |
|---|---|---|---|
| 3,772,002 | 11/1973 | Ramello | 430/553 |
| 4,607,002 | 8/1986 | Nakayama et al. | 430/505 |
| 4,609,618 | 9/1986 | Sasaki et al. | 430/546 |
| 4,614,709 | 9/1986 | Sasaki et al. | 430/546 |
| 4,622,287 | 11/1986 | Umemoto et al. | 430/505 |
| 4,639,415 | 1/1987 | Kaneko et al. | 430/558 |
| 4,692,399 | 9/1987 | Sasaki et al. | 430/507 |

*Primary Examiner*—Paul R. Michl
*Assistant Examiner*—Patrick A. Davy
*Attorney, Agent, or Firm*—Jordan B. Bierman

[57] ABSTRACT

A silver halide color photographic light-sensitive material is disclosed, which is satifactory in the overall discoloration color balance of a dye image composed of yellow, magenta and cyan dyes in the light discoloration as well as in the dark discoloration and produces little or no yellow color stain when stored being exposed to a light or in the dark over an extensive period of time and which is excellent in the quality of the dye image even when stored over an extensive period of time.

The color photographic material comprises a silver halide emulsion layers containing a specific yellow dye-forming coupler, a silver halide emulsion layer containing a specific magenta dye-forming coupler and a silver halide emulsion layer containing two kinds of specific cyan dye-forming couplers, and the respective emulsion layers each contain high-boiling organic solvent having a dielectric constant of not more than 6.0.

5 Claims, No Drawings

SILVER HALIDE COLOR PHOTOGRAPHIC LIGHT-SENSITIVE MATERIAL COMPRISING A SPECIFIC COMBINATION OF COLOR COUPLERS

FIELD OF THE INVENTION

The present invention relates to a silver halide color photographic light-sensitive material capable of forming a dye image excellent in the preservability.

BACKGROUND OF THE INVENTION

In a silver halide color photographic light-sensitive material, a color developing agent such as, for example, an aromatic primary amine-type compound, is used to develop the exposed silver halide grains, and the color developing agent's oxidized product produced in the development then reacts with dye forming couplers, whereby a dye image is formed. In this method, in order to form an image composed of cyan, magenta and yellow color dyes, a phenol-type or naphthol-type cyan coupler, a 5-pyrazolone-pyrazolinobenzimidazole-type, pyrazolotriazole-type, indazolone-type or cyanoacetyl-type magenta coupler, and an acylacetamido-type or benzoylmethane-type yellow coupler are used.

The above-obtained dye image may sometimes be stored being exposed to a light over a long period of time or may, although exposed for a short period, sometimes be stored in the dark over an extensive period. In such instances it is known that the dye image becomes significantly discolored depending upon the storage condition thereof. Generally, the discoloration in the former is called photodiscoloration or light discoloration, while that in the latter is called dark discoloration. In order to preserve semipermanently a record image obtained by use of a color photographic light-sensitive material, it is required that the overall color balance in discoloration of the three-color dye image composed of yellow, magenta and blue dyes be retained as in the initial balance state by keeping down such the light or dark discoloration to a smallest possible degree. However, the degree of the light or dark discoloration differs according to the respective yellow, magenta and blue dye images, so that there has been the inconvenience that after an extensive period of the storage thereof the overall color balance of the three colors tends to be lost, thus deteriorating the quality of each dye image.

In addition, in the case of a magneta coupler, the yellow stain in the color-undeveloped area due to a light, heat or moisture is significant as compared to that in the case of a cyan coupler or yellow coupler, so that there has been the inconvenience that it deteriorates the quality of the resulting dye image just as the discoloration does.

For the purpose of solving such problems, techniques to improve them by specific coupler combinations are disclosed in, e.g., Japanese Patent Examined Publication No. 7344/1977, Japanese Patent Publication Open to Public Inspection (hereinafter referred to as Japanese Patent O.P.I. Publication) Nos. 200037/1982, 57235/1984, 117249/1985, 232550/1985, and the like.

Even in those coupler combinations, however, since the color balance in the light or dark discoloration tends to be lost and the yellow stain tends to appear, the overall image preservability is not adequate, and further there arise other problems that the color balance in the color development process is deteriorated, the color reproduction is inadequate, and so forth. Thus, further improvements have been requested.

SUMMARY OF THE INVENTION

It is a first object of the present invention to provide a silver halide color photographic light-sensitive material which is satisfactory in the overall discoloration color balance of a dye image composed of yellow, magenta and cyan dyes in the light discoloration as well as in the dark discoloration and which produces little or no yellow color stain even when stored being exposed to a light or in the dark over an extensive period of time and which is excellent in the quality of the dye image even when stored over an extensive period of time.

It is a second object of the present invention to provide a silver halide color photographic light-sensitive material excellent in the color reproducibility.

Other objects of the present invention will be apparent from the following description.

The above objects of the present invention are accomplished by a silver halide color photographic light-sensitive material which comprises a support having thereon a silver halide emulsion layer containing an yellow dye forming coupler represented by the following Formula [I], a silver halide emulsion layer containing a magenta dye forming coupler represented by the following Formula [II] and a silver halide emulsion layer containing a cyan dye forming coupler represented by the following Formula [III-1] and a cyan dye forming coupler represented by the following Formula [III-2], the said respective couplers-containing silver halide emulsion layers each also containing a high-boiling organic solvent having a dielectric constant of not more than 6.0

Formula [I]

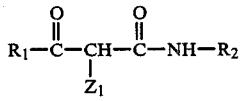

wherein $R_1$ is an alkyl group, $R_2$ is an aryl group, and $Z_1$ is a hydrogen atom or a group capable of splitting off from the coupler residue upon the reaction with the oxidized product of a color developing agent, Formula [II]

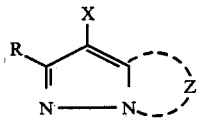

wherein Z is a group of nonmetallic atoms necessary to form a nitrogen-containing heterocyclic ring, the heterocyclic ring formed by the Z being allowed to have a substituent, X is a hydrogen atom or a substituent capable of splitting off from the coupler residue upon the reaction with the oxidized product of a color developing agent, and R is a hydrogen atom or a substituent, Formula [III-1]

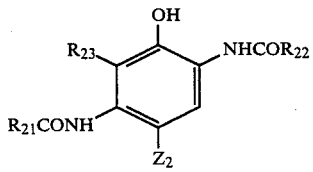

wherein $R_{21}$ is an alkyl or aryl group, $R_{22}$ is an alkyl, cycloalkyl, aryl or heterocyclic group, $R_{23}$ is a hydrogen atom, a halogen atom, an alkyl group or an alkoxy group, the $R_{23}$ and $R_{21}$ being allowed to combine with each other to form a ring, and $Z_2$ is a hydrogen atom or a group capable of splitting off from the coupler residue upon the reaction with the oxidized product of a color developing agent, Formula [III-2]

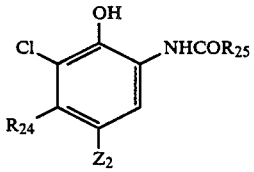

wherein $R_{24}$ is a straight-chain or branched-chain alkyl group having from 2 to 4 carbon atoms, $R_{25}$ is a ballasting group, and $Z_2$ is as defined in the $Z_2$ of Formula [III2].

DETAILED DESCRIPTION OF THE INVENTION

In the present invention, an yellow dye forming coupler having Formula [I], a magenta dye forming coupler having Formula [II], and a cyan dye forming coupler having Formula [III-I]and a cyan dye forming coupler having Formula [III-II]are used, which couplers will be detailed below:

In the present invention, the $R_1$ of Formula [I] is a straight-chain or branched-chain alkyl group and is preferably a t-butyl group, the $R_2$ is an aryl group (preferably a phenyl group), and the alkyl group represented by the $R_1$ and the aryl group by the $R_2$ include those having a substituent. The aryl group represented by the $R_2$ is desirable to be substituted by a halogen atom, an alkyl group, and the like. The $Z_1$ is preferably a group having the following Formula [I-1] or [I-2], and particularly preferably a group having the following Formula [I-1'] out of the Formula [I-1]:

Formula [I-1]

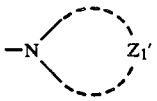

wherein $Z'_1$ is a group of nonmetallic atoms capable of forming a 4- to 7-member ring, $-O-R_3$ Formula [I-2]

wherein $R_3$ is an aryl group, a heterocyclic group, or an acyl group, and of these groups, the aryl group is preferred, and Formula [I-1']

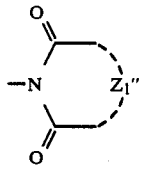

wherein $Z_1''$ is a;group of nonmetallic atoms capable of forming a 4- to 6-member ring along with

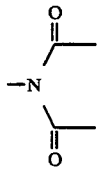

In Formula [I], the preferred yellow coupler of the present invention is one having the following Formula [I']:

Formula [I']

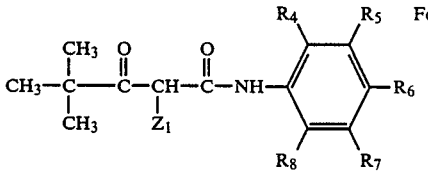

wherein $R_4$ and $R_8$ each is a hydrogen atom, a halogen atom or an alkoxy group. The $R_4$ is preferably a halogen atom, and the $R_8$ is preferably a hydrogen atom; $R_5$, $R_6$ and $R_7$ each is a hydrogen atom, a halogen atom, an alkyl group, an alkenyl group, an alkoxy group, an aryl group, a carboxy group, an alkoxycarbonyl group, a carbamyl group, a sulfone group, a sulfamyl group, an alkylsulfonamido group, an acylamido group, an ureido group or an amino group, the $R_5$ and $R_6$ each being preferably a hydrogen atom, the $R_7$ being preferably an alkoxycarbonyl, acylamido or alkylsulfonamido group; $Z_1$ is as defined in the $Z_1$ of Formula [I] and is preferably a group represented by Formula [I-1] or [I-2], and more preferably a group having Formula [I-1'] out of the Formula [I-1].

The yellow coupler of this invention having Formula [I] may be used in combination with other yellow couplers.

The layer to which the yellow coupler is to be added may be an arbitray silver halide emulsion layer, and preferably a blue-sensitive halide emulsion layer. The adding amount of the yellow coupler is preferably from $2\times10^{-3}$ to $5\times10^{-1}$ moles per mole of silver halide, and more preferably from $1\times10^{-2}$ to $5\times10^{-1}$ moles.

The following are examples of the yellow coupler of this invention, but are not limited thereto.

(Y-1)

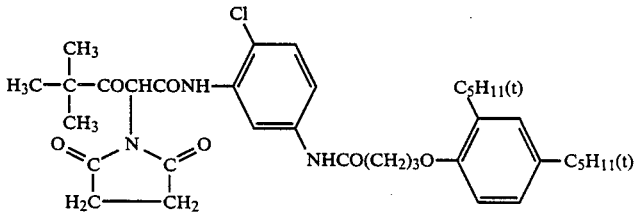

-continued
(Y-2)
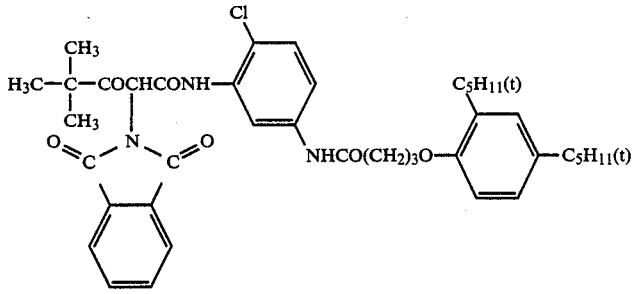
(Y-3)
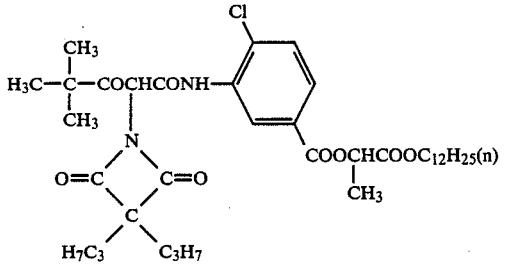
(Y-4)
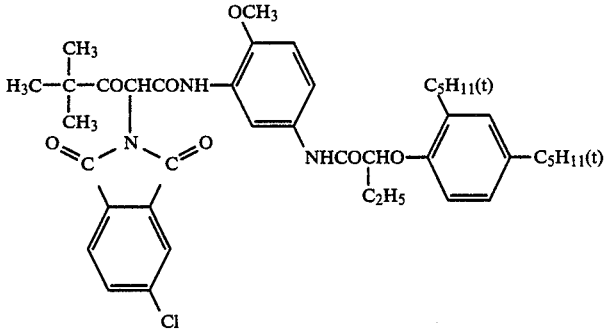
(Y-5)
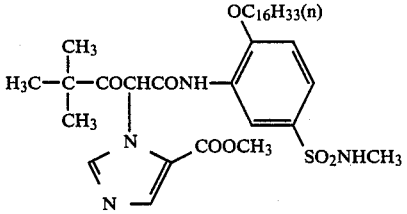
(Y-6)
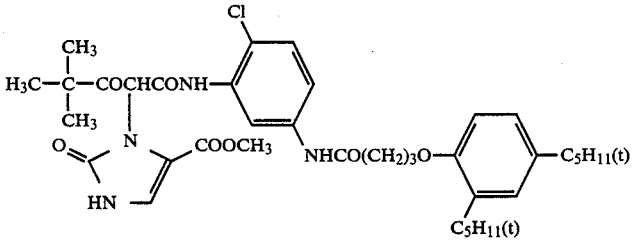
(Y-7)
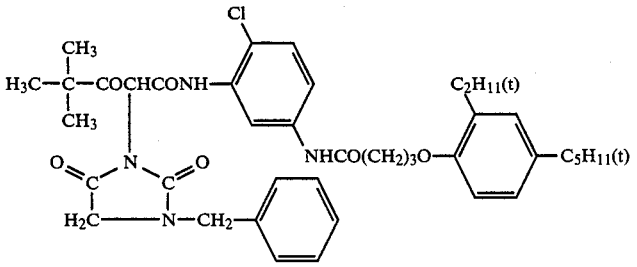

-continued
(Y-8)
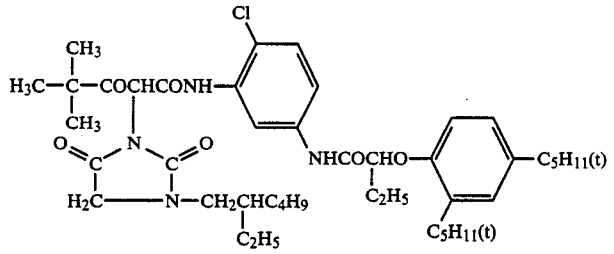
(Y-9)
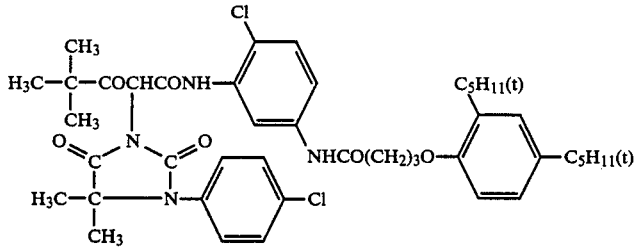
(Y-10)
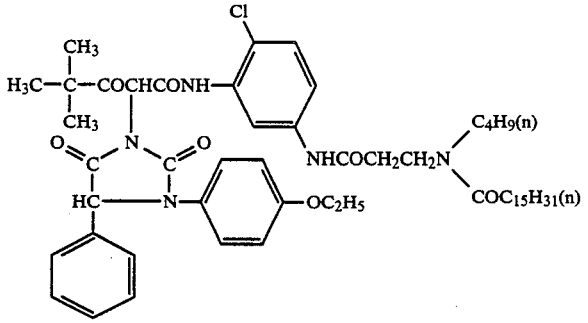
(Y-11)
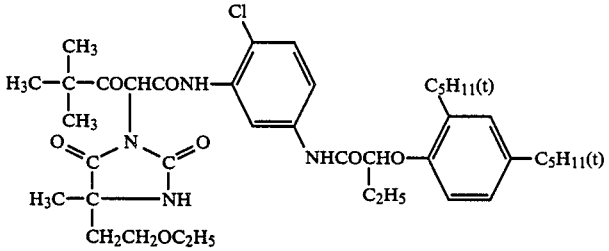
(Y-12)
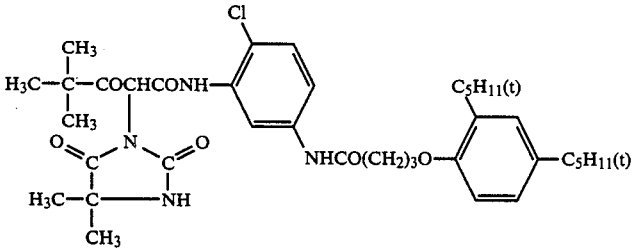
(Y-13)
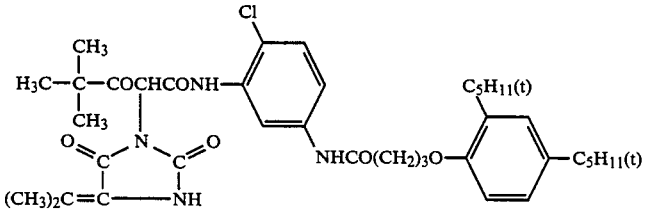

-continued
(Y-14)
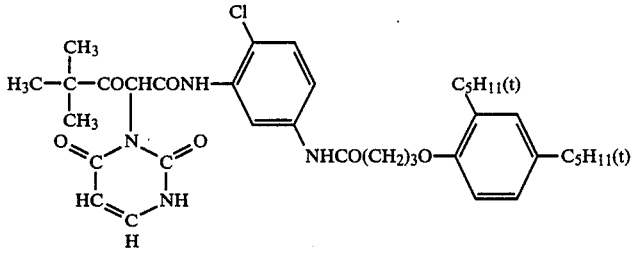
(Y-15)
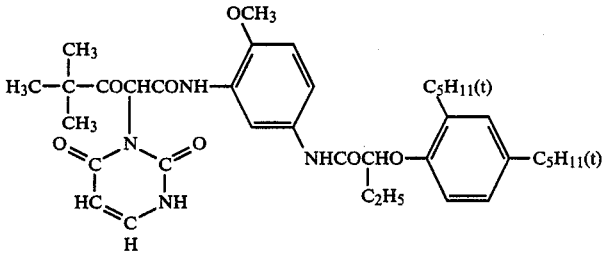
(Y-16)
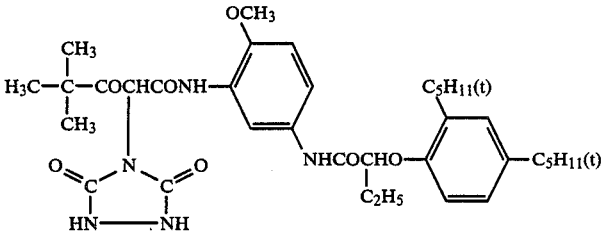
(Y-17)
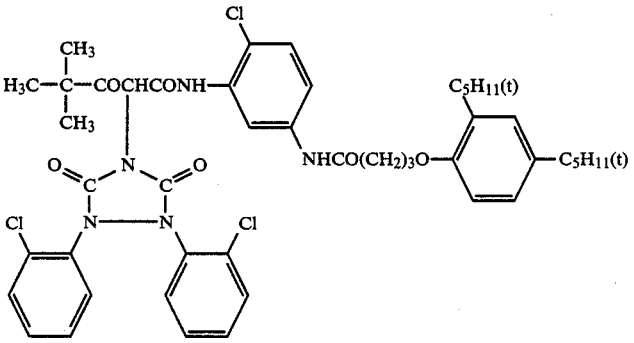
(Y-18)
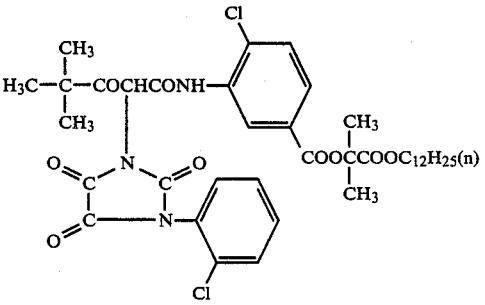
(Y-19)
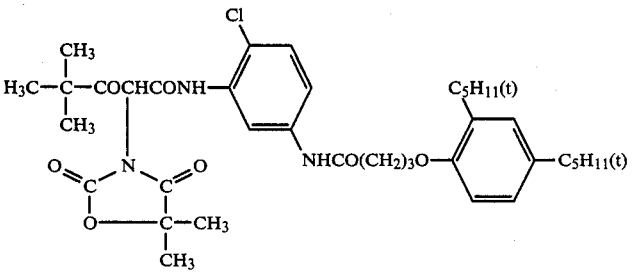

-continued
(Y-20)
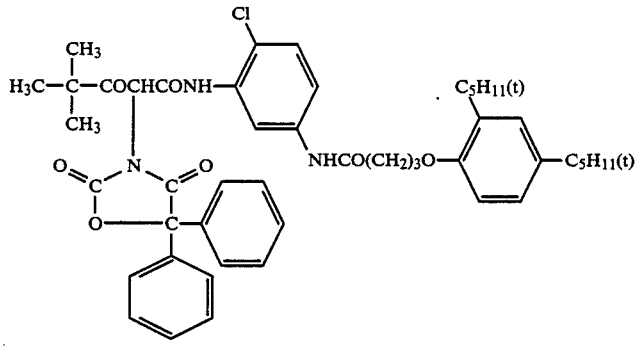
(Y-21)
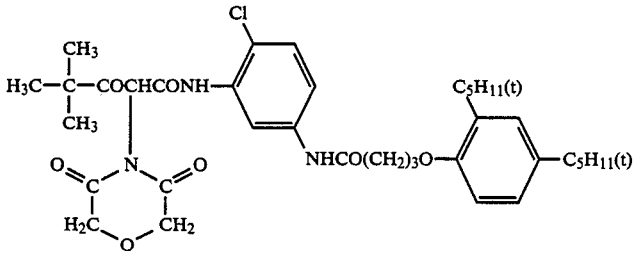
(Y-22)
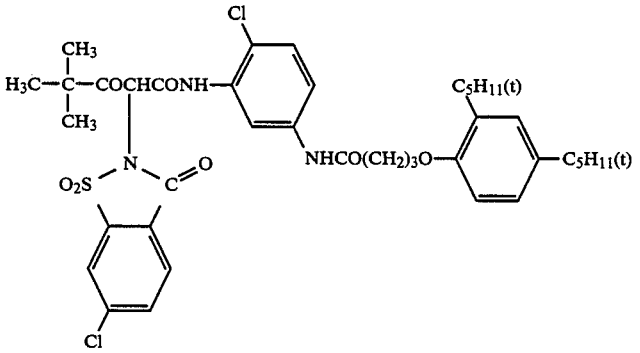
(Y-23)
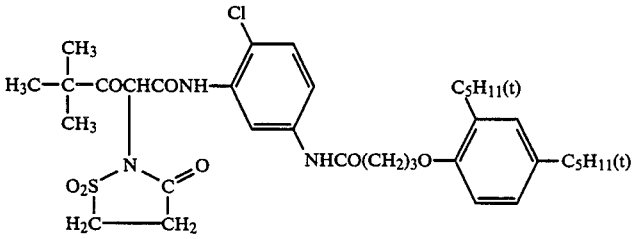
(Y-24)
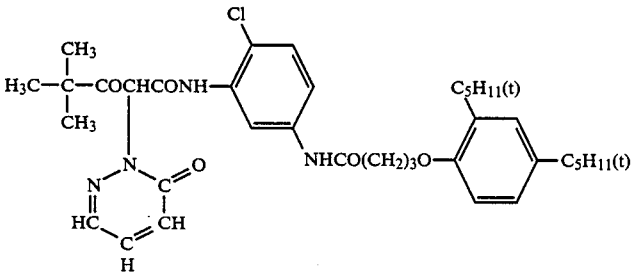

-continued
(Y-25)
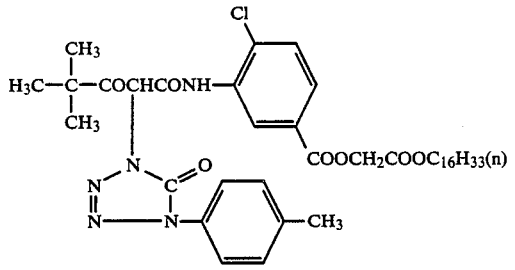
(Y-26)
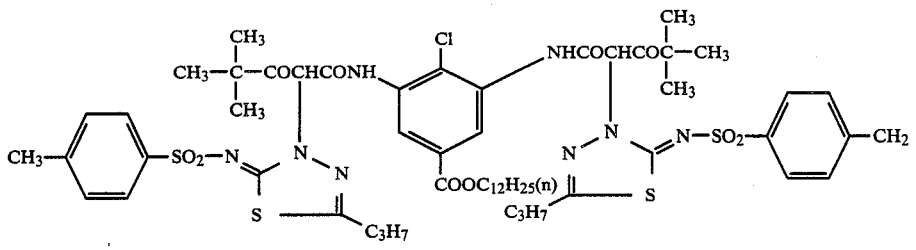
(Y-27)
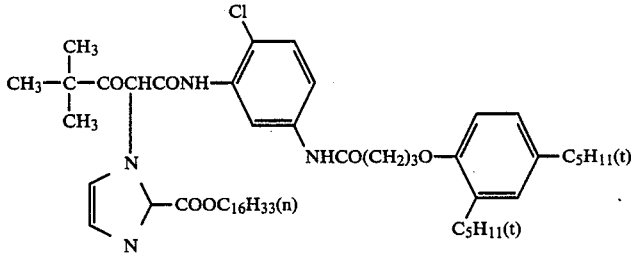
(Y-28)
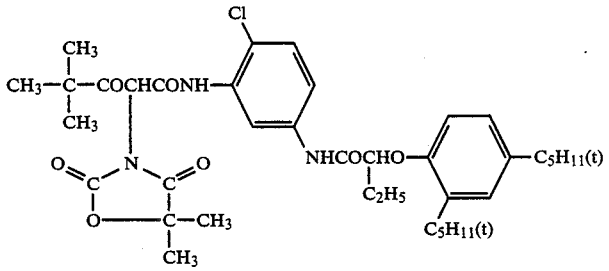
(Y-29)
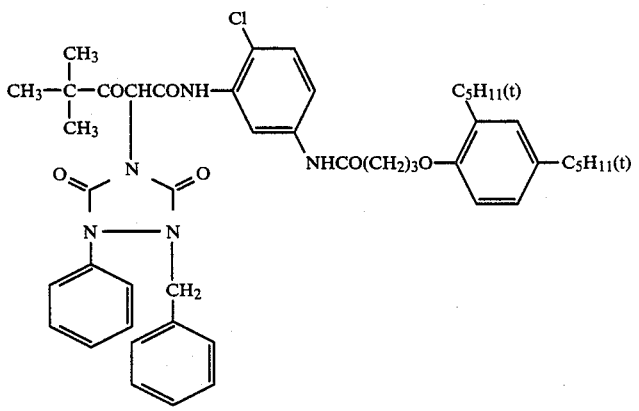

-continued
(Y-30)
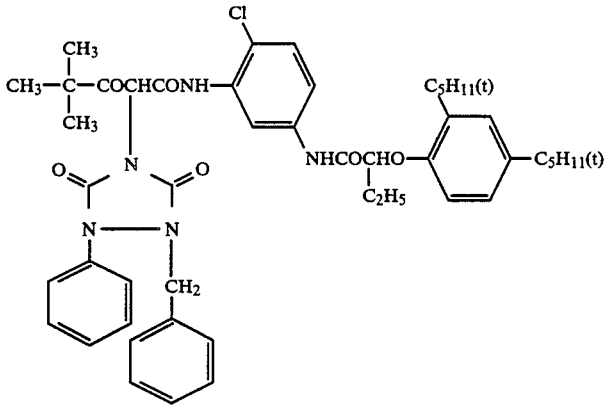
(Y-31)
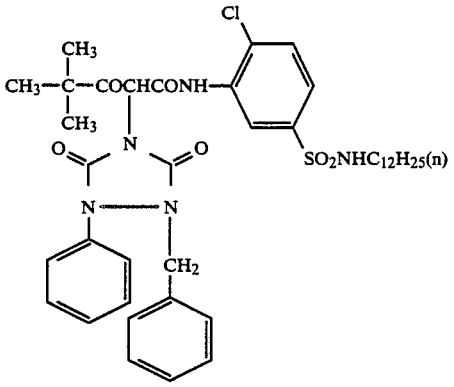
(Y-32)
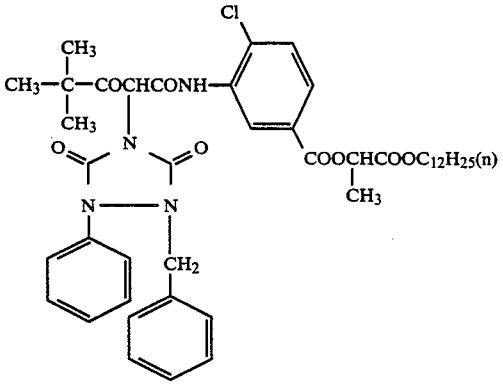
(Y-33)
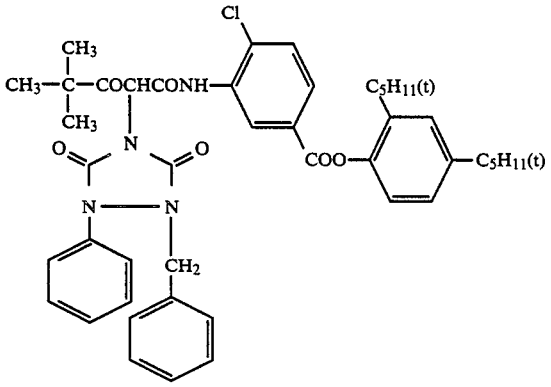

-continued
(Y-34)
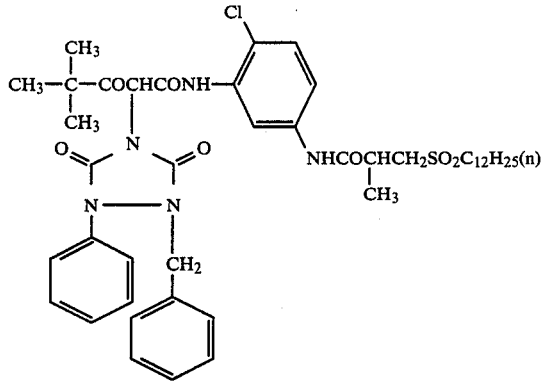
(Y-35)
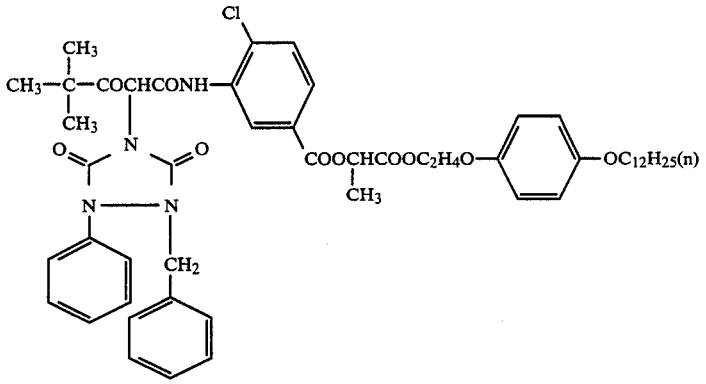
(Y-36)
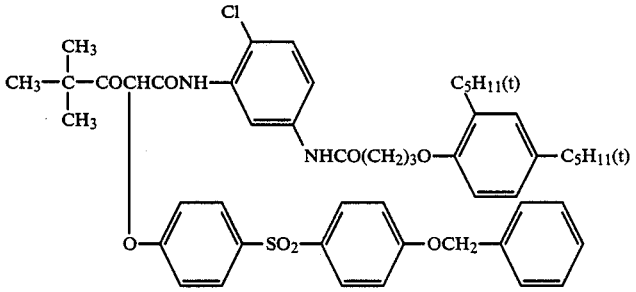
(Y-37)
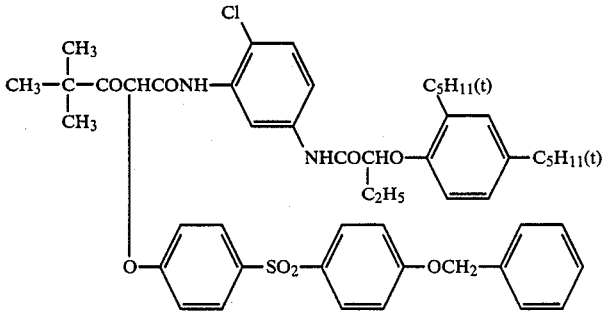

-continued
(Y-38)
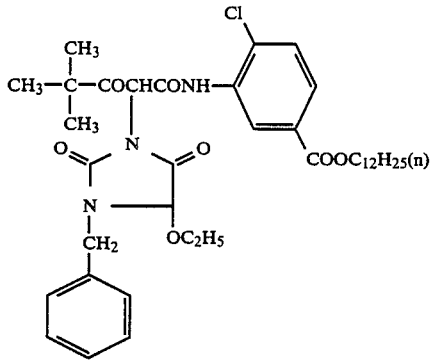
(Y-39)
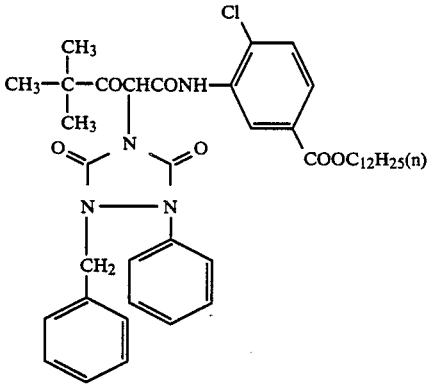
(Y-40)
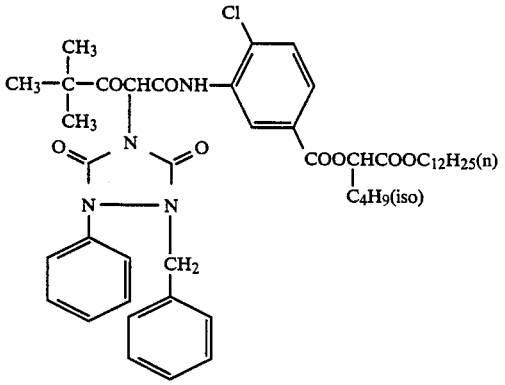
(Y-41)
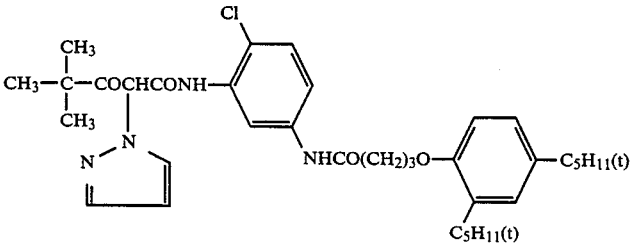

-continued (Y-42)

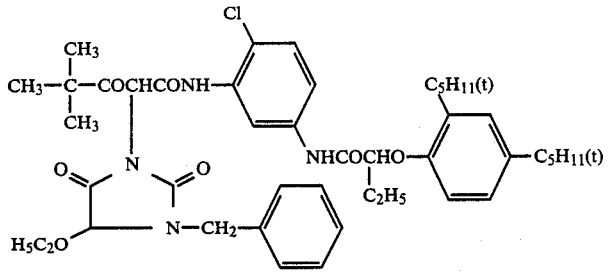

In the magenta couplers which are related to the invention and represented by the following Formula [II], Formula [II]

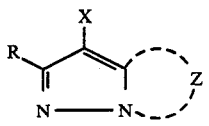

wherein

Z represents a group of non-metal atoms necessary for forming a nitrogen-containing heterocyclic ring, and the rings formed by the Z may be allowed to have a substituent;

X represents a hydrogen atom or a group capable of splitting off through the reaction with the oxidized products of a color developing agent; and R represents a hydrogen atom or a substituent.

The substituents each represented by the R are not particularly limitative, but include, typically, an alkyl, aryl, anilino, acylamino, sulfonamido, alkylthio, arylthio, alkenyl, cycloalkyl or like group and, besides the above, a halogen atom, a cycloalkenyl, alkinyl, heterocyclic, sulfonyl, sulfinyl, phosphonyl, acyl, carbamoyl, sulfamoyl, cyano, alkoxy, aryloxy, heterocyclic-oxy, siloxy, acyloxy, carbamoyloxy, amino, alkylamino, imido, ureido, sulfamoylamino, alkoxycarbonylamino, aryloxycarbonylamino, alkoxycarbonyl, aryloxycarbonyl or heterocyclic-thio group and, further, a spiro-compound residual group, a bridged hydrocarbon compound residual group or the like.

The alkyl groups represented by the R may preferably be those each having one to 32 carbon atoms and they may also be straight-chained or branched.

The aryl groups represented by the R may preferably be a phenyl group.

The acylamino groups represented by the R include, for example, an alkylcarbonylamino group, an arylcarbonylamino group and the like.

The sulfonamido groups represented by the R include, for example, an alkylsulfonylamino group, an arylsulfonylamino group and the like.

The alkyl or aryl components of the alkylthio or arylthio groups each represented by the R include, for example, an alkyl group and an aryl group.

The alkenyl groups each represented by the R may preferably include those each having 2 to 32 carbon taoms; the cycloalkyl groups each represented thereby may preferably include those each having 3 to 12 carbon atoms and more preferably those each having 5 to 7 carbon atoms; and the alkenyl groups may further be the straight-chained or branched.

The cycloalkenyl groups each represented by the R may preferably be those each having 3 to 12 carbon atoms and more preferably 5 to 7 carbon atoms.

The sulfonyl groups each represented by the R include, for example, an alkylsulfonyl group, an arylsulfonyl group and the like;

The sulfinyl groups represented thereby include, for example, an alkylsulfinyl group, an arylsulfinyl group and the like;

The sulfonyl groups each represented thereby include, for example, an alkylphosphonyl group, an alkoxyphosphonyl group, an arylphosphonyl group, an aryl phosphonyl group and the like;

The acyl groups each represdented thereby include, for example, an alkylcarbonyl group, an arylcarbonyl group and the like;

The carbamoyl groups each represented thereby include, for example, an alkylcarbamoyl group, an arylcarbamoyl group and the like;

The sulfamoyl groups each represented thereby include, for example, an alkylsulfamoyl group, an arylsulfamoyl group and the like;

The acyloxy groups each represented thereby include, for example, an alkylcarbonyloxy group, an arylcarbonyloxy group and the like;

The carbamoyloxy groups each represented thereby include, for example, an alkylcarbamoyloxy group, an arylcarbamoyloxy group and the like;

The ureido groups each represented thereby include, for example, an alkylureido group, an arylureido group and the like;

The sulfamoylamino groups each represented thereby include, for example, an alkylsulfamoylamino group, an arylsulfamoylamino group and the like;

The heterocyclic groups may preferably be 5- to 7-member cyclic groups such as, typically, a 2-furyl, 2-thienyl, 2-pyrimidinyl, 2-benzothiazolyl or like group;

The heterocyclic-oxy groups may preferably be 5- to 7-member groups such as, typically, a 3,4,5,6-tetrahydropyranyl-2-oxy group, a 1-phenyltetrazole-5-oxy group and the like;

The heterocyclic-thio groups may preferably be 5- to 7-member heterocyclic-thio groups such as, typically, a 2-pyridylthio group, a 2-benzothiazolylthio group, a 2,4-diphenoxy-1,3,5-triazole-6-thio group and the like;

The siloxy groups include, for example, a trimethylsiloxy group, a triethylsiloxy group, a dimethylbutylsiloxy group and the like;

The imido groups include, for example, a succinimido group, a 3-heptadecyl succinimido group, a phthalimido group, a glutarimido group and the like;

The spiro-compound residual groups include, for example, a spiro[3,3]heptane-1-yl and the like;

The bridged hydrocarbon compound residual groups include, for example, a bicyclo[2,2,1]heptane-1-yl, a tricyclo-[3,3,1,1$^{3'7}$]decane-1-yl, a 7,7-dimethyl-bicyclo[2,2,1]heptane-1-yl and the like.

The groups which are capable of splitting off through the reaction with the oxidized products of a color developing agent and are represented by the X, include, for example, a halogen atom (such as a chlorine atom, a bromine atom, a fluorine atom and the like) and such a group as an alkoxy group, an aryloxy group, a heterocyclic-oxy group, an acyloxy group, a sulfonyloxy group, an alkoxycarbonyloxy group, an aryloxycarbonyl group, an alkyloxalyloxy group, an alkoxyoxalyloxy group, an alkylthio group, an arylthio group, a heterocyclic-thio group, an alkyloxythiocarbonylthio group, an acylamino group, a sulfonamido group, a nitrogen-containing heterocyclic group bonded with an N atom, an alkyloxycarbonylamino group, an aryloxycarbonylamino group, a carboxyl group, a group having the following formula

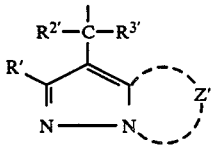

(wherein R′ is synonymous with the aforementioned R; Z′ is synonymous with the aforementioned Z; and $R^{2'}$ and $R^{3'}$ represent each hydrogen atom, an aryl group, an alkyl group or a heterocyclic group); and they may preferably be a halogen atom and more preferably a chlorine atom.

The nitrogen-containing heterocyclic rings each formed by the Z or Z′ include, for example, a pyrazole ring, an imidazole ring, a triazole ring, a tetrazole ring or the like rings. The substituents which the above-mentioned rings are allowed to have include those mentioned about the R.

Those represented by the Formula [II] include, typically, those represented by the following Formulas [IIa] through [IIf]:

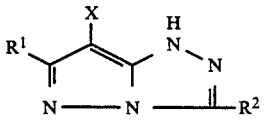

Formula [IIa]

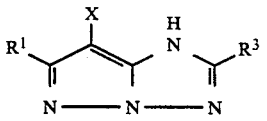

Formula [IIb]

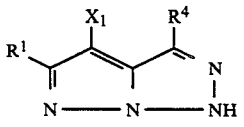

Formula [IIc]

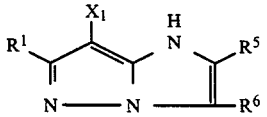

Formula [IId]

-continued

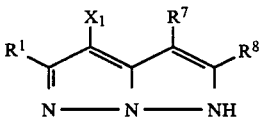

Formula [IIe]

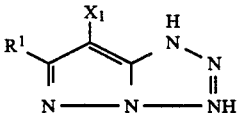

Formula [IIf]

In the Formulas [IIa] through [IIf], $R^1$ through $R^8$ and X are each synonymous with the aforedenoted R and X.

In the Formula [II], the preferable ones are represented by the following Formula [IIg]:

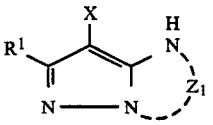

Formula [IIg]

wherein $R^1$, X and $Z_1$ are each sunonymous with R, X and Z denoted in the Formula [II].

Among the magenta couplers represented by the above-given Formulas [IIb] through [IIf], the particularly preferable ones are those represented by the Formula [IIa].

The most preferable ones for the substituents R coupled to the above-mentioned heterocyclic rings are those represented by the following formula [IIh]:

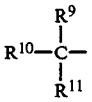

Formula [IIh]

wherein $R^9$, $R^{10}$ and $R^{11}$ are synonymous with the aforementioned R respectively. Two out of the above-mentioned $R^9$, $R^{10}$ and $R^{11}$, $R^9$ and $R^{10}$, for example, are allowed to form a saturated or unsaturated ring (such as a cycloalkane, cycloalkene or heterocyclic ring) and, further, to form a bridged hydrocarbon compound residual group upon the coupling of $R^{11}$ to the ring.

The preferable ones of those represented by the Formula [IIh] are embodied in the following cases that (i) at least two out of the $R^9$ through $R^{11}$ are alkyl groups and (ii) one out of the $R^9$ through $R^{11}$, $R^{11}$ for example, is a hydrogen atom, and the other two, $R^9$ and $R^{10}$, form a cycloalkyl together with a root carbon atom upon the coupling of the two to each other.

A further preferable one in the case (i) is that two out of $R^9$ through $R^{11}$ are alkyl groups and the remaing one is a hydrogen atom or an alkyl group.

The rings formed by the Z denoted in Formula [II] and the rings formed by the $Z_1$ denoted in Formula [IIg] are allowed to have substituents, respectively. Such substituents and the $R^2$ through $R^8$ denoted in the Formulas [IIa] through [IIe] may preferably be represented by the following Formula [IIj]:

$$-R^{12}-SO_2-R^{13}$$ Formula [IIj]

wherein $R^{12}$ represents an alkylene group; and $R^{13}$ represents an alkyl group, a cycloalkyl group or an aryl group.

The alkylene groups represented each by $R^{12}$ are to have preferably not less than two carbon atoms in the straight-chained portion thereof and, more preferably, 3 to 6 carbon atoms therein. These alkylene groups may be of the straight-chained or of the branched.

The preferable cycloalkyl groups represented by $R^{13}$ may be of the 5- or 6-membered.

The typical examples of the compounds relating to this invention will now be given below:

1

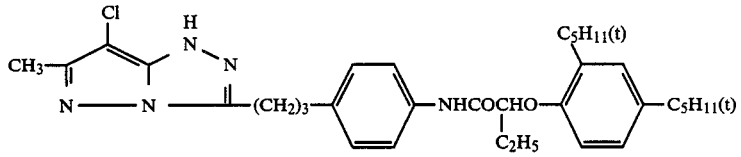

2

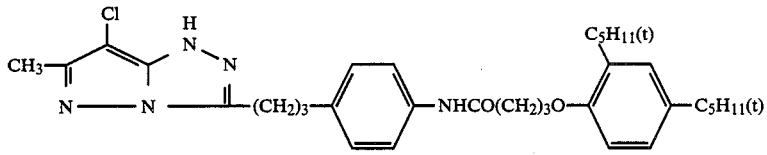

3

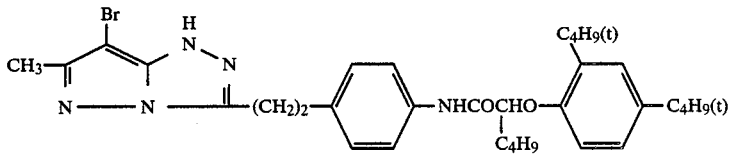

4

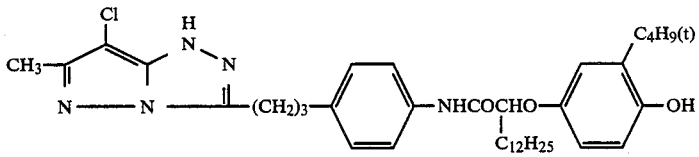

5

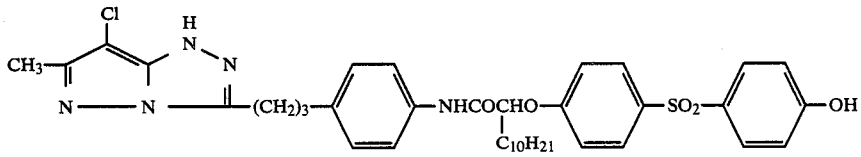

6

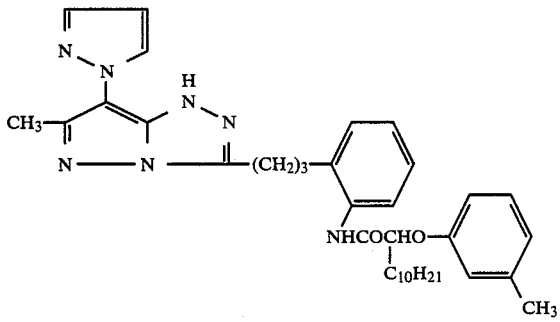

7

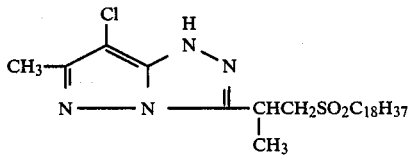

8

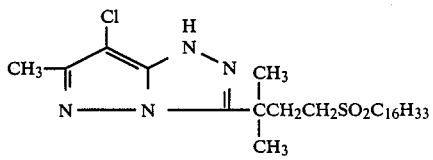

-continued
9
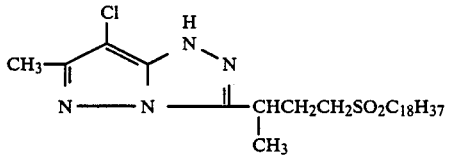
10
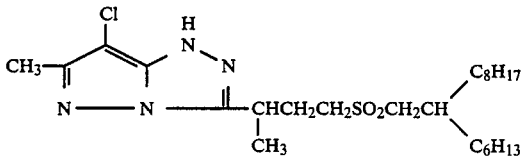
11
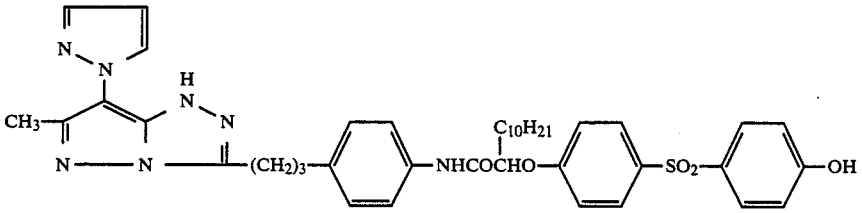
12
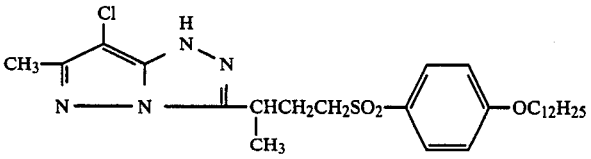
13
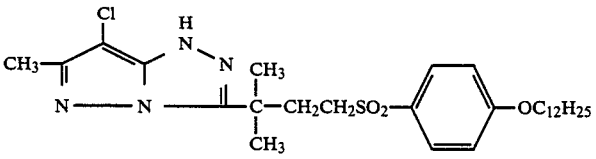
14
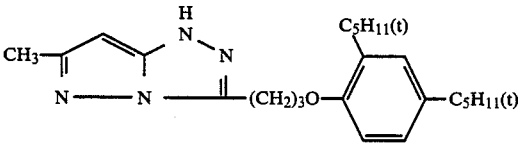
15
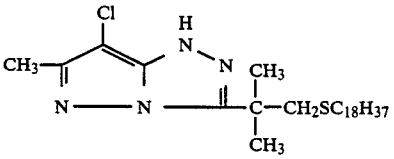
16
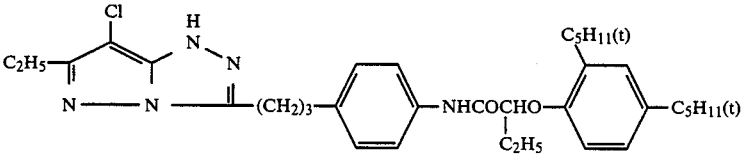

-continued
17
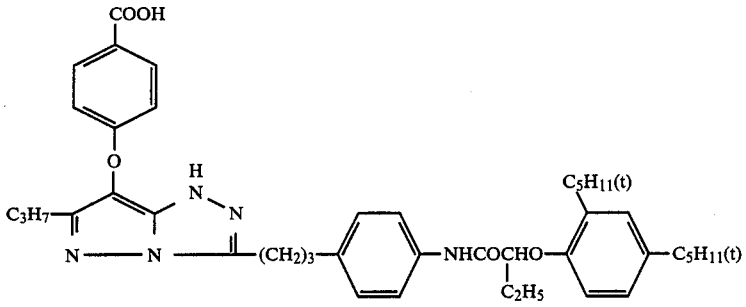
18
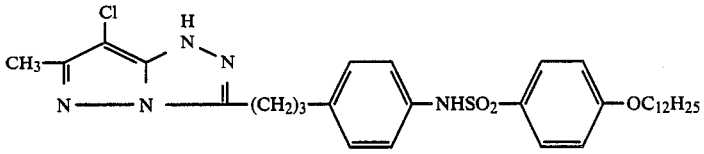
19
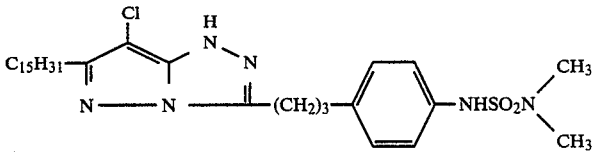
20
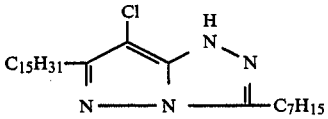
21
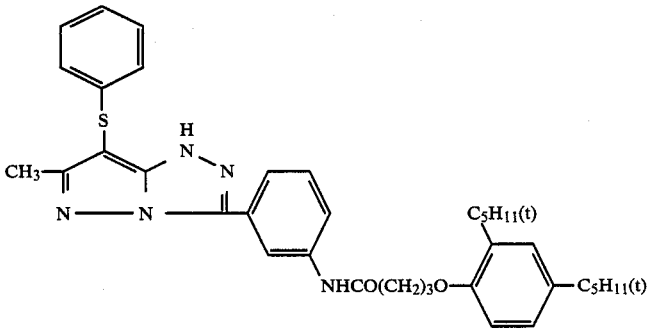
22
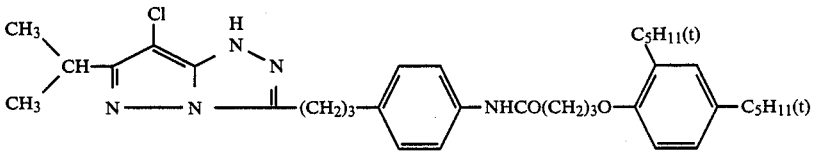
23
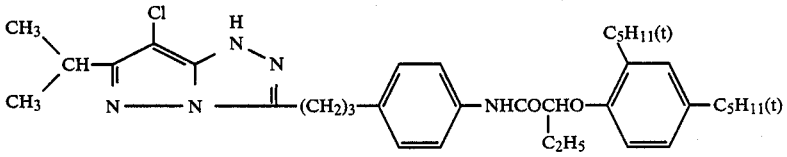
24
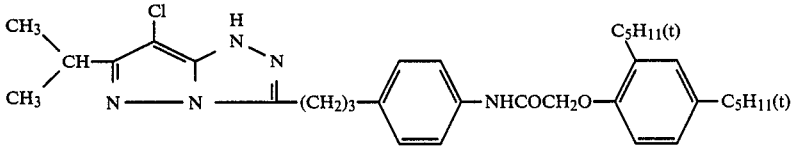

-continued

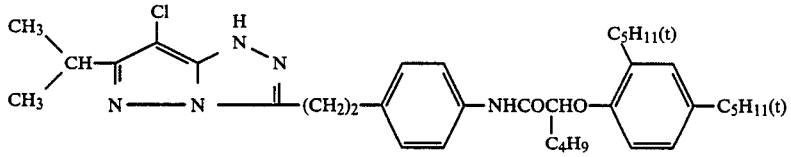

25

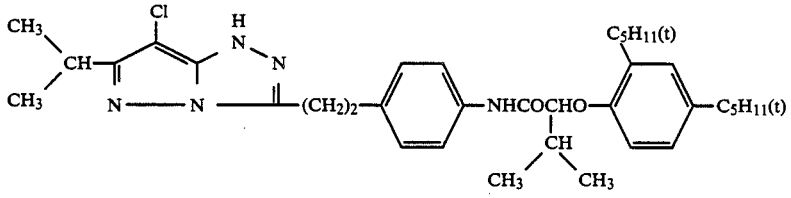

26

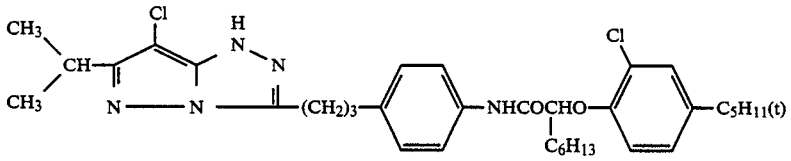

27

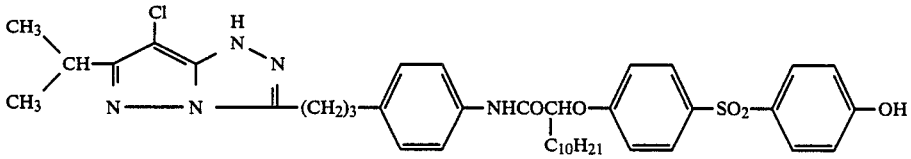

28

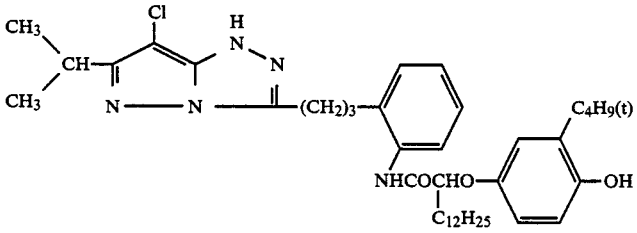

29

Any of these couplers may be synthesized by making reference to the Journal of the Chemical Society. Perkin I (1977), 2047–2052, U.S. Pat. No. 3,725,067, Japanese Patent O.P.I. Publication Nos. 99437/1984, 42045/1983, 162548/1984, 171956/1984, 33552/1985, 43659/1985, 172982/1985, 190779/1985 and the like.

The coupler of this invention may be used in the quantity range of normally from $1\times10^{-3}$ mole to 1 mole per mole of silver halide, and preferably from $1\times10^{-2}$ mole to $8\times10^{-1}$ mole.

And the coupler of this invention may be used in combination with different other magenta couplers.

In the present invention, those cyan couplers having Formula [III-1] and Formula [III-2] are used in combination.

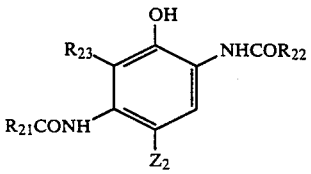

Formula [III-1]

-continued

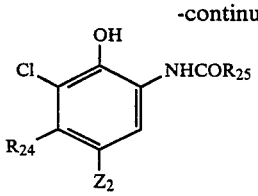

Formula [III-2]

In Formula [III-1], the alkyl group represented by $R_{21}$ is a straight-chain or branched-chain group, and the aryl group represented by the same is a phenyl group, a naphthyl group or the like. These groups represented by the $R_{31}$ also include those having a single substituent or a plurality of substituents.

The halogen atom represented by the $R_{23}$ is, e.g., a chlorine atom; the alkyl group is, e.g., a methyl, group; and the alkoxy group is, e.g., a methoxy group.

In this invention, the alkyl represented by the $R_{22}$ of the foregoing Formula [III-1] is, e.g., a hexyl group, pentadecyl group or polyfluoroalkyl group.

The aryl group represented by the $R_{22}$ is, e.g., a phenyl or naphthyl group, and preferably a phenyl group. The heterocyclic group represented by the $R_{22}$ is, e.g., a pyridyl, furan or the like group. The cycloalkyl group represented by the $R_{22}$ is, e.g., a cyclopropyl, cyclohexyl, or the like group. These groups represented by the $R_{22}$ may each have a single substituent or a plurality of substituents.

The preferred group represented by the $R_{22}$ is a polyfluoroalkyl group, a phenyl group, a halogen atom or a phenyl group having, as the substituent, one or two or more alkyl groups, alkoxy groups, alkoxy groups, alkylsulfonamido groups, arylsulfonamido groups, alkylsulfamoyl groups, arylsulfamoyl groups, alkylsulfonyl groups, arylsulfonyl groups, alkylcarbonyl groups, arylcarbonyl groups or cyano groups.

$Z_2$ is a hydrogen atom or a group that can be split off by the reaction with the oxidized product of a color developing agent.

The more preferred ones among cyan couplers having Formula [III-1] are those compounds having Formula [III-1']:

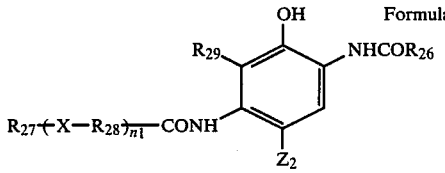

Formula [III-1']

In Formula [III-1'], $R_{26}$ is a phenyl group. The phenyl group includes one having a single substituent or a plurality of substituents. The substituent to be introduced is typified by a halogen atom, an alkyl group, a hydroxyl group, a cyano group, a nitro group, an alkoxy group, an alkylsulfonamido group, an arylsulfonamido group, an alkylsulfamoyl group, an arylsulfamoyl group, an alkyloxycarbonyl group, an aryloxycarbonyl group and the like. Two or more of these substituents may be introduced to the phenyl group. The preferred group represented by the $R_{26}$ is a phenyl group or a phenyl group having, as the substituent, one or two or more halogen atoms (preferably fluorine, chlorine, bromine), alkylsulfonamido groups (preferably o-methylsulfonamido, p-octylsulfonamido, o-dodecylsulfonamido), arylsulfonamido groups (preferably phenylsulfonamido), alkylsulfamoyl groups (preferably butylsulfamoyl), arylsulfamoyl groups (preferably phenylsulfamoyl), alkyl groups (preferably methyl, trifluoromethyl) or alkoxy groups (preferably methoxy, ethoxy).

$R_{27}$ is an alkyl or aryl group. The alkyl or aryl group includes those having a single substituent or a plurality of substituents. The substituent is typified by a halogen atom, a hydroxyl group, a carboxyl group, an alkyl group, a cyano group, a nitro group, an alkoxy group, an aryloxy group, an alkylsulfonamido groups, an arylsulfonamido group, an alkylsulfamoyl group, an arylsulfamoyl group, an alkyloxycarbonyl group, an aryloxycarbonyl group, an aminosulfonamido group, an alkylsulfonyl group, an arylsulfonyl group, an alkylcarbonyl group, an arylcarbonyl group, an aminocarbonylamido group, a carbamoyl group, a sulfinyl group, or the like. Two or more of these substituents may be introduced.

The preferred group represented by the $R_{27}$, when $n_1$ is zero, is an alkyl group, and, when $n_1$ is equal to or more than 1, is an aryl group. The more preferred group represented by the $R_{27}$, when $n_1$ is zero, is an alkyl group having from 1 to 22 carbon atoms (preferably methyl, ethyl, propyl, butyl, octyl, dodecyl), and, when $n_1$ is equal to or more than 1, is an unsubstituted phenyl group or a phenyl group having, as the substituent, one or two or more alkyl groups (preferably t-butyl, t-amyl, octyl), alkylsulfonamido groups (preferably butylsulfonamido, octylsulfonamido, dodecylsulfonamido), arylsulfonamido groups (preferably phenylsulfonamido), aminosulfonamido groups (preferably dimethylaminosulfonamido), or alkyloxycarbonyl groups (preferably methyloxycarbonyl, butyloxycarbonyl).

$R_{28}$ is an alkylene group, preferably a straight-chain or branched-chain alkylene group having from 1 to 20 carbon atoms, and more preferably an alkylene group having from 1 to 12 carbon atoms.

$R_{29}$ is a hydrogen atom or a halogen atom, and preferably a hydrogen atom.

$n_1$ is zero or an integer, and more preferably zero or 1.

$X_1$ is a divalent group such as —O—, —CO—, —COO—, —OCO—, $—SO_2NR_{20}—$, $—NR_{20}SO_2NR_{20}''—$, —S—, —SO— or $—SO_2—$ (wherein $R_{20}$, $R_{20}'$ and $R_{20}''$ each represents an alkyl group including one having a substituent), and preferably —O—, —S—, —SO— or $—SO_2$.

$Z_2$ is as defined in the $Z_2$ of Formula [III-1].

In the present invention, the straight-chain or branched-chain alkyl group having from 2 to 4 carbon atoms represented by the $R_{24}$ of the foregoing Formula [III-2] is, e.g., an ethyl, propyl, butyl, iso-propyl, iso-butyl, sec-butyl or tert-butyl group, and these include those having a substituent. The substituent is an acylamino group (such as acetylamino), an alkoxy group (such as methoxy) or the like.

The ballasting group represented by the $R_{25}$ is an organic group having a magnitude and form to cause the coupler molecular to be of a sufficient bulk to substantially prevent the diffusion of the coupler from the coupler-applied layer into other layers.

Examples representative of the ballasting group are alkyl or aryl groups whose total number of carbon atoms is from 8 to 32.

These alkyl or aryl groups include those having a substituent. The substituent to the aryl group is, for example, an alkyl, aryl, alkoxy, aryloxy, carboxy, acyl, ester, hydroxy, cyano, nitro, carbamoyl, carbonamido, alkylthio, arylthio, sulfonyl, sulfonamido or sulfamoyl group, or a halogen atom. The substituent to the alkyl group includes the same examples except the alkyl to the above aryl group. Above all, the preferred as the ballasting group are those having the following Formula [III-3]:

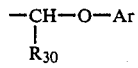

Formula [III-3]

wherein $R_{30}$ is a hydrogen atom or an alkyl group having from 1 to 12 carbon atoms, Ar is an aryl group such as a phenyl group. The aryl group includes those having a substituent. The substituent is an alkyl group, a hydroxy group, an alkylsulfonamido group or the like, and most preferably a branched-chain alkyl group such as a t-butyl group.

In Formula [III-1] and Formula [III-2], $Z_2$ is typified by, e.g., a halogen atom such as chlorine or fluorine, an alkoxy, aryloxy, arylthio, carbamoyloxy, acyloxy, sulfonyloxy, sulfonamido, heteroylthio, heteroyloxy, or the like group, and the particularly preferred one is a hydrogen atom or a chlorine atom.

The following are examples of the cyan coupler having Formula [III-1], but are not limited thereto.

C-1
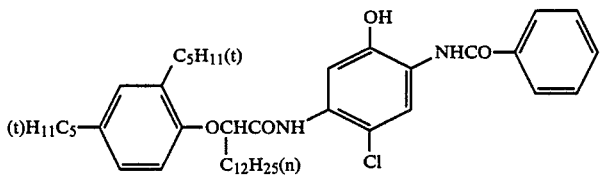
C-2
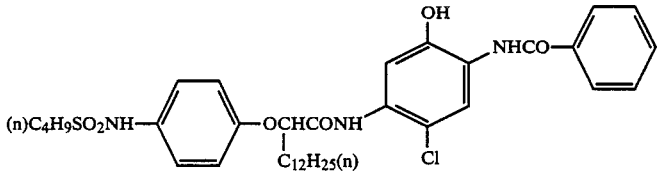
C-3
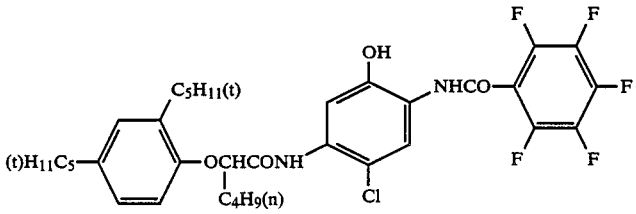
C-4
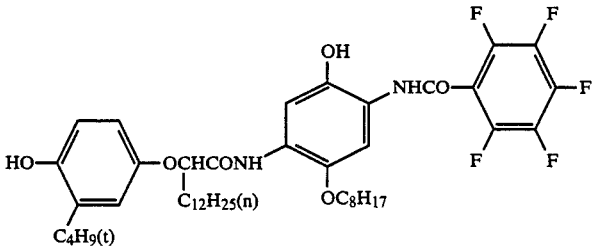
C-5
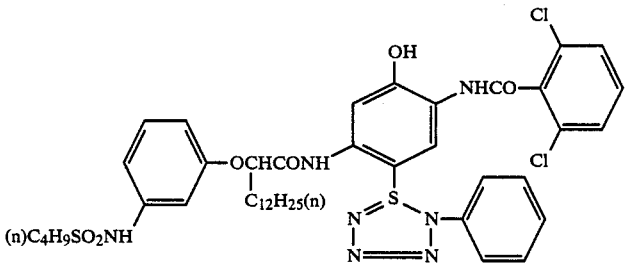
C-6
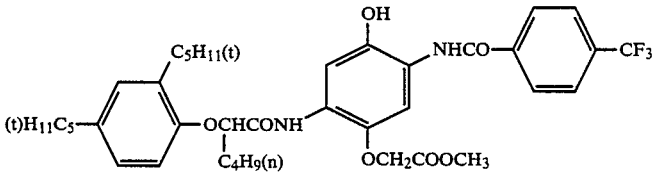
C-7
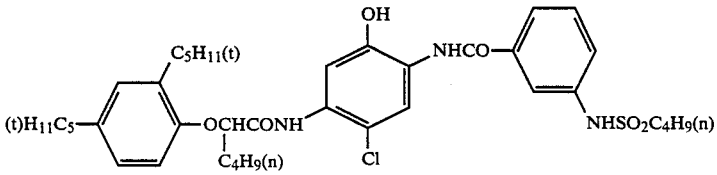

-continued
C-8
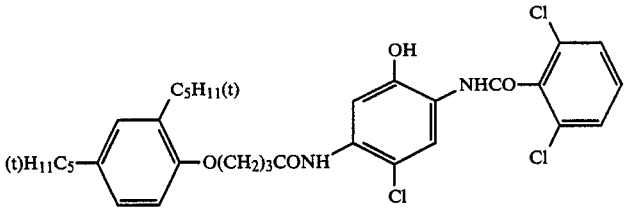
C-9
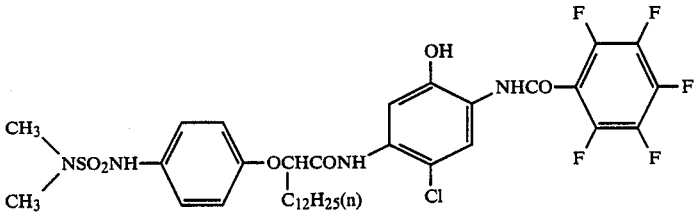
C-10
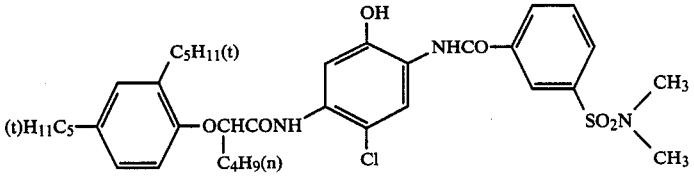
C-11
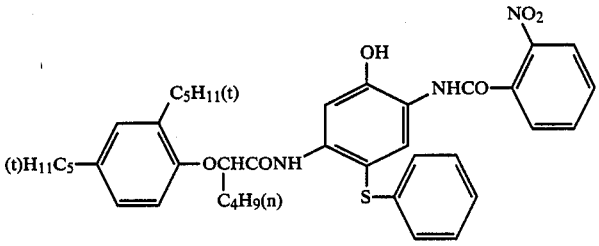
C-12
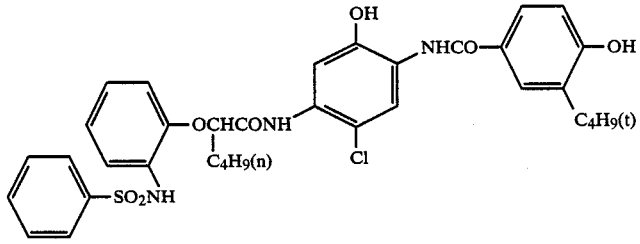
C-13
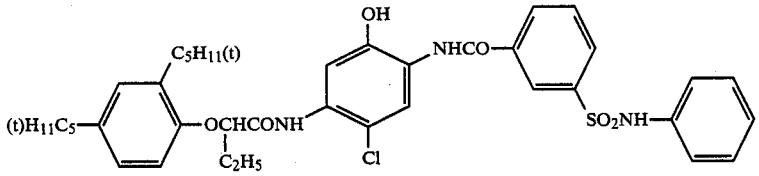
C-14
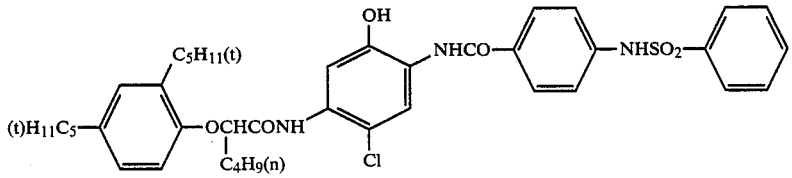

-continued
C-15
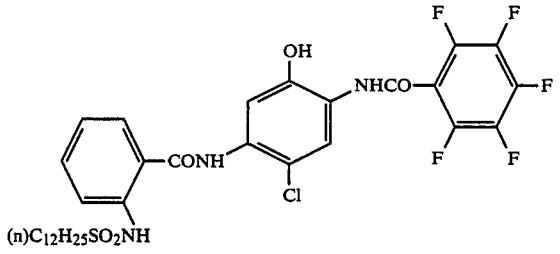
C-16
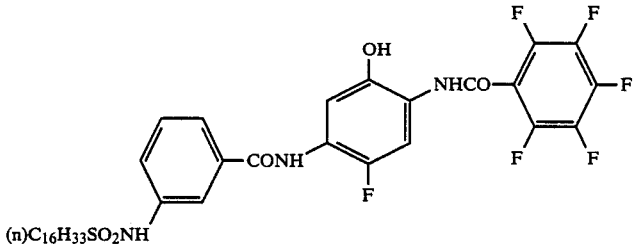
C-17
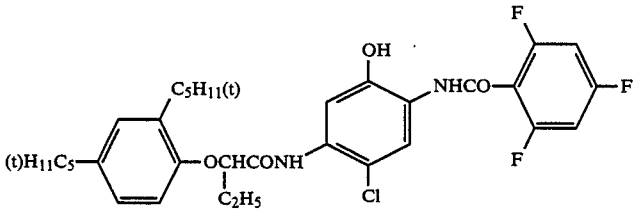
C-18
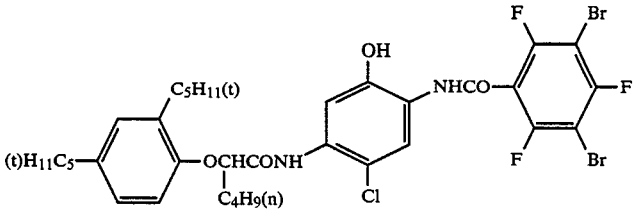
C-19
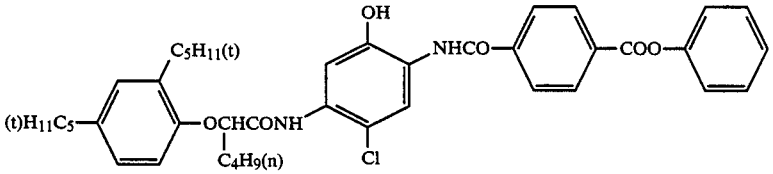
C-20
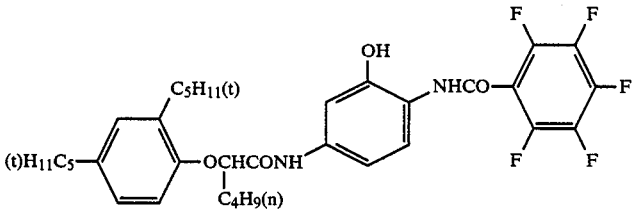
C-21
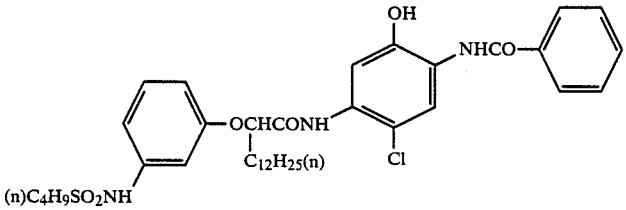

-continued
C-22
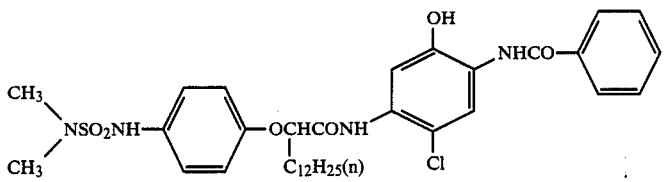
C-23
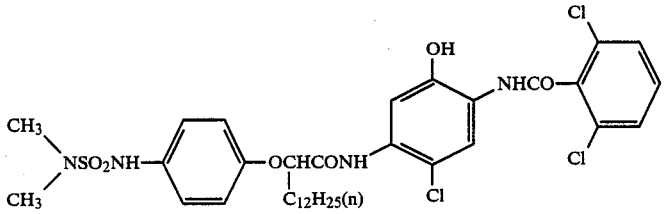
C-24
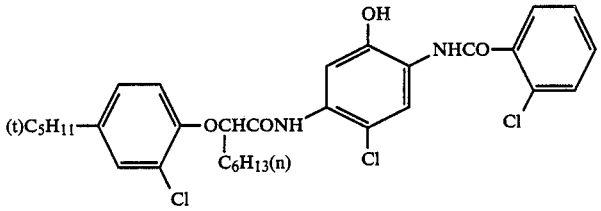
C-25
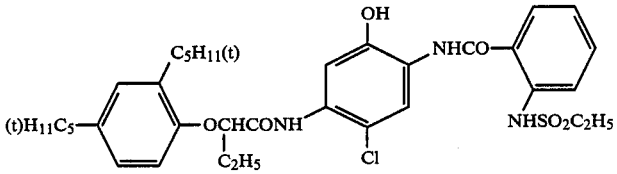
C-26
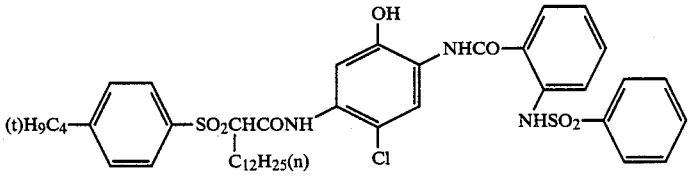
C-27
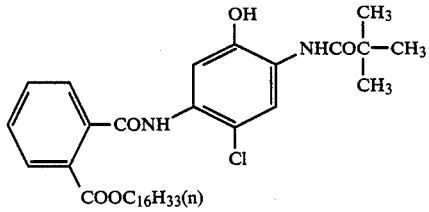
C-28
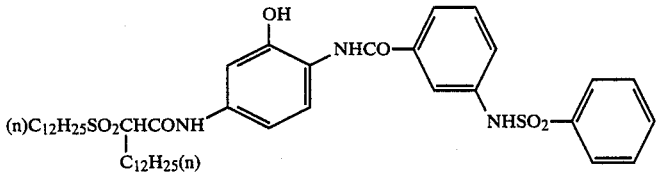
C-29
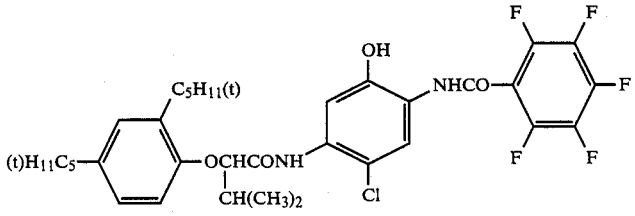

-continued

C-30

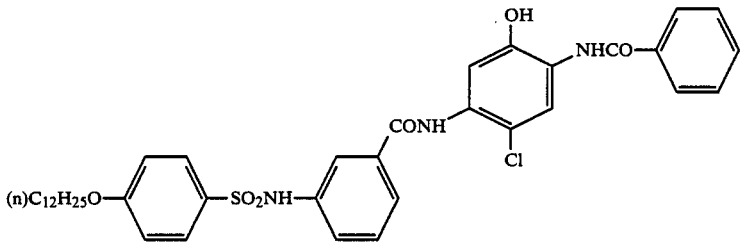

C-31

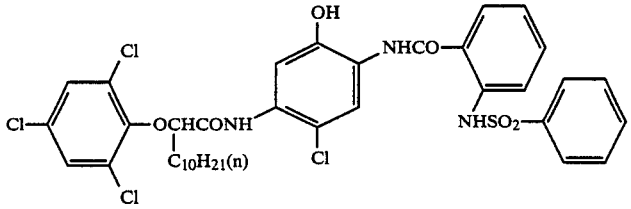

C-32

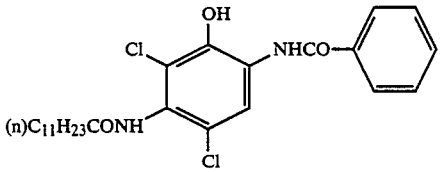

These cyan couplers having Formula [III-1] may be synthesized in accordance with those methods as described in Japanese Patent O.P.I. Publication Nos. 31935/1984, 121332/1984, 124341/1984, 139352/1984, 100440/1984, 166956/1984, 146050/1984, 112038/1975, 109630/1978 and 163537/1980, and U.S. Pat. No. 2,895,826, and the like.

Subsequently, the following are examples of the coupler having Formula [III-2], but are not limited thereto.

Formula [III-2]

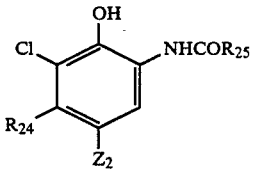

| Coupler No. | $R_{24}$ | $Z_2$ | $R_{25}$ |
|---|---|---|---|
| C-33 | $-C_2H_5$ | $-Cl$ | 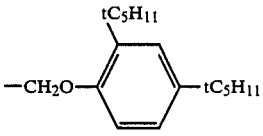 |
| C-34 | $-C_2H_5$ | 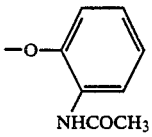 | 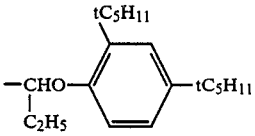 |
| C-35 | 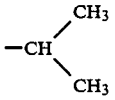 | $-Cl$ | 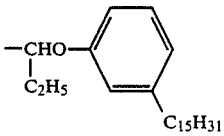 |
| C-36 | $-C_2H_5$ | $-Cl$ | 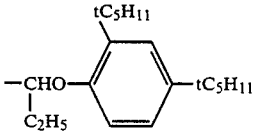 |

-continued
| Coupler No. | $R_{24}$ | $Z_2$ | $R_{25}$ |
|---|---|---|---|
| C-37 | $-C_2H_5$ | $-Cl$ | 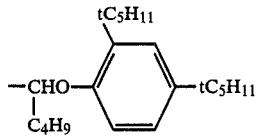 |
| C-38 | $-C_4H_9$ | $-F$ | 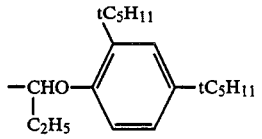 |
| C-39 | $-C_2H_5$ | $-F$ | 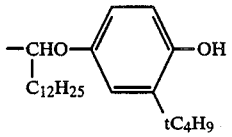 |
| C-40 | $-C_2H_5$ | $-Cl$ | 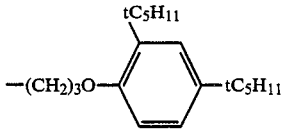 |
| C-41 | $-C_2H_5$ | $-F$ | 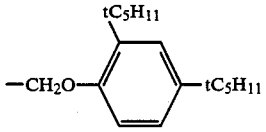 |
| C-42 | $-C_2H_5$ | $-Cl$ | 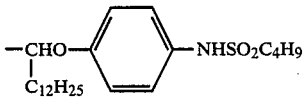 |
| C-43 | $-C_2H_5$ | $-Cl$ | 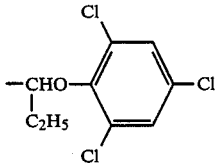 |
| C-44 | $-CH(CH_3)_2$ | $-Cl$ | $-C_{18}H_{37}$ |
| C-45 | $-C_2H_5$ | $-F$ | 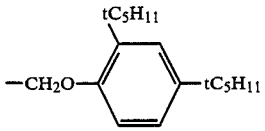 |
| C-46 | $-C_2H_5$ | $-Cl$ | 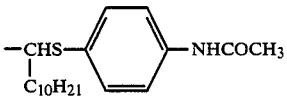 |
| C-47 | $-C_3H_7$ | $-Cl$ | 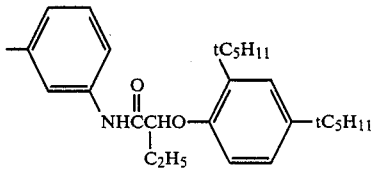 |

-continued
| Coupler No. | $R_{24}$ | $Z_2$ | $R_{25}$ |
|---|---|---|---|
| C-48 | $-C_3H_7$ | $-Cl$ | 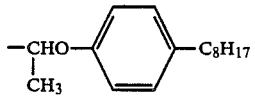 |
| C-49 | $-C_2H_4NHC(=O)CH_3$ | $-Cl$ | 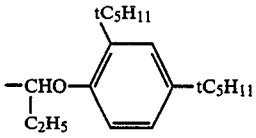 |
| C-50 | $-C_3H_6OCH_3$ | $-Cl$ | 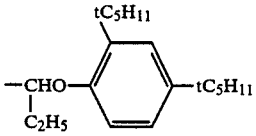 |
| C-51 | $-C_2H_5$ | $-Cl$ | 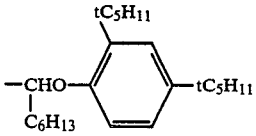 |
| C-52 | $-C_2H_5$ | $-Cl$ | 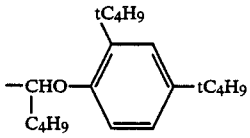 |
| C-53 | $-CH(CH_3)_2$ | $-Cl$ | 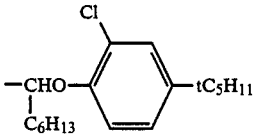 |
| C-54 | $-C_2H_5$ | $-Cl$ | 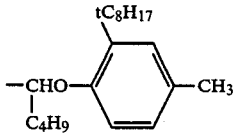 |
| C-55 | $-C_2H_5$ | $-Cl$ | 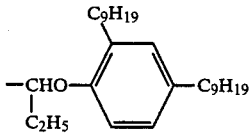 |
| C-56 | $-C_4H_9$ | $-OCH_2CH_2SO_2CH_3$ | 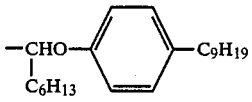 |
| C-51 | $-C_2H_5$ | $-Cl$ | 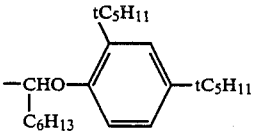 |
| C-52 | $-C_2H_5$ | $-Cl$ | 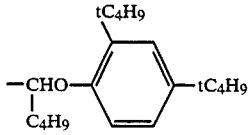 |

-continued

| Coupler No. | $R_{24}$ | $Z_2$ | $R_{25}$ |
|---|---|---|---|
| C-53 | $-CH(CH_3)_2$ | $-Cl$ | 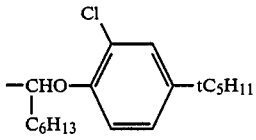 |
| C-54 | $-C_2H_5$ | $-Cl$ | 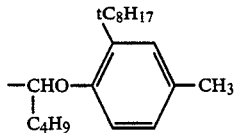 |
| C-55 | $-C_2H_5$ | $-Cl$ | 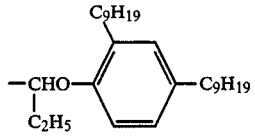 |
| C-56 | $-C_4H_9$ | $-OCH_2CH_2SO_2CH_3$ | 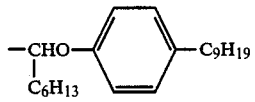 |

These cyan couplers having Formula [III-2] may be synthesized in accordance with those methods as described in Japanese Paten Examined Publication No. 11572/1974, Japanese Patent O.P.I. Publication Nos. 117249/1985, 205446/1985, 205447/1985 and 232550/1985, and U.S. Pat. No. 4,540,657, and the like. The cyan coupler having Formula [III-1] and the cyan coupler having Formula [III-2] are desirable to be used in combination in the proportional quantity range of from 10:90 to 90:10 mole%, more preferably from 20:80 to 80:20 mole% and most preferably from 30:70 to 70:30 mole%. Both cyan couplers may be used in the total amount range of normally from 0.05 to 2 moles per mole of silver halide, and more preferably from 0.1 to 1 mole.

The previously mentioned respective dye-forming couplers-containing silver halide emulsion layers of this invention contain a high-boiling organic solvent having a dielectric constant of not more than 6.0.

Useful examples of the high-boiling organic solvent having a dielectric constant of not more than 6.0 include such various ones as, e.g., esters such as phthalates, phosphates, etc., organic acid amides, ketones, hydrocarbon compounds, and the like, and are preferably those high-boiling organic solvents of which the dielectric constant is from 1.9 to 6.0, and the vapor pressure at 100° C. is not more than 0.5 mmHg, and more preferably the phthalates and phosphates out of these high-boiling organic solvents. The organic solvent to be used may be a mixture of two or more of these solvents, and in this instance, the dielectric constant of the mixture should be not more than 6.0. In addition, the dielectric constant herein means one at 30° C.

The phthalate to be used in this invention includes those having the following Formula [IV]:

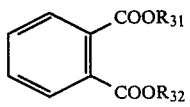

Formula [IV]

wherein $R_{31}$ and $R_{32}$ each is an alkyl, alkenyl or aryl group, provided that the total number of the carbon atoms of these groups represented by the $R_{31}$ and $R_{32}$ is from 8 to 32, and more preferably from 16 to 24.

In the present invention, the alkyl group represented by the $R_{31}$ or $R_{32}$ of Formula [IV] may be in the straight-chain or branched-chain form. The aryl group represented by the $R_{31}$ or $R_{32}$ is a phenyl, naphtyl or the like group, and the alkenyl group is, e.g., a hexenyl, heptenyl, octadecenyl or the like group. These alkyl, alkenyl and aryl groups also include those having a single substituent or a plurality of substituents.

The phosphates advantageously usable in this invention are those having the following Formula [V]:

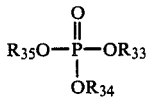

Formula [V]

wherein $R_{33}$, $R_{34}$ and $R_{35}$ each is an alkyl, alkenyl or aryl group, provided that the total number of the carbon atoms of the $R_{33}$, $R_{34}$ and $R_{35}$ is from 24 to 54.

These alkyl, alkenyl and aryl groups also include those having a single substituent or a plurality of substituents. The $R_{33}$, $R_{34}$ and $R_{35}$ each is preferably an alkyl group.

The following are typical examples of the high-boiling organic solvent having a dielectric constant of not more than 6.0 to be used in this invention, but are not limited thereto.

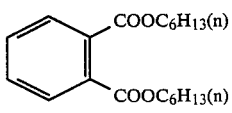

1

-continued

2 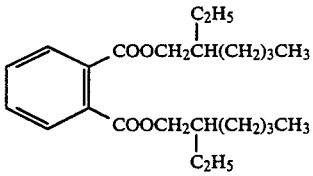

3 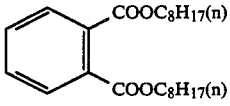

4 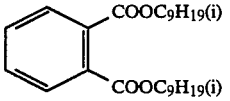

5 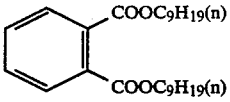

6 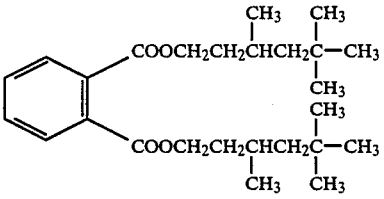

7 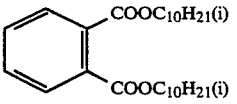

8 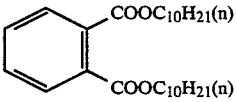

9 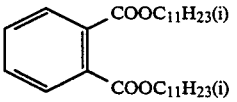

10 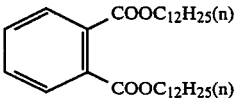

11 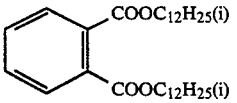

12 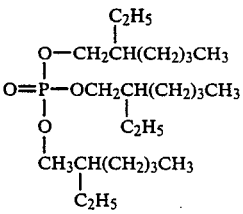

-continued

13 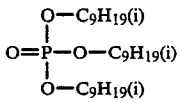

14 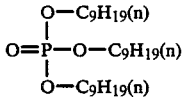

15 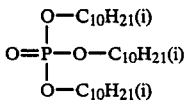

16 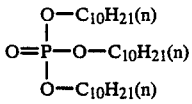

17 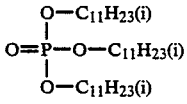

18 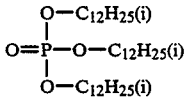

19 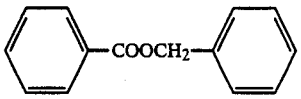

20 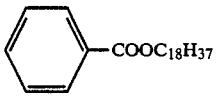

21 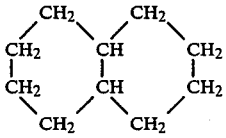

22 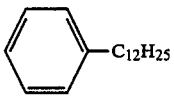

These high-boiling organic solvents each may be used in a proportion of from 10 to 150% by weight of the yellow dye forming coupler having the foregoing Formula [I], and preferably 20 to 100% by weight; in a proportion of from 10 to 150% by weight of the magenta dye forming coupler having the foregoing Formula [II], and preferably 20 to 100% by weight; and in a proportion of from 10 to 150% by weight of the total of both the cyan couplers of the foregoing Formulas [III-1] and [III-2], and preferably 20 to 100% by weight.

The high-boiling organic solvents having a dielectric constant of not more than 6.0 usable in this invention are preferably those high-boiling organic solvents having the foregoing Formulas [IV] and [V], and more preferably those phthalate-type high-boiling organic solvents having Formula [IV].

The addition to a silver halide emulsion of the yellow dye forming coupler having Formula [I], the magenta dye forming coupler having Formula [II] and the cyan dye forming couplers having Formulas [III-1] and [III-2] may be carried out by the application of the oil-in-water dispersion method which uses the foregoing high-boiling organic solvent having a dielectric constant of not more than 6.0 for dispersion; normally, the coupler is dissolved in a above-mentioned high-boiling organic solvent having a boiling point of not less than about 150° C., if necessary, in combination with a low-boiling and/or water-soluble organic solvent, the solution is then emulsifiedly dispersed using a surfactant into a hydrophilic binder such as an aqueous gelatin solution by use of a dispersing means such as a stirrer, homogenizer, colloid mill, flow-jet mixer or ultrasonic disperser, and after that the dispersed liquid is incorporated into the objective layer. In this instance, a process of removing the low-boiling solvent simultaneously with the dispersing step may be inserted.

The most preferred embodiment of this invention is such that the respective couplers of this invention are dispersed by using the high-boiling organic solvent of this invention thereby to be contained in the appropriate silver halide emulsion layers.

In the present invention, it is more desirable that a compound having the following Formula [a] and/or a compound having the following Formula [b] are contained in each of the silver halide emulsion layer containing an yellow dye forming coupler having Formula [I] and the silver halide emulsion layer containing a cyan dye forming coupler having Formula [III-1] and a cyan dye forming coupler having Formula [III-2].

Of these the most preferred is the case where a compound having the following Formula [a] is contained in both the silver halide emulsion layer containing the yellow dye forming coupler and the silver halide emulsion layer containing the cyan dye forming couplers.

Formula [a]

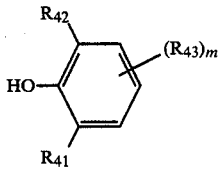

wherein $R_{41}$ and $R_{42}$ each is an alkyl group, $R_{43}$ is an alkyl group, a —NR'R"group, a —SR'group (wherein R' is a monovalent organic group) or a —COOR" group (wherein R" is a hydrogen atom or a monovalent organic group), and m is an integer of from zero up to 3.

Formula [b]

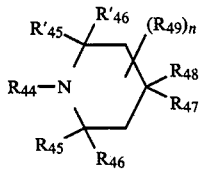

wherein $R_{44}$ is a hydrogen atom, a hydroxyl group, an oxy radical (—Ȯ), a —SOR' group, a —$SO_2$R' group (wherein R' is a monovalent organic group), an alkyl group, an alkenyl group, an alkinyl group or a —COR" group (wherein R" is a hydrogen atom or a monovalent organic group), $R_{45}$, $R_{46}$, $R'_{45}$, $R'_{46}$ and $R_{49}$ each is an alkyl group, $R_{47}$ and $R_{48}$ each is a hydrogen atom or a —$OCOR_{50}$ group (wherein $R_{50}$ is a monovalent organic group) or are allowed to form a heterocyclic group in cooperation with each other, and n is an integer of from zero to 4.

In the present invention, the alkyl group represented by the $R_{41}$ or $R_{42}$ of Formula [a] is preferably an alkyl group having from 1 to 12 carbon atoms, more preferably an α-position-branched-chain alkyl group having from 3 to 8 carbon atoms, and most preferably a t-butyl or t-pentyl group.

The alkyl group represented by the $R_{43}$ is a straight-chain or branched-chain alkyl group. The alkyl group also includes those having a substituent. The substituent is, for example, a halogen atom, a hydroxyl group, a nitro group, an aryl group, an amino group, an alkyloxycarbonyl group, an aryloxycarbonyl group, a carbamoyl group, or a heterocyclic group such as an isocyanuryl group, 1,3,5-triazinyl group, or the like. The typical examples of the —NR'R" group represented by the $R_{43}$ includes alkylamino groups such as, e.g., a dimethylamino, diethylamino, methylethylamino, or like group, arylamino groups such as phenylamino group, hydroxylphenylamino, etc., cycloalkyl groups such as cyclohexyl, etc., heterocyclic amino groups such as 1,3,5-triazinyl, isocyanuryl, and the like. The monovalent organic group represented by the R' or R" includes, for example, alkyl groups, aryl groups, cycloalkyl groups, heterocyclic groups, and the like. These organic groups include those having a substituent. The substituent is, for example, a halogen atom, a hydroxyl group, a nitro group, a cyano group, an amino group, an alkyl group, an aryl group, an alkenyl group, an alkylcarbonyloxy group, an arylcarbonyloxy group or the like.

In the present invention, the preferred among the compounds having Formula [a] are those compounds having the following Formula [a']:

Formula [a']

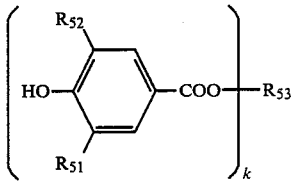

wherein $R_{51}$ and $R_{52}$ each is a straight-chain or branched-chain alkyl group having from 3 to 8 carbon atoms, particularly a t-butyl or t-pentyl group, and $R_{53}$ is a k-valent organic group, wherein k is an integer of from 1 to 6.

Examples of the k-valent organic group represented by the $R_{53}$ include, e.g., alkyl groups such as methyl, propyl, hexadecyl, methoxyethyl, benzyl, etc., alkenyl groups such as allyl, propenyl, etc., polyvalent unsaturated hydrocarbon groups such as ethylene, trimethylene, 2-chlorotrimethylene, etc., unsaturated hydrocarbon groups such as glyceryl, dipentaerythrityl, etc., alicyclic hydrocarbon groups such as cyclopropyl, cyclohexyl, etc., aryl groups such as phenyl, 2,4-dimethylphenyl, 2,4-di-butylphenyl, p-chlorophenyl, naphthyl, etc., arylene groups such as phenylene, 3,5-dimethyl-1,4-phenylene, naphthalene, etc., 1,3,5-trisubstituted benzene groups, and the like.

The $R_{53}$, besides the above groups, also includes those k-valent organic groups, arbitrary ones out of the above groups, which link through a —O—, —S— or —$SO_2$— group.

The most preferred groups represented by the $R_{53}$ are 2,4-di-t-butylphenyl, 2,4-di-t-pentylphenyl, p-octylphenyl, p-dodecylphenyl, 3,5-di-t-butyl-4-hydroxyphenyl and 3,5-di-t-pentyl-4-hydroxypheny groups.

The k is preferably an integer of from 1 to 4.

The following are examples of the compound having the foregoing Formula [a], but this invention is not limited by the examples.

(1)

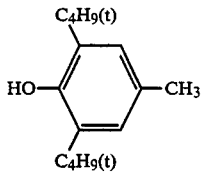

(2)

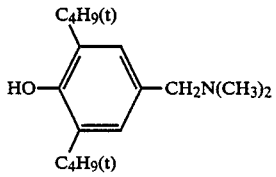

(3)

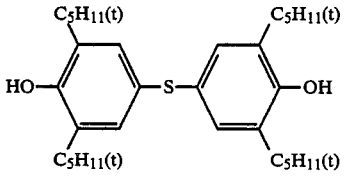

(4)

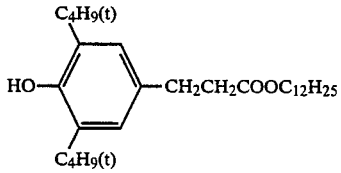

(5)

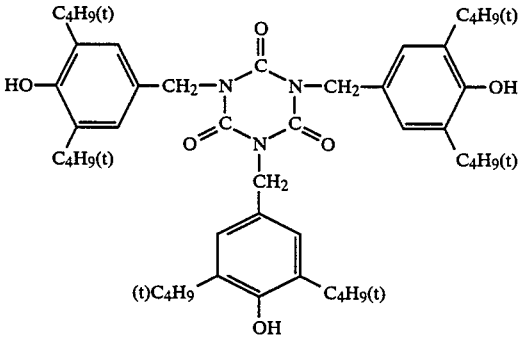

(6)

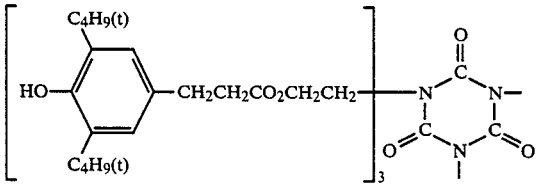

-continued (7)

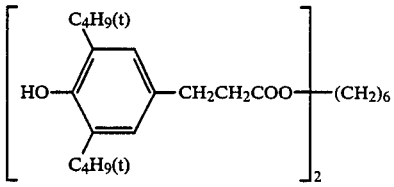

(8)

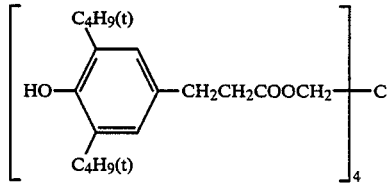

(9)

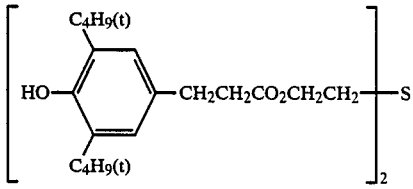

(10)

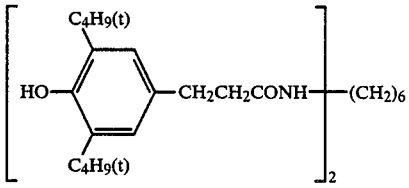

(11)

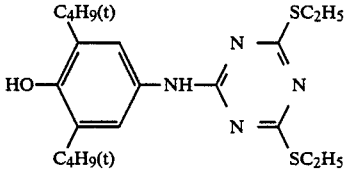

(12)

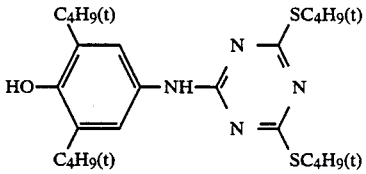

(13)

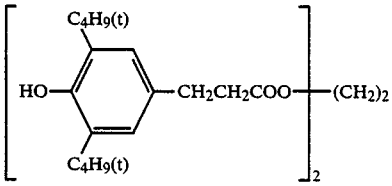

(14)

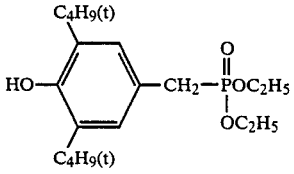

-continued
(15)
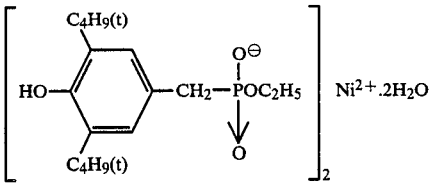
(16)
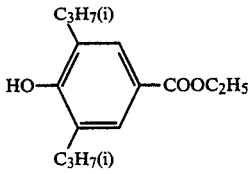
(17)
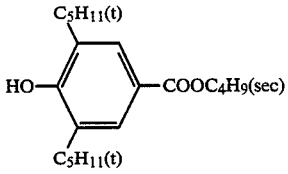
(18)
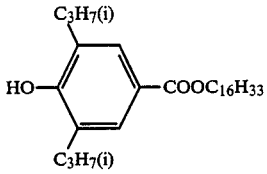
(19)
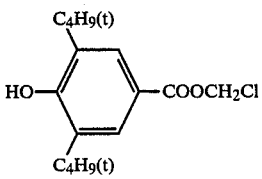
(20)
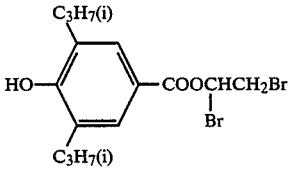
(21)
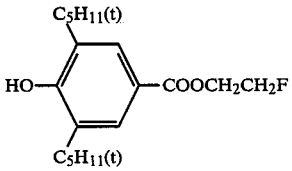
(22)
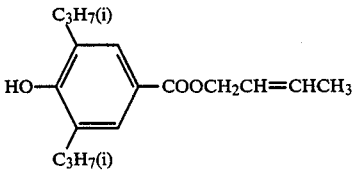
(23)
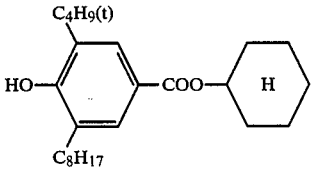
-continued
(24)
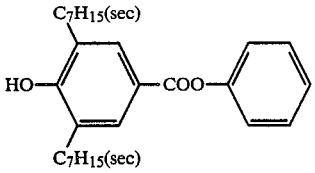
(25)
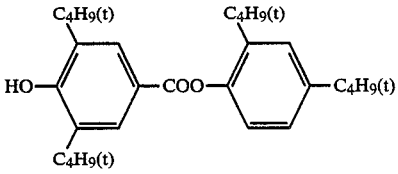
(26)
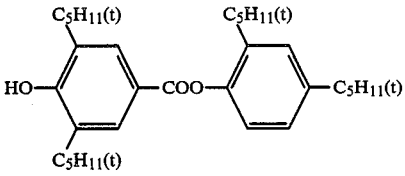
(27)
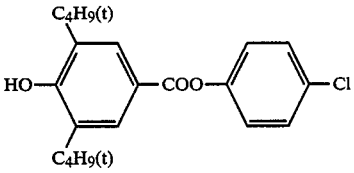
(28)
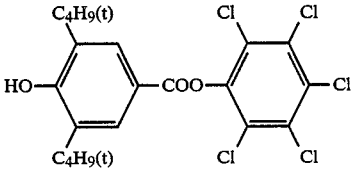
(29)
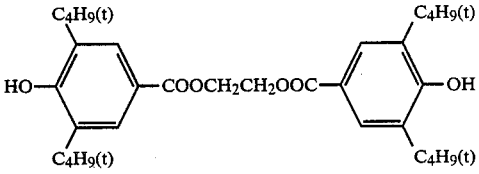
(30)
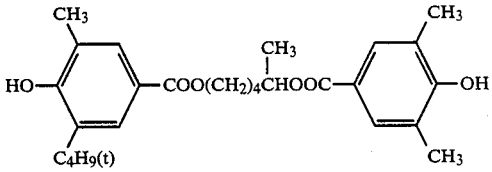
(31)
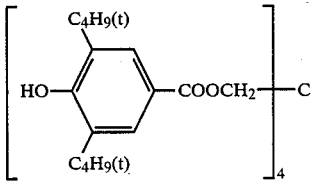

-continued
(32)
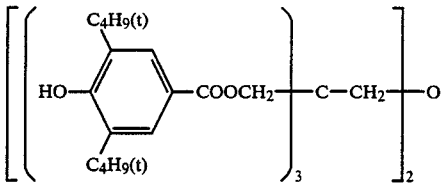
(33)
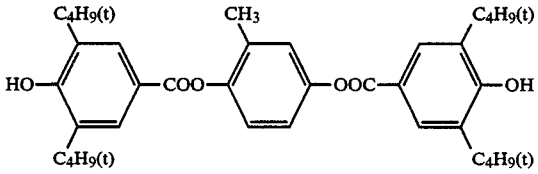
(34)
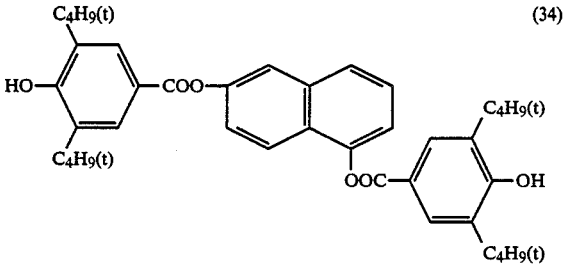
(35)
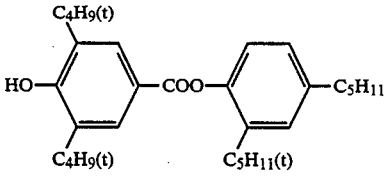
(36)
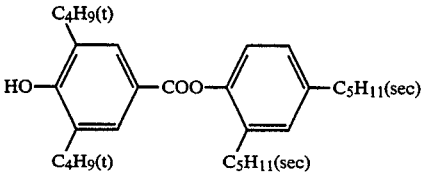
(37)
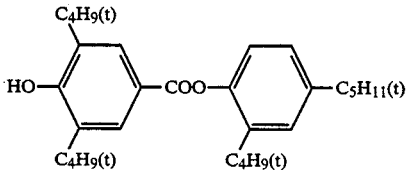
(38)
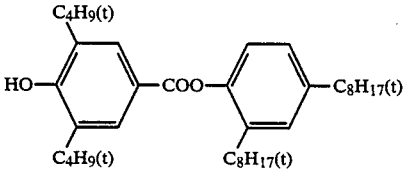
(39)
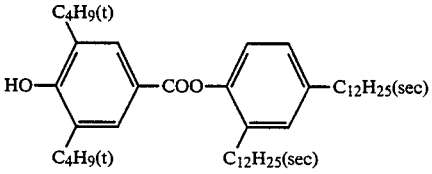
-continued
(40)
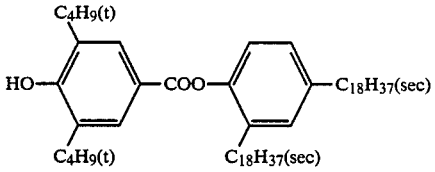
(41)
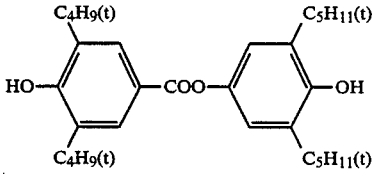
(42)
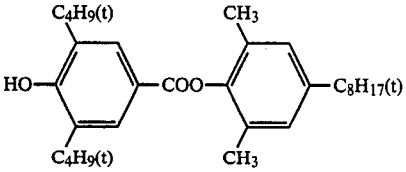
(43)
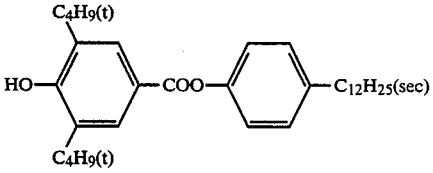
(44)
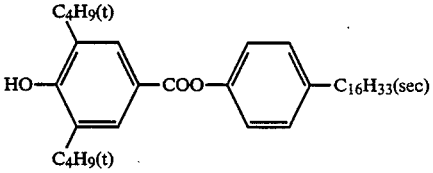
(45)
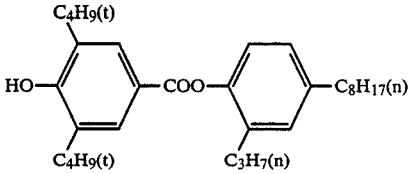
(46)
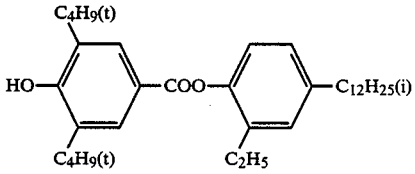
(47)
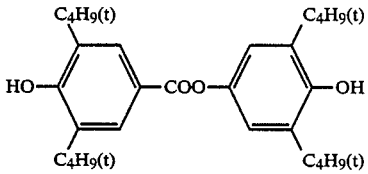
(48)
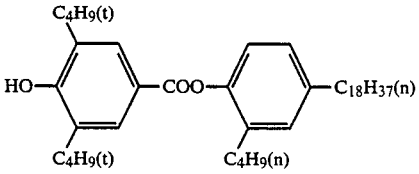

The alkyl group represented by the $R_{44}$ of Formula [b] is preferably an alkyl group having from 1 to 12 carbon atoms, and the alkenyl or alkinyl group is preferably one having from 2 to 4 carbon atoms. The monovalent organic group represented by the R' or R'' is, for example, an alkyl, alkenyl, alkinyl, or aryl group. The $R_{44}$ is preferably a hydrogen atom, an alkyl group, an alkenyl group, an alkinyl group or a —COR'' group. The R'' is preferably an alkyl group, an alkenyl group, an alkinyl group, or an aryl group.

The alkyl group represented by the $R_{45}$, $R_{46}$, $R'_{45}$, $R'_{46}$ or $R_{49}$ is preferably a straight-chain or branched-chain alkyl group having from 1 to 5 carbon atoms, and particularly preferably a methyl group.

In the $R_{47}$ and $R_{48}$, the monovalent organic group represented by the $R_{50}$ is, for example, an alkyl group, an alkenyl group, an alkinyl group, an aryl group, an alkylamino group or an arylamino group. The heterocyclic group formed by the $R_{47}$ and $R_{48}$ in cooperation with each other includes, e.g., those having the formulas:

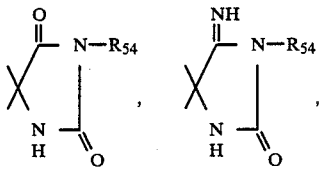

(wherein $R_{54}$ is a hydrogen atom, an alkyl, cycloalkyl or phenyl group), and the like.

In the present invention, the preferred among the compounds having Formula [b] are those having the following Formula [b']:

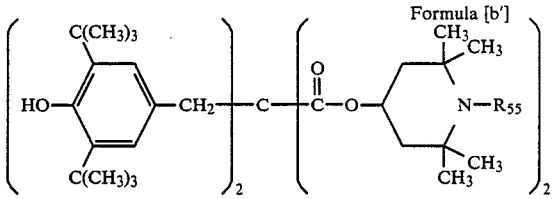

wherein $R_{55}$ is an alkyl group, an alkenyl group, an alkinyl group, or an acyl group.

The most preferred groups represented by the $R_{55}$ are methyl, ethyl, vinyl, allyl, propinyl, benzyl, acetyl, propionyl, acryloyl, methacryloyl and crotonoyl groups.

The following are examples of the compound having Formula [b], but the present invention is not limited by the examples.

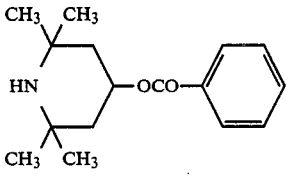

(49)

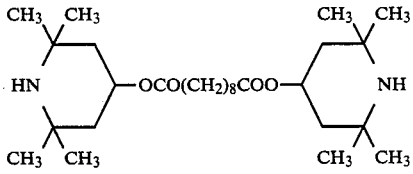

(50)

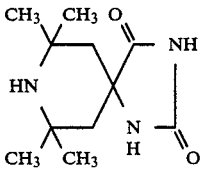

(51)

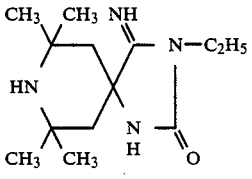

(52)

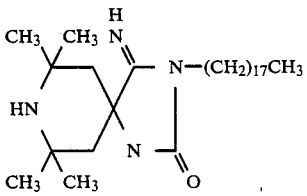

(53)

-continued
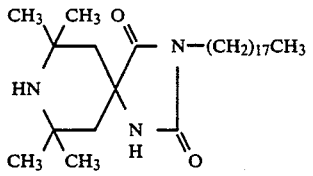
(54)
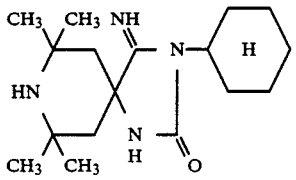
(55)
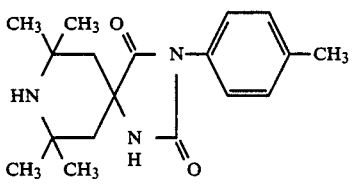
(56)
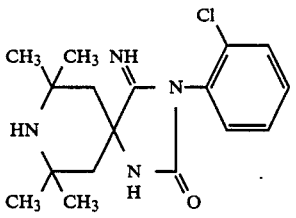
(57)
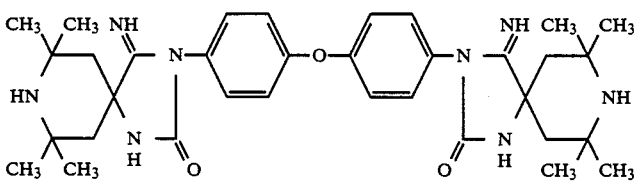
(58)
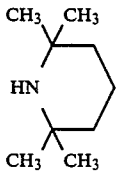
(59)
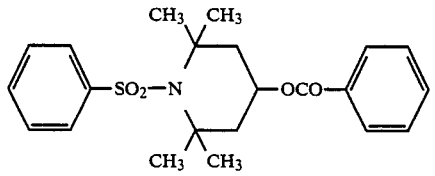
(60)
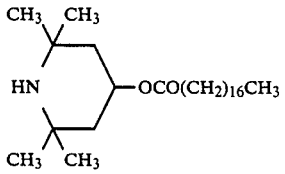
(61)

-continued
(62)
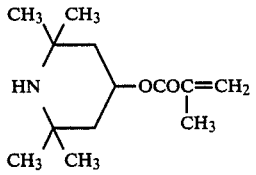
(63)
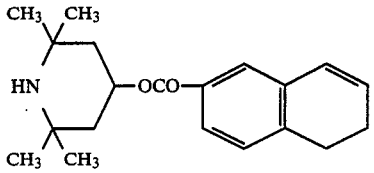
(64)
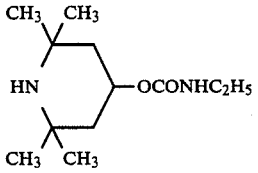
(65)
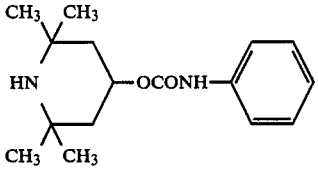
(66)
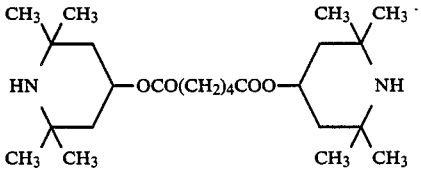
(67)
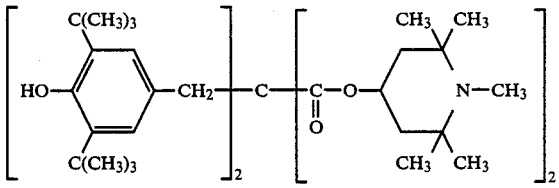
(68)
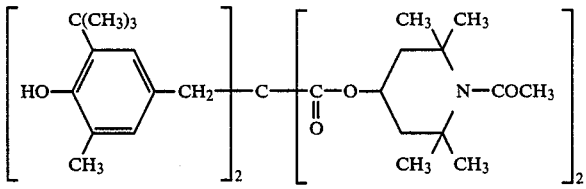
(69)
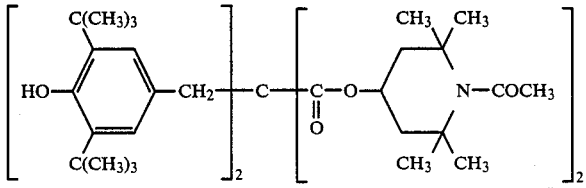

-continued
(70)
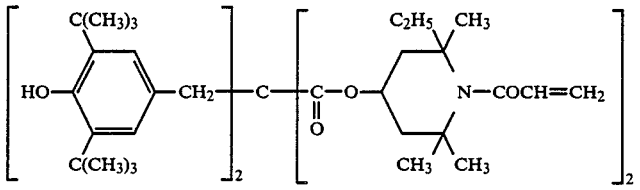
(71)
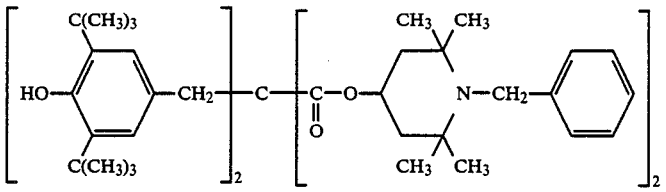
(72)
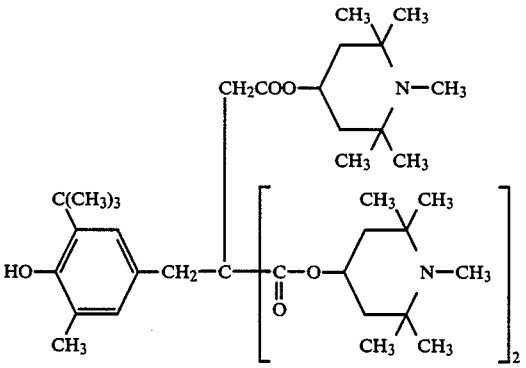
(73)
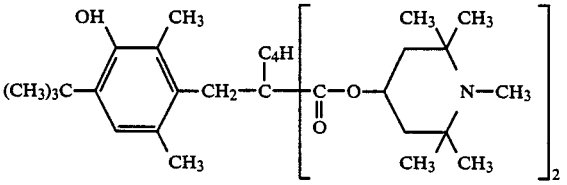
(74)
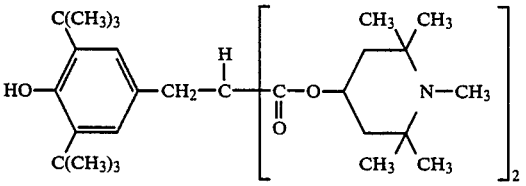
(75)
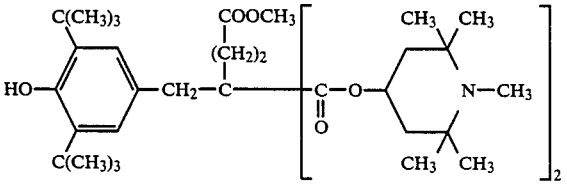

-continued
(76)
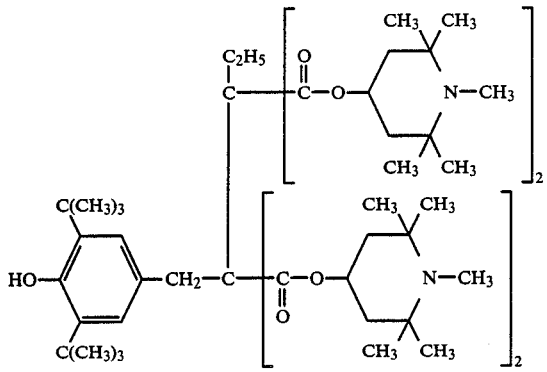
(77)
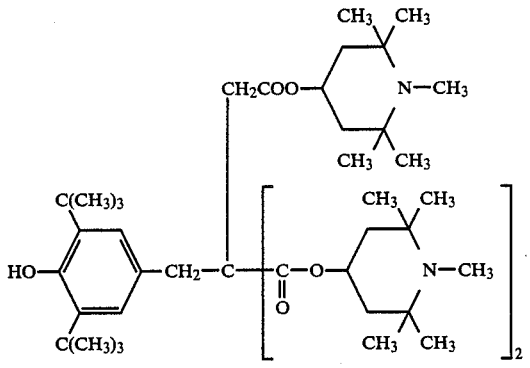
(78)
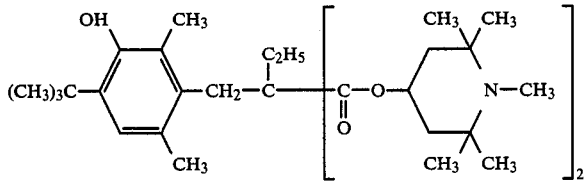
(79)
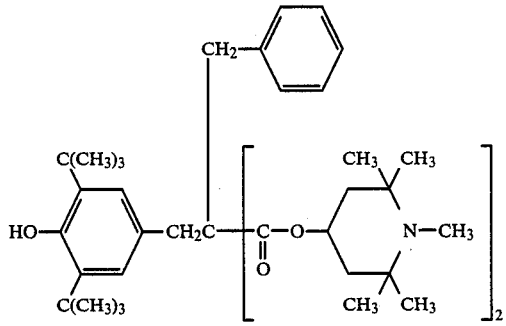
(80)
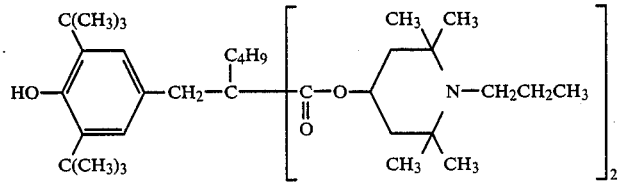

-continued

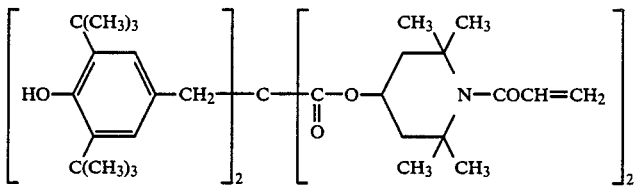
(81)

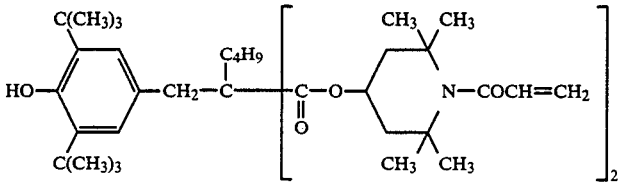
(82)

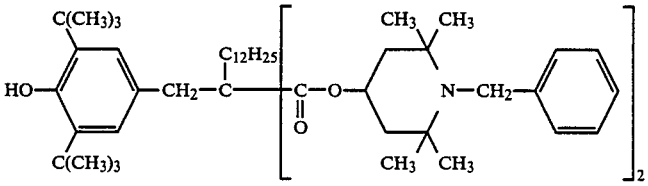
(83)

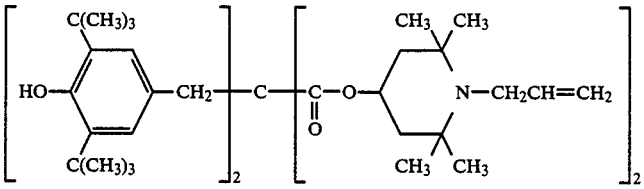
(84)

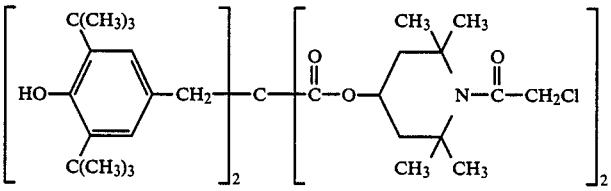
(85)

The silver halide color photographic light-sensitive material can be, for example, a color negative film or positive film or a color photographic paper, and above all, where it is used as a color photographic paper to be provided for direct appreciation, can display significantly the effect of the method of the present invention.

The particularly preferred layer arrangement of the silver halide color photographic light-sensitive material of this invention is such that on a support are provided in order from the support side an yellow dye image forming layer, an interlayer, a magenta dye image forming layer, an interlayer, a cyan dye image forming layer, an interlayer and a protective layer.

For the silver halide emulsion to be used in the silver halide color photographic light-sensitive material of this invention (hereinafter referred to as the silver halide emulsion of this invention), an arbitrary silver halide that is commonly used in ordinary silver halide emusions may be used.

The silver halide emulsion of this invention may be optically sensitized to a desired wavelength region.

To the silver halide emulsion of this invention may be added a compound known as the antifoggant or stabilizer to those skilled in the art during the chemical ripening and/or upon completion of the chemical ripening and/or after completion of the chemical ripening up to the time immediately before coating the silver halide emulsion for the purpose of preventing the fog possibly occurring during the manufacture, storage or photographic processing of the photographic light-sensitive material and/or keeping the photographic characteristics thereof stable.

An anticolor-stain agent may be used for the prevention of the deterioration of the color purity and sharpness or of the conspicuousness of the graniness due to the oxidized product of a color developing agent or electron transfer agent transferring between the emulsion layers (between the emulsion layers having the same color sensitivity and/or the emulsion layers different in the color sensitivity).

The anticolor-stain agent may be used either in the emulsion layer itself or in the interlayer provided between the adjacent emulsion layers.

The anticolor-stain agent suitably usable in this invention includes those compounds having the following Formula [VI]:

Formula [VI]

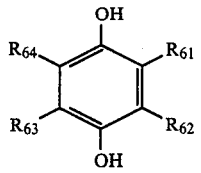

wherein $R_{61}$, $R_{62}$, $R_{63}$ and $R_{64}$ each is a hydrogen atom, a halogen atom, an alkyl, alkenyl, aryl, cycloalkyl, alkoxy, aryloxy, alkylthio, arylthio, acyl, alkylacylamino, arylacylamino, alkylcarbamoyl, arylcarbamoyl, alkylsulfonamido, arylsulfonamido, alkylsulfamoyl, arylsulfamoyl, alkylsulfonyl, arylsulfonyl, nitro, cyano, alkyloxycarbonyl, aryloxycarbonyl, alkylacyloxy or arylacyloxy group, provided that at least one of the $R_{61}$, $R_{62}$, $R_{63}$ and $R_{64}$ is a group the total number of the carbon atoms of which is not less than 6.

Among the compounds having the foregoing Formula [VI] those having the following Formula [VI-1] can be particularly suitably used in this invention.

Formula [VI-1]

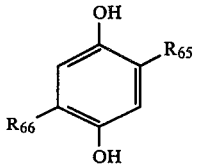

wherein $R_{65}$ and $R_{66}$ each is a hydrogen atom, an alkyl, alkenyl, aryl, acyl, cycloalkyl or heterocyclic group, provided that at least one of the $R_{65}$ and $R_{66}$ is a group the total number of the carbon atoms of which is not less than 6.

In Formula [VI-1], the preferred alkyl groups represented by the $R_{65}$ or $R_{66}$ particularly include those having from 1 to 32 carbon atoms.

The preferred alkenyl groups particularly include those having from 2 to 32 carbon atoms.

The aryl group is such as phenyl, naphthyl; the acyl group is such as acetyl, octanoyl, lauroyl; the cycloalkyl group is such as cyclohexyl, cyclopentyl; and the heterocyclic group is such as imidazolyl, furyl, pyridyl, triazinyl, thiazolyl.

In Formula [VI], at least one of the $R_{65}$ and $R_{66}$ is preferably a group the total number of the carbon atoms of which is not less than 8, more preferably the total number of the carbon atoms of each group of both $R_{65}$ and $R_{66}$ is from 8 to 18, and most preferably both $R_{65}$ and $R_{66}$ represent the same group the total number of the carbon atoms of which is from 8 to 18.

The following are examples of the compound having Formula [VI] to be used in the present invention, but it goes without saying that this invention is not limited by the examples.

(HQ-1)

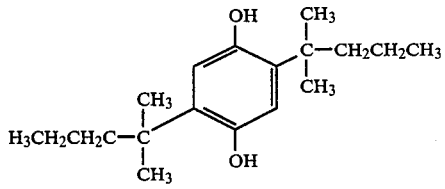

(HQ-2)

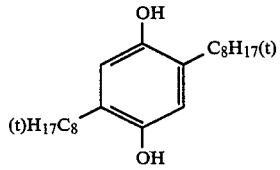

(HQ-3)

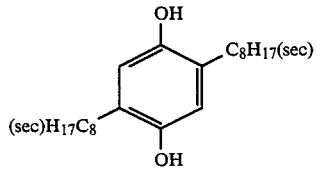

(HQ-4)

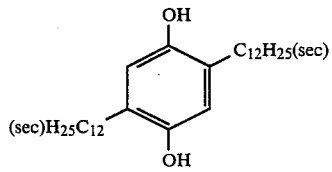

(HQ-5)

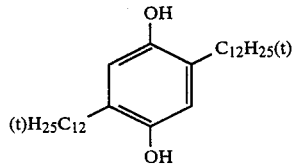

-continued
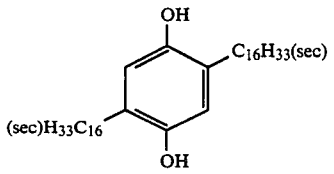
(HQ-6)
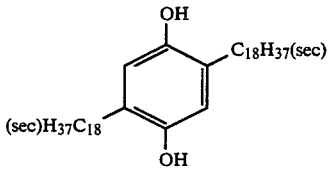
(HQ-7)
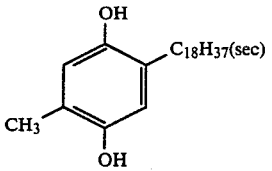
(HQ-8)
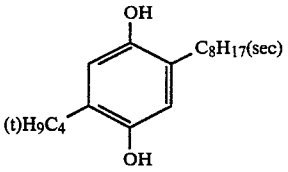
(HQ-9)
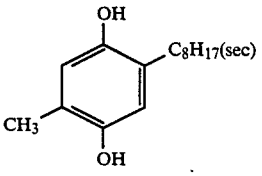
(HQ-10)
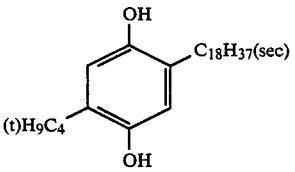
(HQ-11)
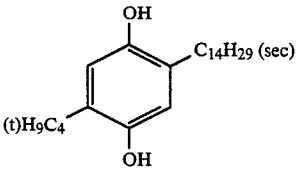
(HQ-12)
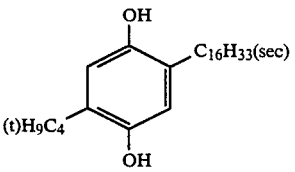
(HQ-13)
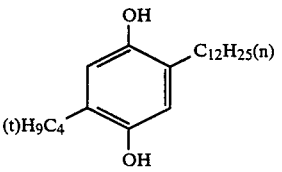
(HQ-14)

-continued
(HQ-15)
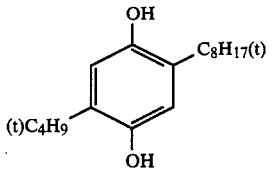
(HQ-16)
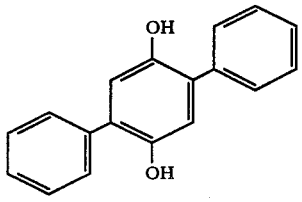
(HQ-17)
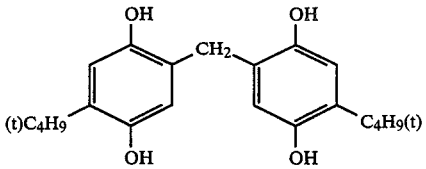
(HQ-18)
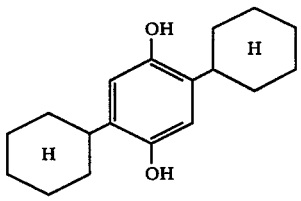
(HQ-19)
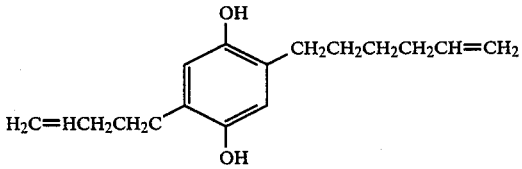
(HQ-20)
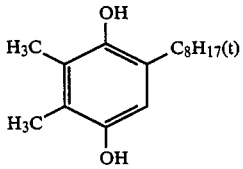
(HQ-21)
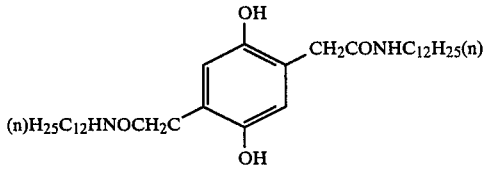
(HQ-22)
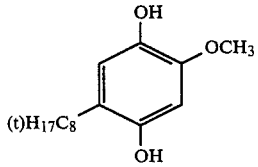

-continued (HQ-23)

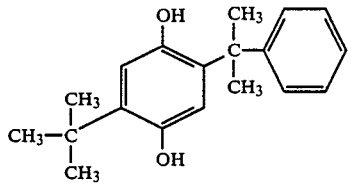

(HQ-24)

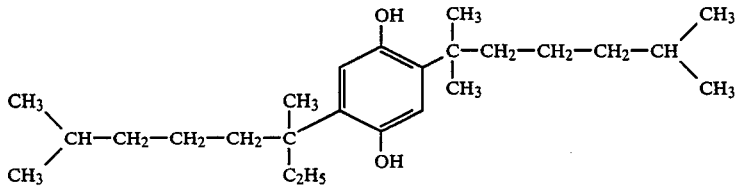

These compounds are described in, e.g., Research Disclosure No. 176 (1978), 17643, VII, I.

Any of these compounds having Formula [VI] may be incorporated in any of the silver halide emulsion layer and nonlight-sensitive layer, and the adding quantity thereof is not particularly restricted, but preferably from $1\times10^{-8}$ to $1\times10^{-4}$ mole/dm$^2$.

In the silver halide color photographic light-sensitive material of this invention an image stabilizer may be used to prevent the deterioration of the resulting dye image therefrom.

Image stabilizers suitably usable in this invention include those compounds having the following Formulas [A] through [H] and [J] and [K], and such compounds are desirable to be used particularly in combination with the magenta coupler having the foregoing Formula [II].

Formula [A]

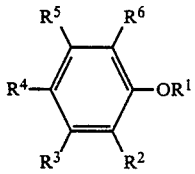

wherein $R^1$ is a hydrogen atom, an alkyl, alkenyl, aryl or heterocyclic group, $R^2$, $R^3$, $R^5$ and $R^6$ each is a hydrogen atom, a halogen atom, a hydroxy, alkyl, alkenyl, aryl, alkoxy or acylamino group, and $R^4$ is an alkyl, hydroxy, aryl or alkoxy group, provided that the $R^1$ and $R^2$ are allowed to close with each other to form a 5- or 6-member ring, and in this case the $R^4$ represents a hydroxy or alkoxy group, and also the $R^3$ and $R^4$ are allowed to close with each other to form a 5-member hydrocarbon ring, and in that case the $R^1$ represents an alkyl, aryl or heterocyclic group, except where the $R^1$ is a hydrogen atom and the $R^4$ is a hydroxy group.

The ring formed by the $R^1$ and $R^2$ closing with each other is such as chroman, chraman, methylenedioxybenzene or the like.

The ring formed by the $R^3$ and $R^4$ closing with each other is such as indan. These rings each is allowed to have a substituent (such as alkyl, alkoxyl aryl).

An atom of the ring formed by the $R^1$ and $R^2$ or the $R^3$ and $R^4$ closing with each other may be used as a spiro atom to form a spiro compound, and the $R^2$ or $R^4$ may be used as a linkage group to form a bis-type compound.

The preferred among the phenol-type compounds or phenyl-ether-type compounds having the foregoing Formula [A] are biindan compounds having four RO-groups (wherein R is an alkyl, alkenyl, aryl or heterocyclic group), and the particularly preferred compounds are those having the following Formula [A-1]:

Formula [A-1]

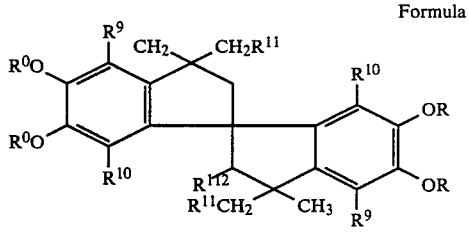

wherein $R^0$ is an alkyl group, an alkenyl group, an aryl group, or a heterocyclic group; $R^9$ and $R^{10}$ each is a hydrogen atom, a halogen atom, an alkyl group, an alkoxy group or an alkoxy group; and $R^{11}$ is a hydrogen atom, an alkyl group, an alkenyl group or an aryl group.

The compounds having Formula [A] also include those compounds as described in U.S. Pat. Nos. 3,935,016, 3,982,944 and 4,254,216, Japanese Patent O.P.I. Publication Nos. 21004/1980 and 145530/1979, British Patent O.P.I. Publication Nos. 2,077,455 and 2,062,888, U.S. Pat. Nos. 3,764,337, 3,432,300, 3,574,627 and 3,573,050, Japanese Patent O.P.I. Publication Nos. 152225/1977, 20327/1978, 17729/1978, 6321/1980, British Pat. No. 1,347,556, British Patent O.P.I. Publication No. 2,066,975, Japanese Patent Examined Publication Nos. 12337/1979 and 31625/1973, U.S. Pat. No. 3,700,455, and the like.

The using quantity of the compound having Formula [A] is preferably from 5 to 300 mole% of the magenta coupler used, and more preferably from 10 to 200 mole%.

The following are examples of the compound having Formula [A].

Type (1)

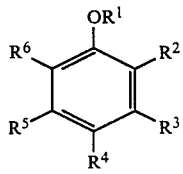

-continued

Type (2)

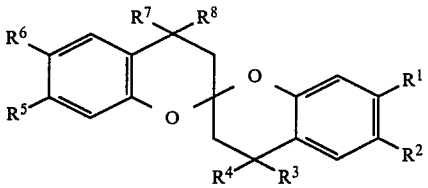

-continued

Type (7)

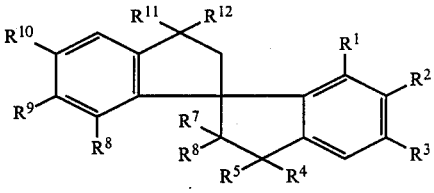

Type (1)

| Compound No. | $R^1$ | $R^2$ | $R^3$ | $R^4$ | $R^5$ | $R^6$ |
|---|---|---|---|---|---|---|
| A-1 | H | OH | $-C(CH_3)_2CH_2C(CH_3)_3$ | $CH_3O$ | H | $-C(CH_3)_2CH_2C(CH_3)_3$ |
| A-8 | $C_8H_{17}$ | $C(CH_3)_2C_2H_5$ | H | $C_8H_{17}O$ | $C(CH_3)_2C_2H_5$ | H |
| A-14 | H | H | OH | $C(CH_3)_2CH_2C(CH_3)_3$ | H | H |
| A-16 | H | $C(CH_3)_2C_3H_7$ | H | $CH_3O$ | $C(CH_3)_2C_3H_7$ | H |

Type (3)

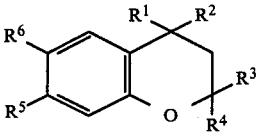

Type (4)

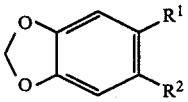

Type (2)

| Compound No. | $R^1$ | $R^2$ | $R^3$ | $R^4$ | $R^5$ | $R^6$ | $R^7$ | $R^8$ |
|---|---|---|---|---|---|---|---|---|
| A-2 | $CH_3$ | OH | $CH_3$ | $CH_3$ | $CH_3$ | OH | $CH_3$ | $CH_3$ |
| A-10 | $CH_3$ | $OCH_3$ | $CH_3$ | $CH_3$ | $CH_3$ | $CH_3$ | $CH_3$ | $CH_3$ |

Type (3)

| Compound No. | $R^1$ | $R^2$ | $R^3$ | $R^4$ | $R^5$ | $R^6$ |
|---|---|---|---|---|---|---|
| A-3 | $CH_3$ | $CH_3$ | H | $CH_3$ | $(t)C_8H_{17}$ | OH |
| A-11 | $CH_3$ | $CH_3$ | H | $CH_3$ | $(t)C_8H_{17}$ | $C_8H_{17}O$ |
| A-12 | $CH_3$ | $CH_3$ | H | $CH_3$ | $CH_3$ | $O(CH_2)_2OC_{10}H_{21}$ |
| A-17 | H | $CH_3$ | $CH_3$ | $CH_3$ | $(t)C_8H_{17}$ | OH |
| A-18 | $CH_3$ | $CH_3$ | $CH_3$ | 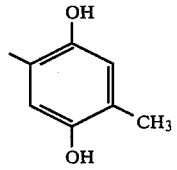 | $CH_3$ | OH |

Type (4)

| Compound No. | $R^1$ | $R^2$ |
|---|---|---|
| A-4 | $C_3H_7$ | 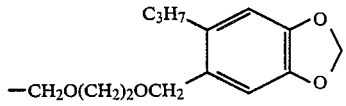 |
| A-9 | $C_3H_7$ | $-CH_2O(CH_2)_2OC_4H_9$ |

Type (5)

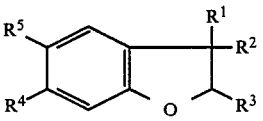

Type (5)

| Compound No. | $R^1$ | $R^2$ | $R^3$ | $R^4$ | $R^5$ |
|---|---|---|---|---|---|
| A-5 | $CH_3$ | $CH_3$ | $C_2H_5O$ | $(t)C_8H_{17}$ | OH |

Type (6)

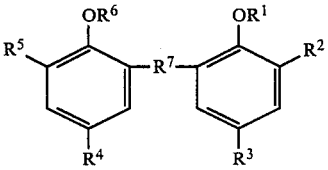

Type (6)

| Compound No. | $R^1$ | $R^2$ | $R^3$ | $R^4$ | $R^5$ | $R^6$ | $R^7$ |
|---|---|---|---|---|---|---|---|
| A-6 | H | $(t)C_4H_9$ | $CH_3$ | $CH_3$ | $(t)C_4H_9$ | H | $CH_2$ |
| A-15 | $CH_3$ | $(t)C_4H_9$ | $CH_3$ | $CH_3$ | $(t)C_4H_9$ | $CH_3$ | $CH_2$ |

Type (7)

| Compound No. | $R^1$ | $R^2$ | $R^3$ | $R^4$ | $R^5$ | $R^6$ | $R^7$ | $R^8$ | $R^9$ | $R^{10}$ | $R^{11}$ | $R^{12}$ |
|---|---|---|---|---|---|---|---|---|---|---|---|---|
| A-13 | H | $C_3H_7O$ | $C_3H_7O$ | $CH_3$ | $CH_3$ | H | H | H | $C_3H_7O$ | $C_3H_7O$ | $CH_3$ | $CH_3$ |
| A-19 | H | $CH_3O$ | $CH_3O$ | $CH_3$ | $CH_3$ | H | H | H | $CH_3O$ | $CH_3O$ | $CH_3$ | $CH_3$ |
| A-20 | $CH_3$ | $C_4H_9O$ | $C_4H_9O$ | $CH_3$ | $CH_3$ | H | H | $CH_3$ | $C_4H_9O$ | $C_4H_9O$ | $CH_3$ | $CH_3$ |
| A-21 | H | $C_2H_5O$ | $C_2H_5O$ | $CH_3$ | $CH_3$ | H | H | H | $C_2H_5O$ | $C_2H_5O$ | $CH_3$ | $CH_3$ |
| A-22 | H | $CH_3O$ | $CH_3O$ | $C_2H_5$ | $CH_3$ | H | $CH_3$ | H | $CH_3O$ | $CH_3O$ | $CH_3$ | $CH_3$ |
| A-23 | H | $C_7H_{15}COO$ | $C_7H_{15}COO$ | $CH_3$ | $CH_3$ | H | H | H | $C_7H_{15}COO$ | $C_7H_{15}COO$ | $CH_3$ | $CH_3$ |
| A-24 | H | $C_4H_9O$ | $C_4H_9O$ | $CH_3$ | $CH_3$ | H | H | H | $C_4H_9O$ | $C_4H_9O$ | $CH_3$ | $CH_3$ |
| A-25 | H | $CH_3O(CH_2)_2O$ | $CH_3O(CH_2)_2O$ | $CH_3$ | $CH_3$ | H | H | H | $CH_3O(CH_2)_2O$ | $CH_3O(CH_2)_2O$ | $CH_3$ | $CH_3$ |
| A-26 | H | $CH_2{=}CHCH_2O$ | $CH_2{=}CHCH_2O$ | $CH_3$ | $CH_3$ | H | H | H | $CH_2{=}CHCH_2O$ | $CH_2{=}CHCH_2O$ | $CH_3$ | $CH_3$ |
| A-27 | H | $C_3H_7O$ | $C_3H_7O$ | $C_6H_5CH_2$ | $CH_3$ | $C_6H_5$ | H | H | $C_3H_7O$ | $C_3H_7O$ | $C_6H_5O$ | $CH_3$ |
| A-28 | $CH_3O$ | $C_4H_9O$ | $C_4H_9O$ | $CH_3$ | $CH_3$ | H | H | $CH_3$ | $C_4H_9O$ | $C_4H_9O$ | $CH_3$ | $CH_3$ |
| A-29 | H | (s)$C_5H_{11}O$ | (s)$C_5H_{11}O$ | $CH_3$ | $CH_3$ | H | H | H | (s)$C_5H_{11}O$ | (s)$C_5H_{11}O$ | $CH_3$ | $CH_3$ |
| A-30 | H | $C_4H_9O$ | $C_4H_9O$ | (i)$C_3H_7$ | $CH_3$ | $CH_3$ | $CH_3$ | H | $C_4H_9O$ | $C_4H_9O$ | (i)$C_3H_7$ | $CH_3$ |
| A-31 | H | $C_{18}H_{37}O$ | $C_{18}H_{37}O$ | $CH_3$ | $CH_3$ | H | H | H | $C_{18}H_{37}O$ | $C_{18}H_{37}O$ | $CH_3$ | $CH_3$ |
| A-32 | H | $C_6H_5CH_2O$ | $C_6H_5CH_2O$ | $CH_3$ | $CH_3$ | H | H | H | $C_6H_5CH_2O$ | $C_6H_5CH_2O$ | $CH_3$ | $CH_3$ |

A-7

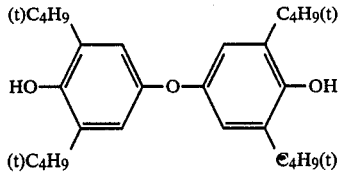

Formula [B]

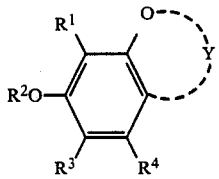

wherein $R^1$ and $R^4$ each is a hydrogen atom, a halogen atom, an alkyl, alkenyl, alkoxy, alkenyloxy, hydroxy, aryl, aryloxy, acyl, acylamino, acyloxy, sulfonamido, cycloalkyl or alkoxycarbonyl group, $R^2$ is a hydrogen atom, an alkyl, alkenyl, aryl, acyl, cycloalkyl or heterocyclic group, and $R^3$ is a hydrogen atom, a halogen atom, an alkyl, alkenyl, aryl, aryloxy, acyl, acyloxy, sulfonamido, cycloalkyl or alkoxycarbonyl group.

The above-mentioned groups each may be substituted by another substituent.

The $R^2$ and $R^3$ may be allowed to close with each other to form a 5- or 6-member ring. The ring to be formed by the $R^2$ and $R^3$ closing along with the benzene ring is such as, e.g., a chroman or methylenedioxybenzene ring.

Y is a group of atoms necessary to form a chroman or chraman ring.

The chroman or chraman ring may be substituted by a halogen atom, an alkyl, cycloalkyl, alkoxy, alkenyl, alkenyloxy, hydroxy, aryl, aryloxy or heterocyclic group, and may also form a spiro ring.

Of the compounds having Formula [B] particularly useful compounds for this invention are those having Formulas [B-1], [B-2], [B-3], [B-4] and [B-5].

Formula [B-1]

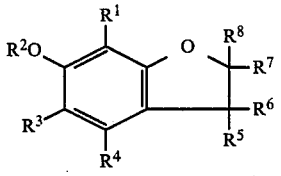

Formula [B-2]

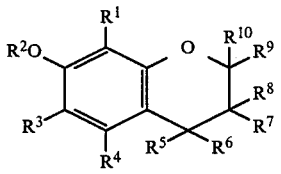

-continued

Formula [B-3]

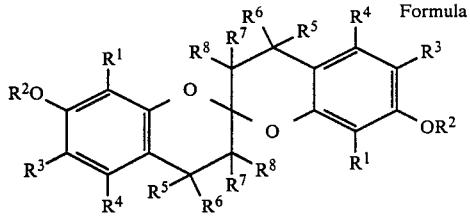

Formula [B-4]

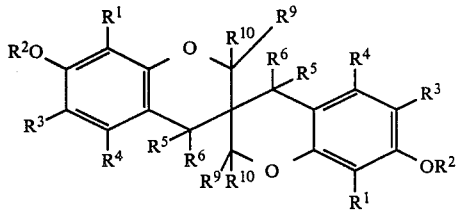

Formula [B-5]

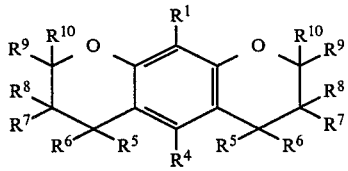

In Formulas [B-1], [B-2], [B-3], [B-4] and [B-5], $R^1$, $R^2$, $R^3$ and $R^4$ are as defined in the foregoing Formula [B], and $R^5$, $R^6$, $R^7$, $R^8$, $R^9$ and $R^{10}$ each is a hydrogen atom, a halogen atom, an alkyl, alkoxy, hydroxy, alkenyl, alkenyloxy, aryl, aryloxy or heterocyclic group, provided that the $R^5$ and $R^6$, the $R^6$ and $R^7$, the $R^7$ and $R^8$, the $R^8$ and $R^9$, and the $R^9$ and $R^{10}$ each pair may cyclize to form a carbocyclic ring, and the ring may be substituted by an alkyl group.

Particularly useful compounds for this invention are those of Formulas [B-1], [B-2], [B-3], [B-4] and [B-5] in which the $R^1$ and $R^4$ each is a hydrogen atom, an alkyl, alkoxy, hydroxy or cycloalkyl group, and the $R^5$, $R^6$, $R^7$, $R^8$, $R^9$ and $R^{10}$ each is a hydrogen atom, an alkyl or cycloalkyl group.

The compounds having Formula [B] are or include those described in the publications the Tetrahedron, 1970, vol. 26, 4743–4751, the Journal of the Chemical Society of Japan, 1972, No. 10, 0987–1990, the Chemical (Chem. Lett.), 1972(4), 315–316, and Japanese Patent O.P.I. Publication No. 139383/1980, and may be synthesized in accordance with those methodes described in these publications.

Any of the compounds having Formula [B] may be used in the quantity range of from 5 to 300 mole% of the magenta coupler to be used in the emulsion of this invention, and more preferably from 10 to 200 mole%.

The following are typical examples of these compounds:

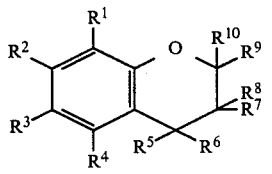

Cpd.

-continued

| No. | $R^1$ | $R^2$ | $R^3$ | $R^4$ | $R^5$ | $R^6$ | $R^7$ | $R^8$ | $R^9$ | $R^{10}$ |
|---|---|---|---|---|---|---|---|---|---|---|
| B-1 | H | H | H | H | H | $CH_3$ | H | H | $CH_3$ | $CH_3$ |
| B-2 | H | H | $CH_3$ | H | H | $CH_3$ | H | H | $CH_3$ | $CH_3$ |
| B-3 | H | H | $C_{12}H_{25}$ | H | H | $CH_3$ | H | H | $CH_3$ | $CH_3$ |
| B-4 | H | H | 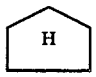 | H | H | $CH_3$ | H | H | $CH_3$ | $CH_3$ |
| B-5 | H | $CH_3$ | H | H | H | $CH_3$ | H | H | $CH_3$ | $CH_3$ |
| B-9 | $CH_3$ | H | $CH_3$ | H | H | H | H | 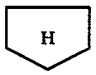 (condensate) | | H |
| B-10 | H | $CH_3CO$ | H | H | H | (i)$C_3H_7$ | H | H | $CH_3$ | $CH_3$ |
| B-11 | H | $C_3H_7$ | (t)$C_8H_{17}$ | H | H | $CH_3$ | H | $CH_3$ | $CH_3$ | $CH_3$ |
| B-12 | Br | H | Br | H | H | H | H | $CH_3$ | $CH_3$ | $CH_3$ |
| B-13 | H | 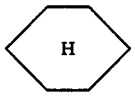 | H | H | $CH_3$ | $CH_3$ | H | H | $CH_2OH$ | $CH_3$ |
| B-14 | H | 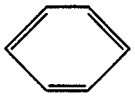 | H | H | $CH_3$ | $CH_3$ | H | H | $CH_3$ | $CH_3$ |
| B-15 | H | H | $CH_2{=}CHCH_2CO$ | | $CH_3$ | $CH_3$ | H | H | 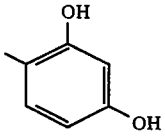 | $CH_3$ |
| B-16 | H | H | H | $CH_3SO_2NH$ | $CH_3$ | $CH_3$ | H | H | 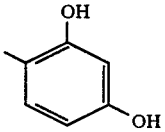 | $CH_3$ |
| B-17 | H | 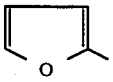 | $CH_3$ | H | Cl | H | Cl | H | $CH_3$ | $CH_3$ |
| B-18 | H | 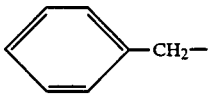 | $CH_3CONH$ | H | H | H | H | H | 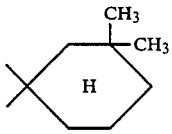 (spiro) | |
| B-54 | $CH_3O$ | $CH_3O$ | H | H | H | H | H | H | $CH_3$ | $CH_3$ |
| B-55 | H | 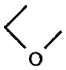 (methylenedioxy) | | H | H | H | H | H | $CH_3$ | $CH_3$ |

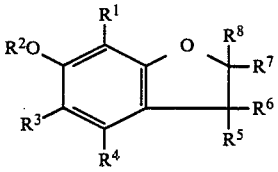

| Compound No. | $R^1$ | $R^2$ | $R^3$ | $R^4$ | $R^5$ | $R^6$ | $R^7$ | $R^8$ |
|---|---|---|---|---|---|---|---|---|
| B-6 | H | H | H | H | H | 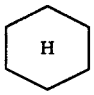 (condensate) | | H |
| B-7 | H | H | (i)$C_3H_7$ | H | H | H | $CH_3$ | $CH_3$ |
| B-8 | H | $CH_3$ | Cl | H | H | H | $CH_3$ | $CH_3$ |

-continued

| | | | | | | | | |
|---|---|---|---|---|---|---|---|---|
| B-19 | H | H | 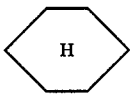 | H | $CH_3$ | $CH_3$ | $CH_3$ | $CH_3$ |
| B-20 | H | $CH_2{=}CHCH_2$ | $CH_3$ | H | $CH_3$ | $CH_3$ | $CH_3$ | H |
| B-21 | H | $C_3H_7$ | $C_3H_7$ | H | $CH_3$ | $CH_3$ | 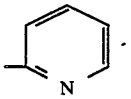 | H |
| B-22 | $CH_3$ | H | $CH_3$ | H | 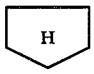 (spiro) | | H | H |
| B-23 | $CH_3$ | H | 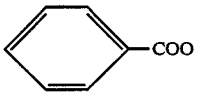 | H | $CH_3$ | | $CH_3$ | $CH_3$ |

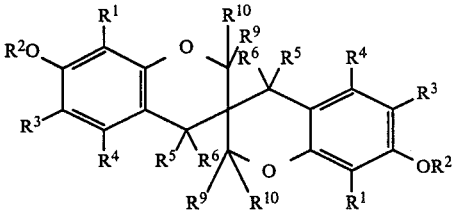

| Compound No. | $R^1$ | $R^2$ | $R^3$ | $R^4$ | $R^5$ | $R^6$ | $R^9$ | $R^{10}$ |
|---|---|---|---|---|---|---|---|---|
| B-24 | H | H | H | H | $CH_3$ | $CH_3$ | H | H |
| B-25 | H | H | $CH_3$ | H | $CH_3$ | $CH_3$ | H | H |
| B-26 | H | H | (t)$C_4H_9$ | H | H | H | H | H |
| B-27 | H | $CH_3$ | H | H | $CH_3$ | $CH_3$ | H | H |
| B-28 | H | H | 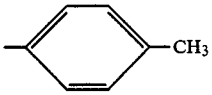 | H | $CH_3$ | $CH_3$ | H | H |
| B-29 | H | H | $C_2H_5COOCH_2$ | H | $CH_3$ | $CH_3$ | H | H |
| B-30 | $CH_3$ | 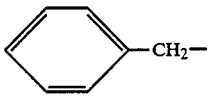 | H | $CH_3$ | $CH_3$ | $CH_3$ | H | H |
| B-31 | Cl | H | H | H | 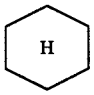 (spiro) | | H | H |
| B-32 | H | H | $CH_3CONH$ | H | $CH_3$ | $CH_3$ | H | H |
| B-33 | $CH_3$ | 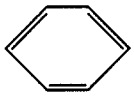 | (t)$C_8H_{17}$ | H | $CH_3$ | $CH_3$ | H | H |
| B-34 | H | H | 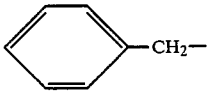 | H | $CH_3$ | $CH_3$ | H | H |

-continued

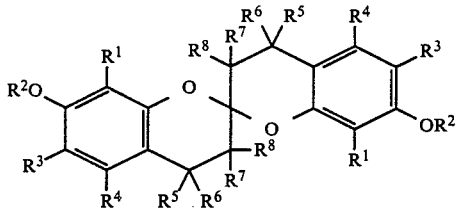

| Compound No. | $R^1$ | $R^2$ | $R^3$ | $R^4$ | $R^5$ | $R^6$ | $R^7$ | $R^8$ |
|---|---|---|---|---|---|---|---|---|
| B-35 | H | H | H | H | $CH_3$ | $CH_3$ | H | H |
| B-36 | H | $C_3H_7$ | H | H | $CH_3$ | $CH_3$ | H | H |
| B-37 | H | $CH_3$ | $CH_3$ | H | $CH_3$ | $CH_3$ | H | H |
| B-38 | H | H | (t)$C_4H_9$ | H | $CH_3$ | $CH_3$ | H | H |
| B-39 | H | H | 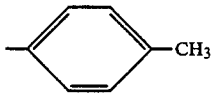 | H | $CH_3$ | $CH_3$ | H | H |
| B-40 | H | H | $CH_3SO_2NH$ | H | H | H | H | H |
| B-41 | $CH_3$ | 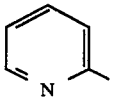 | H | $CH_3$ | $CH_3$ | $CH_3$ | H | H |
| B-42 | Cl | (t)$C_4H_9$ | H | H | 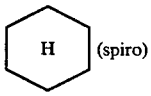 (spiro) | | H | H |
| B-43 | H | $C_{12}H_{25}$ | $CH_3CONH$ | H | $CH_3$ | $CH_3$ | H | H |
| B-44 | H | H | (t)$C_8H_{17}$ | H | $CH_3$ | $CH_3$ | H | H |
| B-45 | H | H | 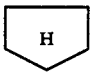 | H | $CH_3$ | $CH_3$ | H | H |

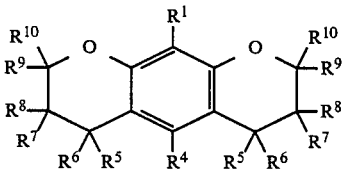

| Compound No. | $R^1$ | $R^4$ | $R^5$ | $R^6$ | $R^7$ | $R^8$ | $R^9$ | $R^{10}$ |
|---|---|---|---|---|---|---|---|---|
| B-46 | H | H | H | H | H | H | $CH_3$ | $CH_3$ |
| B-47 | OH | H | H | H | H | H | $CH_3$ | $CH_3$ |
| B-48 | H | H | H | H | H | H | $CH_3$ | $C_2H_5$ |
| B-49 | H | H | H | H | H | H | 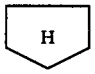 (spiro) | |
| B-50 | $C_3H_7O$ | H | $CH_3$ | H | H | H | $CH_3$ | $CH_3$ |
| B-51 | H | H | H | H | $C_3H_7$ | H | $C_3H_7$ | H |
| B-52 | H | OH | H | H | H | H | $CH_3$ | $CH_3$ |
| B-53 | H | $C_3H_7O$ | H | H | H | H | $CH_3$ | $CH_3$ |

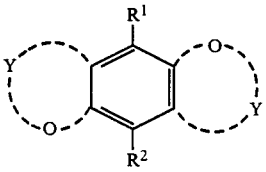

Formula [C]

-continued

-continued

Formula [D]

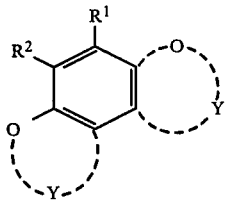

wherein $R^1$ and $R^2$ each is a hydrogen atom, a halogen atom, an alkyl, alkenyl alkoxy, alkenyloxy, hydroxy, aryl, aryloxy, acyl, acylamino, acyloxy, sulfonamido or alkoxycarbonyl group.

These groups each may have another substituent.

Y is a group of atoms necessary to form a dichroman or dichraman ring.

The chroman or chraman ring may be substituted by a halogen atom, an alkyl, cycloalkyl, alkoxy, alkenyl, alkenyloxy, hydroxy, aryl, aryloxy or heterocyclic group, and further may form a spiro ring.

Particularly useful compounds for this invention among the compounds having Formulas [C] and [D] are those having the following Formulas [C-1], [C-2], [D-1] and [D-2]

Formula [C-1]

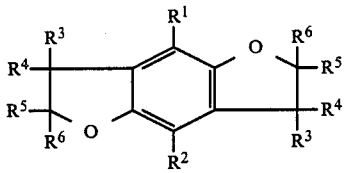

Formula [C-2]

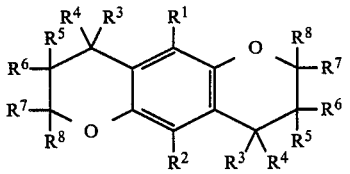

-continued

Formula [D-1]

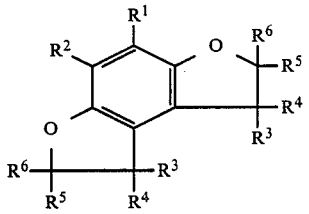

Formula [D-2]

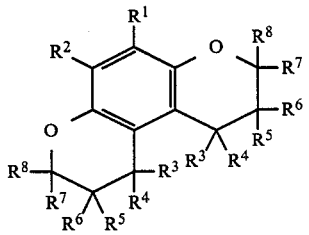

In Formulas [C-1], [C-2], [D-1] and [D-2], $R^1$ and $R^2$ are as defined in the foregoing Formulas [C] and [D], and $R^3$, $R^4$, $R^5$, $R^6$, $R^7$ and $R^8$ each is a hydrogen atom, a halogen atom, an alkyl, alkoxy, hydroxy, alkenyl, alkenyloxy, aryl, aryloxy or heterocyclic group, provided that each pair of the $R^3$ and $R^4$, the $R^4$ and $R^5$, the $R^5$ and $R^6$, the $R^6$ and $R^7$, and the $R^7$ and $R^8$ may cyclize with each other to form a carbocyclic ring, and further the carbocyclic ring may be substituted by an alkyl group.

Particularly useful compounds are those of Formulas [C-1], [C-2], [D-1] and [D-2] in which the $R^1$ and $R^2$ each is a hydrogen atom, an alkyl, alkoxy, hydroxy or cycloalkyl group, and the $R^3$, $R^4$, $R^5$, $R^6$, $R^7$ and $R^8$ each is a hydrogen atom, an alkyl or cycloalkyl group.

The compounds having Formulas [C] and [D] include those compounds described in the journal of the Chemical Society of Japan (J. Chem. Soc. part C) 1968 (14), 1937–18, the journal of the Society of Organic Synthesis Chemistry of Japan, 1970, 28(1), 60–65, and the Tetrahedron Letters, 1973 (29), 2707–2710, and may be synthesized in accordance with those methods described in these publications.

The using quantity of the compounds having the foregoing Formulas [C] and [D] is preferably from 5 to 300 mole% of the magenta coupler of this invention, and more preferably from 10 to 200 mole%.

The following are examples of these compounds.

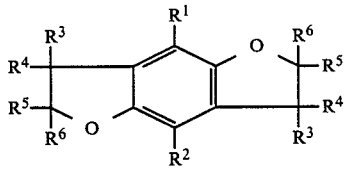

| Compound No. | $R^1$ | $R^2$ | $R^3$ | $R^4$ | $R^5$ | $R^6$ |
|---|---|---|---|---|---|---|
| C-11 | H | H | H | H | $CH_3$ | $CH_3$ |
| C-12 | H | H | H | H | 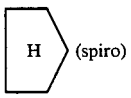 (spiro) | |

-continued

| | | | | | |
|---|---|---|---|---|---|
| C-13 | H | H | H | 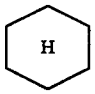 (condensate) | H |

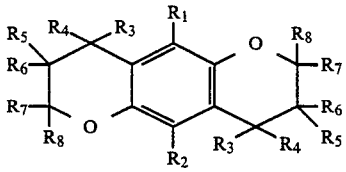

| Compound No. | $R_1$ | $R_2$ | $R_3$ | $R_4$ | $R_5$ | $R_6$ | $R_7$ | $R_8$ |
|---|---|---|---|---|---|---|---|---|
| C-1 | H | H | H | H | H | H | H | H |
| C-2 | H | H | H | H | H | H | $CH_3$ | $CH_3$ |
| C-3 | H | H | $CH_3$ | H | H | H | $CH_3$ | $CH_3$ |
| C-4 | $CH_3$ | H | $CH_3$ | $CH_3$ | H | H | $CH_3$ | $CH_3$ |
| C-5 | OH | H | H | H | H | H | $C_2H_5$ | $CH_3$ |
| C-6 | $OCH_3$ | H | H | H | H | H | H | H |
| C-7 | $OC_3H_7$ | H | H | H | H | H | H | H |
| C-8 | $OC_{12}H_{25}$ | H | H | H | H | H | H | H |
| C-9 | $CH_3COO$ | H | H | H | H | H | $CH_3$ | $CH_3$ |
| C-10 | $CH_3CONH$ | H | H | H | H | H | 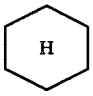 (spiro) | |
| C-14 | $(CH_3)_2\underset{\underset{Cl}{\vert}}{C}CHCH_2$ | $(CH_3)_2\underset{\underset{Cl}{\vert}}{C}CH_2CH_2$ | H | H | H | H | $CH_3$ | $CH_3$ |
| C-15 | $CH_3$ | $CH_3$ | H | H | H | H | $CH_3$ | $CH_3$ |
| C-16 | $(CH_3)_2C{=}CHCH_2$ | $(CH_3)_2C{=}CCH_2$ | H | H | H | H | $CH_3$ | $CH_3$ |
| C-17 | Cl | H | H | H | H | H | H | H |

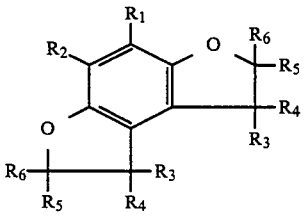

| Compound No. | $R_1$ | $R_2$ | $R_3$ | $R_4$ | $R_5$ | $R_6$ |
|---|---|---|---|---|---|---|
| D-1 | $CH_3$ | $CH_3$ | H | H | H | H |
| D-2 | H | H | H | H | $CH_3$ | $CH_3$ |

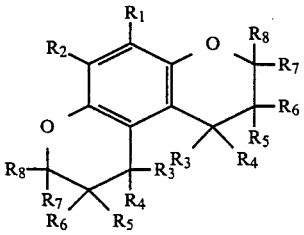

| Compound No. | $R_1$ | $R_2$ | $R_3$ | $R_4$ | $R_5$ | $R_6$ | $R_7$ | $R_8$ |
|---|---|---|---|---|---|---|---|---|
| D-3 | H | H | H | H | H | H | H | H |
| D-4 | H | H | H | H | H | H | $CH_3$ | $CH_3$ |
| D-5 | $CH_3$ | $CH_3$ | H | H | H | H | $CH_3$ | $CH_3$ |
| D-6 | $(CH_3)_2\underset{\underset{Cl}{\vert}}{C}CH_2CH_2$ | $(CH_3)_2\underset{\underset{Cl}{\vert}}{C}CH_2CH_2$ | H | H | H | H | $CH_3$ | $CH_3$ |
| D-7 | H | H | Cl | H | Cl | H | H | H |

-continued

| | | | | | | | | |
|---|---|---|---|---|---|---|---|---|
| D-8 | H | H | H | H | H | H | 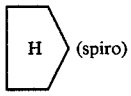 (spiro) | |
| D-9 | $CH_3O$ | H | H | H | H | H | 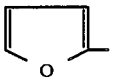 | H |
| D-10 | H | H | H | H | H | H | $CH_2OH$ | $CH_3$ |
| D-11 | 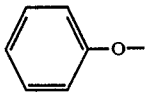 | H | H | H | H | H | $CH_3$ | $CH_3$ |

Formula [E]

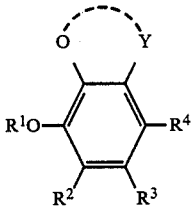

wherein $R^1$ is a hydrogen atom, an alkyl, alkenyl, aryl, acyl, cycloalkyl or heterocyclic group, $R^3$ is a hydrogen atom, a halogen atom, an alkyl, alkenyl, aryl, aryloxy, acyl, acylamino, acyloxy, sulfonamido, cycloalkyl or alkoxycarbonyl group, and $R^2$ and $R^4$ each is a hydrogen atom, a halogen atom, an alkyl, alkenyl, aryl, acyl, acylamino, sulfonamido, cycloalkyl or alkoxycarbonyl group.

The above-mentioned groups each may be substituted by another substituent.

The $R^1$ and $R^2$ may be allowed to close with each other to form a 5- or 6-member ring.

Where the $R^1$ and $R^2$ form such a ring, the $R^3$ and $R^4$ each is a hydrogen atom, a halogen atom, an alkyl, alkenyl, alkoxy, alkenyloxy, hydroxy, aryl, aryloxy, acyl, acylamino, acyloxy, sulfonamido or alkoxycarbonyl group.

Y is a group of atoms necessary to form a chroman or chraman ring.

The chroman or chraman ring may be subtituted by a halogen atom, an alkyl, cycloalkyl, alkoxy, alkenyl, alkenyloxy, hydroxy, aryl, aryloxy or heterocyclic group, and may further form a spiro ring.

Particularly useful compounds for this invention among the compounds having Formula [E] are those having the following Formulas [E-1], [E-2], [E-3], [E-4] and [E-5]:

Formula [E-1]

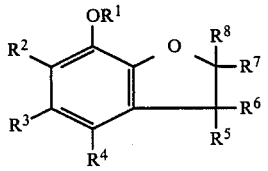

-continued

Formula [E-2]

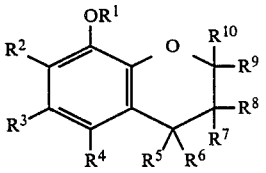

Formula [E-3]

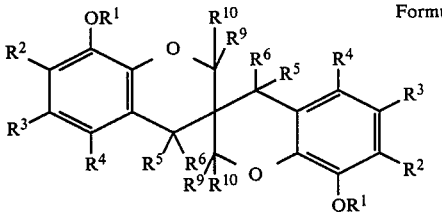

Formula [E-4]

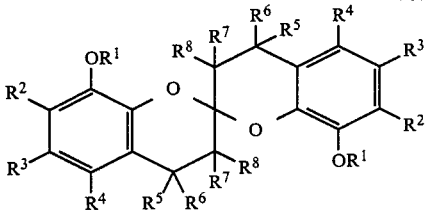

Formula [E-5]

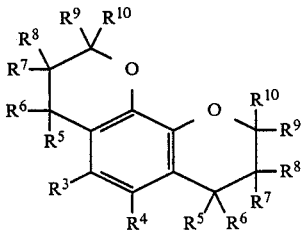

In Formulas [E-1], [E-2], [E-3], [E-4] and [E-5], $R^1$, $R^2$, $R^3$ and $R^4$ are as defined in the foregoing Formula [E], and $R^5$, $R^6$, $R^7$, $R^8$, $R^9$ and $R^{10}$ each is a hydrogen atom, a halogen atom, an alkyl, alkoxy, hydroxy, alkenyl, alkenyloxy, aryl, aryloxy or heterocyclic group, provided that each pair of the $R^5$ and $R^6$, the $R^6$ and $R^7$, the $R^7$ and $R^8$, the $R^8$ and $R^9$, and the $R^9$ and $R^{10}$ may cyclize with each other to form a carbocyclic ring, and the ring may be substituted by an alkyl group.

Particularly useful compounds are those of Formulas [E-1] through [E-5] in which the $R^1$, $R^2$, $R^3$ and $R^4$ each is a hydrogen atom, an alkyl or cycloalkyl group; and of Formula [E-5] in which the $R^3$ and $R^4$ each is a hydrogen atom, an alkyl, alkoxy, hydroxy or cycloalkyl group, and further of Formulas [E-1] through [E-5] in which the $R^5$, $R^6$, $R^7$, $R^8$, $R^9$ and $R^{10}$ each is a hydrogen atom, an alkyl group or a cycloalkyl group.

The compounds having Formula [E] include those compounds described in the Tetrahedron Letters, 1965 (8), 457–460; the journal of the Chemical Society of Japan (J. Chem. Soc. part C) 1966 (22), 2013–2016; ans Zh. Org. Khim, 1970 (6), 1230–1237, and may be synthesized in accordance with those methods described in these publications.

The using quantity of the compound having Formula [E-1] is preferably from 5 to 300 mole% of the magenta coupler of this invention, and more preferably from 10 to 200 mole%.

The following are typical examples of these compounds.

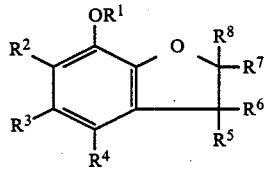

| Compound No. | $R^1$ | $R^2$ | $R^3$ | $R^4$ | $R^5$ | $R^6$ | $R^7$ | $R^8$ |
|---|---|---|---|---|---|---|---|---|
| E-19 | H | H | H | H | H | | 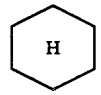 (condensate) | H |
| E-20 | $C_3H_7$ | H | H | H | H | | 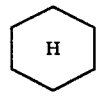 (condensate) | H |
| E-21 | H | H | H | H | H | H | 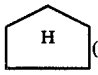 (spiro) | |
| E-22 | $CH_3$ | H | H | H | H | H | 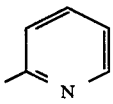 | H |
| E-23 | H | H | H | H | H | H | $CH_3$ | $CH_3$ |
| E-24 | $CH_3$ | H | 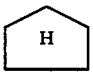 | H | H | H | $CH_3$ | $CH_3$ |
| E-25 | 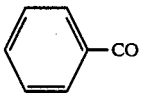 | H | H | H | H | H | $CH_3$ | $CH_3$ |
| E-26 | $C_{12}H_{25}$ | H | H | H | $CH_3$ | $CH_3$ | $CH_3$ | $CH_2OH$ |

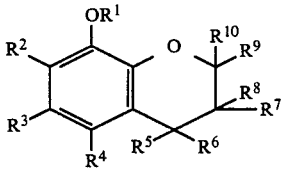

| Cpd. No. | $R^1$ | $R^2$ | $R^3$ | $R^4$ | $R^5$ | $R^6$ | $R^7$ | $R^8$ | $R^9$ | $R^{10}$ |
|---|---|---|---|---|---|---|---|---|---|---|
| E-1 | H | H | H | H | H | H | H | H | H | H |
| E-2 | H | H | H | H | H | H | H | H | $CH_3$ | $CH_3$ |
| E-3 | H | H | H | H | $CH_3$ | H | H | H | $CH_3$ | $CH_3$ |
| E-4 | H | H | $CH_2{=}CHCH_2$ | H | H | H | H | H | $CH_3$ | $CH_3$ |
| E-5 | $CH_3$ | H | H | H | H | H | H | H | $CH_3$ | $CH_3$ |
| E-6 | $C_3H_7$ | H | H | H | H | H | H | H | $CH_3$ | $CH_3$ |
| E-7 | $C_{12}H_{25}$ | H | H | H | $CH_3$ | H | H | H | $CH_3$ | $CH_3$ |

-continued

| | | | | | | | | | | |
|---|---|---|---|---|---|---|---|---|---|---|
| E-8 | 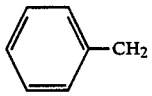 | H | H | H | H | H | H | H | H | H |
| E-9 | H | H | H | H | H | H | H | H | $CH_3$ | $CH_3$ |
| E-10 | 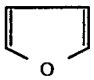 | H | H | H | H | H | H | H | $CH_3$ | $CH_3$ |
| E-11 | H | H | H | H | H | H | H | H | $CH_3$ | $C_{16}H_{33}$ |
| E-12 | H | H | 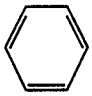 | H | H | H | H | H | $CH_3$ | $CH_3$ |
| E-13 | $CH_3$ | H | $CH_3CO$ | H | H | H | H | H | $CH_3$ | $CH_3$ |
| E-14 | $CH_3$ | H | H | H | H | Br | Br | H | H | H |
| E-15 | $CH_3$ | H | H | H | H | Cl | Cl | H | H | H |
| E-16 | $CH_3$ | H | H | H | H | $CH_3O$ | Br | H | H | H |
| E-17 | $CH_3$ | H | H | H | H | OH | Br | H | $CH_3$ | $CH_3$ |
| E-18 | $CH_3$ | H | H | H | H | $C_2H_5O$ | OH | H | $CH_3$ | $CH_3$ |

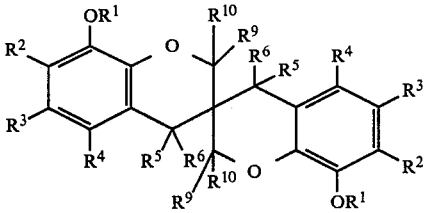

| Compound No. | $R^1$ | $R^2$ | $R^3$ | $R^4$ | $R^5$ | $R^6$ | $R^9$ | $R^{10}$ |
|---|---|---|---|---|---|---|---|---|
| E-27 | H | H | H | H | H | H | H | H |
| E-28 | $CH_3$ | H | H | H | H | H | H | H |
| E-29 | 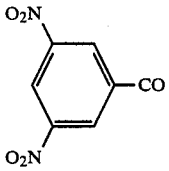 | H | H | H | H | H | H | H |
| E-30 | H | H | $CH_3$ | H | H | H | $CH_3$ | $CH_3$ |
| E-31 | $C_3H_7$ | H | H | H | H | H | H | H |
| E-32 | $C_3H_7$ | H | H | H | $CH_3$ | $CH_3$ | H | H |
| E-37 | H | H | H | $CH_3CONH$ | H | H | H | H |
| E-38 | CO | H | H | H | H | H | H | H |

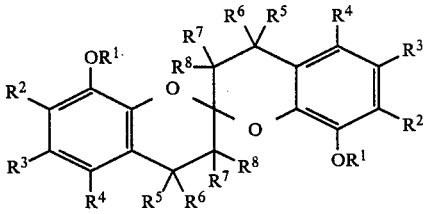

| Compound No. | $R^1$ | $R^2$ | $R^3$ | $R^4$ | $R^5$ | $R^6$ | $R^7$ | $R^8$ |
|---|---|---|---|---|---|---|---|---|
| E-33 | H | H | H | H | H | H | H | H |
| E-34 | H | H | H | H | $CH_3$ | $CH_3$ | H | H |
| E-35 | $C_{12}H_{25}$ | H | H | H | $CH_3$ | $CH_3$ | H | H |
| E-36 | $CH_3$ | H | $CH_3$ | H | $CH_3$ | $CH_3$ | H | H |

-continued

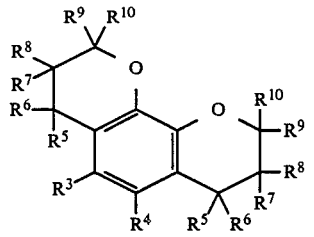

| Compound No. | $R^3$ | $R^4$ | $R^5$ | $R^6$ | $R^7$ | $R^8$ | $R^9$ | $R^{10}$ |
|---|---|---|---|---|---|---|---|---|
| E-39 | H | H | H | H | H | H | H | H |
| E-40 | H | H | H | H | H | H | $CH_3$ | $CH_3$ |
| E-41 | OH | H | H | H | H | H | $CH_3$ | $CH_3$ |
| E-42 | $C_3H_7O$ | H | $CH_3$ | $CH_3$ | H | H | H | H |

Formula [F]

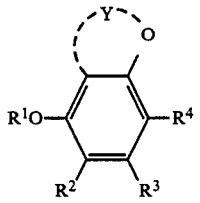

wherein $R^1$ is a hydrogen atom, an alkyl, alkenyl, aryl, acyl, cycloalkyl or heterocyclic group, $R^2$ is a hydrogen atom, a halogen atom, an alkyl, alkenyl, aryl, aryloxy, acyl, acylamino, acyloxy, sulfonamido, cycloalkyl or alkoxycarbonyl group, $R^3$ is a hydrogen atom, a halogen atom, an alkyl, alkenyl, aryl, acyl, acylamino, sulfonamido, cycloalkyl or alkoxycarbonyl group, and $R^4$ is a hydrogen atom, a halogen atom, an alkyl, alkenyl, alkoxy, alkenyloxy, hydroxy, aryl, aryloxy, acyl, acylamino, acyloxy, sulfonamido or alkoxycarbonyl group.

The above groups each may be substituted by another substituent.

The $R^1$ and $R^2$ may cyclize with each other to form a 5- or 6-member ring, provided that, in that case, the $R^3$ and $R^4$ each represents a hydrogen atom, a halogen atom, an alkyl, alkenyl, alkoxy, alkenyloxy, hydroxy, aryl, aryloxy, acyl, acylamino, acyloxy, sulfonamido or alkoxycarbonyl group.

Y represents a group of atoms necessary to form a chroman or chraman ring.

The chroman or chraman ring may be substituted by a halogen atom, an alkyl, cycloalkyl, alkoxy, alkenyl, alkenyloxy, hydroxy, aryl, aryloxy or heterocyclic group, and may also form a spiro ring.

Particularly useful compounds for this invention among the compounds having Formula [F] are those having the following Formulas [F-1], [F-2], [F-3], [F-4] and [F-5]:

Formula [F-1]

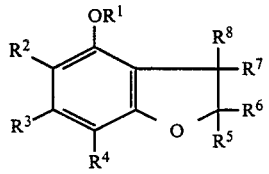

-continued

Formula [F-2]

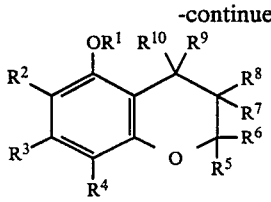

Formula [F-3]

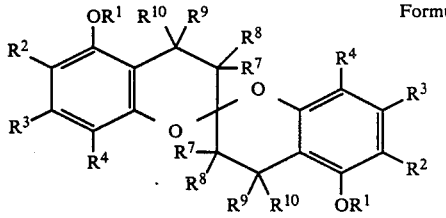

Formula [F-4]

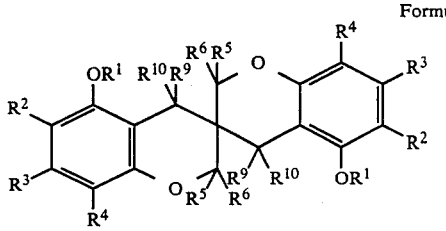

Formula [F-5]

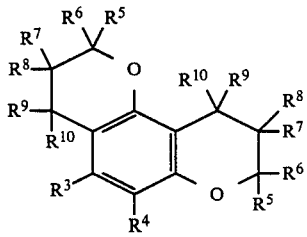

In Formulas [F-1] and [F-5], $R^1$, $R^2$, $R^3$ $R^4$ are as defined in the foregoing Formula [F], and $R^5$, $R^6$, $R^7$, $R^8$, $R^9$ and $R^{10}$ each is a hydrogen atom, a halogen atom, an alkyl, alkoxy, hydroxy, alkenyl, alkenyloxy, aryl, aryloxy or heterocyclic group, provided that each pair of the $R^5$ and $R^6$, the $R^6$ and $R^7$, the $R^7$ and $R^8$, the $R^8$ and $R^9$, and the $R^9$ and $R^{10}$ may cyclize with each other to form a carbocyclic ring, and the ring may further be substituted by an alkyl group.

In Formulas [F-3], [F-4] and [F-5], each pair of the $R^1$s through the $R^{10}$s may be either the same as or different from each other.

Particularly useful compounds for this invention are those of Formulas [F-1], [F-2], [F-3], [F-4] and [F-5] in which the $R^1$, $R^2$ and $R^3$ each is a hydrogen atom, an alkyl or cycloalkyl group, and the $R^4$ is a hydrogen atom, an alkyl, alkoxy, hydroxy or cycloalkyl group, and further the $R^5$, $R^6$, $R^7$, $R^8$, $R^9$ and $R^{10}$ each is a hydrogen atom, an alkyl or cycloalkyl group.

The compounds having Formula [F] include those compounds described in the Tetrahedron Letters, 1970, vol. 26, 4743–4751; the journal of the Chemical Society of Japan, 1972, No. 10, 1987–1990; the Synthesis, 1975, vol. 6, 392–393; and Bul. Soc. Chim. Belg., 1975, vol. 84(7), 747–759, and may be synthesized in accordance with those methods described in these publications.

The using quantity of the compound having Formula [F] is preferably from 5 to 300 mole% of the magenta coupler of this invention, and more preferably from 10 to 200 mole%.

The following are typical examples of the compounds having Formula [F]:

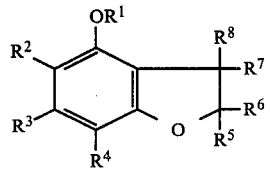

| Compound No. | $R^1$ | $R^2$ | $R^3$ | $R^4$ | $R^5$ | $R^6$ | $R^7$ | $R^8$ |
|---|---|---|---|---|---|---|---|---|
| F-11 | H | H | H | H | H | 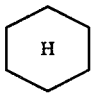 (conpensate) | | H |
| F-12 | $C_3H_7$ | H | H | H | H | 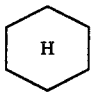 (conpensate) | | H |
| F-13 | H | H | H | H | H | H | H | H |
| F-14 | H | H | H | H | H | H | $CH_3$ | H |
| F-15 | H | H | $CH_3$ | H | H | H | $CH_3$ | H |
| F-16 | H | H | 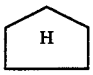 | H | H | H | $CH_3$ | H |
| F-17 | H | H | 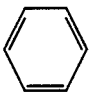 | H | H | H | $CH_3$ | H |
| F-18 | $C_3H_7$ | H | $CH_3$ | H | H | H | $CH_3$ | H |
| F-19 | 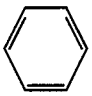 | H | H | H | 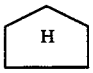 (spiro) | | H | H |
| F-24 | $CH_2{=}CHCH_2$ | $CH_3$ | $CH_3$ | H | H | $C_2H_5O$ | $CH_3$ | $CH_3$ |
| F-25 | $C_3H_7$ | H | H | H | H | 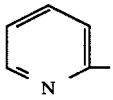 | $CH_3$ | $CH_3$ |
| F-26 | H | $CH_3$ | $CH_3$ | H | H | H | 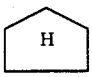 (spiro) | |

-continued

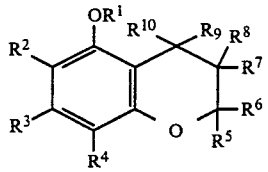

| Compound No. | $R^1$ | $R^2$ | $R^3$ | $R^4$ | $R^5$ | $R^6$ | $R^7$ | $R^8$ | $R^9$ | $R^{10}$ |
|---|---|---|---|---|---|---|---|---|---|---|
| F-1 | H | H | H | H | H | H | H | H | H | H |
| F-2 | H | H | H | H | $CH_3$ | $CH_3$ | H | H | $CH_3$ | H |
| F-3 | H | H | H | H | $CH_3$ | $CH_3$ | H | H | H | H |
| F-4 | H | $(CH_3)_2C{=}CCHCH_2$ | H | H | $CH_3$ | $CH_3$ | H | H | H | H |
| F-5 | $CH_3$ | H | H | H | $CH_3$ | $CH_3$ | H | H | H | H |
| F-6 | $C_3H_7$ | H | H | H | $CH_3$ | $CH_3$ | H | H | H | H |
| F-7 | $C_{12}H_{25}$ | H | H | H | $CH_3$ | $CH_3$ | H | H | H | H |
| F-8 | 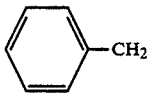 | H | H | H | $CH_3$ | $CH_3$ | H | H | H | H |
| F-9 | 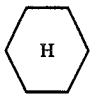 | H | H | H | $CH_3$ | $CH_3$ | H | H | H | H |
| F-10 | 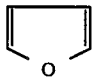 | H | H | H | $CH_3$ | $CH_3$ | H | H | H | H |
| F-20 | H | Cl | H | H | H | 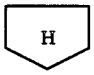 (condensate) | | H | H | H |
| F-21 | H | H | H | H | $CH_3$ | $CH_2OH$ | H | H | $CH_3$ | $CH_3$ |
| F-22 | $C_3H_7$ | $(t)C_8H_{17}$ | H | H | $C_2H_5$ | $CH_3$ | H | H | H | H |
| F-23 | $CH_3CO$ | H | H | H | $CH_3$ | $CH_3$ | H | H | $CH_3$ | H |

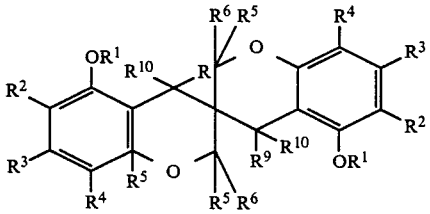

| Compound No. | $R^1$ | $R^2$ | $R^3$ | $R^4$ | $R^5$ | $R^6$ | $R^9$ | $R^{10}$ |
|---|---|---|---|---|---|---|---|---|
| F-27 | H | H | H | H | H | H | $CH_3$ | $CH_3$ |
| F-28 | $C_3H_7$ | H | H | H | H | H | $CH_3$ | $CH_3$ |
| F-29 | H | H | H | $(t)C_8H_{17}$ | H | H | H | H |
| F-30 | H | Cl | H | H | H | H | 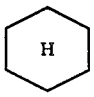 (spiro) | |
| F-31 | 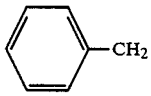 | H | H | H | H | H | $CH_3$ | $CH_3$ |

-continued

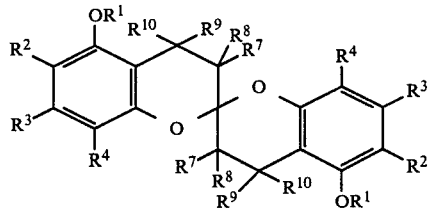

| Compound No. | $R^1$ | $R^2$ | $R^3$ | $R^4$ | $R^7$ | $R^8$ | $R^9$ | $R^{10}$ |
|---|---|---|---|---|---|---|---|---|
| F-32 | H | H | H | H | H | H | $CH_3$ | $CH_3$ |
| F-33 | $CH_3$ | H | H | H | H | H | $CH_3$ | $CH_3$ |
| F-34 | H | $CH_3$ | H | H | H | H | H | H |
| F-35 | H | H | H | (t)$C_4H_9$ | H | H | $CH_3$ | $CH_3$ |
| F-36 | H | 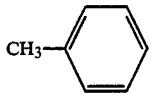 | H | H | H | H | $CH_3$ | $CH_3$ |
| F-37 | H | H | H | $CH_3SO_2NH$ | H | H | H | H |
| F-38 | 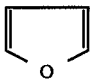 | H | H | H | H | H | $CH_3$ | $CH_3$ |
| F-39 | $C_{12}H_{25}$ | H | H | H | H | H | $CH_3$ | $CH_3$ |
| F-40 | 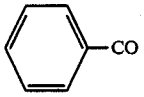 | H | H | H | H | H | 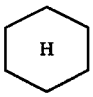 (spiro) | |
| F-41 | H | H | H | H | H | H | $CH_3$ | $CH_3$ |

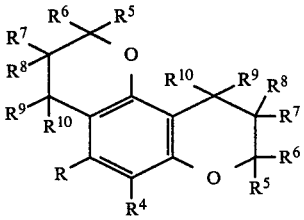

| Compound No. | $R^3$ | $R^4$ | $R^5$ | $R^6$ | $R^7$ | $R^8$ | $R^9$ | $R^{10}$ |
|---|---|---|---|---|---|---|---|---|
| F-42 | H | H | $CH_3$ | $CH_3$ | H | H | H | H |
| F-43 | H | H | 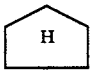 (spiro) | | H | H | H | H |
| F-44 | H | OH | $CH_3$ | $CH_3$ | H | H | $CH_3$ | H |
| F-45 | H | $C_3H_7O$ | H | H | H | H | $CH_3$ | $CH_2OH$ |
| F-46 | OH | H | $CH_3$ | $CH_3$ | H | H | H | H |
| F-47 | $C_3H_7O$ | H | $CH_3$ | $CH_3$ | H | H | H | H |

Formula [G]

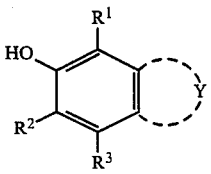

wherein $R^1$ and $R^3$ each is a hydrogen atom, a halogen atom, an alkyl, alkenyl, alkoxy, hydroxy, aryl, aryloxy, acyl, acylamino, acyloxy, sulfonamido, cycloalkyl or alkoxycarbonyl group, and $R^2$ is a hydrogen atom, a halogen atom, an alkyl, alkenyl, hydroxy, aryl, acyl, acylamino, acyloxy, sulfonamido, cycloalkyl or alkoxycarbonyl group.

The above groups each may be substituted by another substituent.

The $R^2$ and $R^3$ may cyclize with each other to form a 5- or 6-member hydrocarbon ring. The 5- or 6-member hydrocarbon ring may be substituted by a halogen atom, an alkyl, cycloalkyl, alkoxy, alkenyl, hydroxy, aryl, aryloxy, heterocyclic or the like group.

Y represents a group of atoms necessary to form an indan ring. The indan ring may be substituted by a halogen atom, an alkyl, alkenyl, alkoxy, cycloalkyl, hydroxy, aryl, aryloxy, heterocyclic or the like group, and may further form a spiro ring.

Particularly useful compounds for this invention among the compounds having Formula [G] are those having the following Formulas [G-1] through [G-3]:

Formula [G-1]

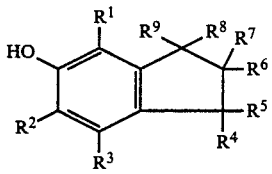

Formula [G-2]

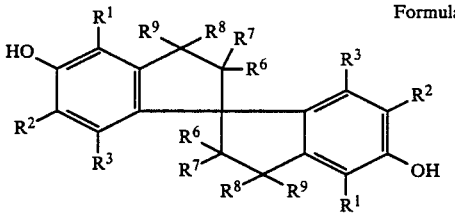

-continued

Formula [G-3]

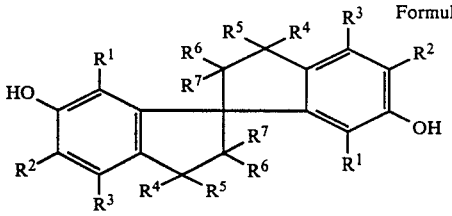

In Formulas [G-1] through [G-3], $R^1$, $R^2$ and $R^3$ are as defined in the foregoing Formula [G], and $R^4$, $R^5$, $R^6$, $R^7$, $R^8$ and $R^9$ each is a hydrogen, a halogen, an alkyl, alkoxy, alkenyl, hydroxy, aryl, aryloxy or heterocyclic group. Each pair of the $R^4$ and $R^5$, the $R^5$ and $R^6$, the $R^6$ and $R^7$, the $R^7$ and $R^8$, and the $R^8$ and $R^9$ may cyclize with each other to form a hydrocarbon ring, and the hydrocarbon ring may further be substituted by an alkyl group.

Particularly useful compounds for this invention are those of Formulas [G-1] through [G-3] in which the $R^1$ and $R^3$ each is a hydrogen atom, an alkyl, alkoxy, hydroxy or cycloalkyl group, and the $R^2$ is a hydrogen atom, an alkyl, hydroxy or cycloalkyl group, and the $R^4$, $R^5$, $R^6$, $R^7$, $R^8$ and $R^9$ each is a hydrogen atom, an alkyl or cycloalkyl group.

The using quantity of the compound having the foregoing Formula [G] is preferably from 5 to 300 mole% of the magenta coupler of this invention, and more preferably from 10 to 200 mole%.

The following are typical examples of the compounds having Formula [G]:

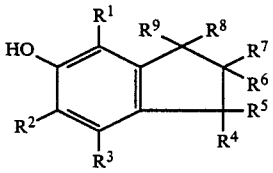

| Cpd. No. | $R^1$ | $R^2$ | $R^3$ | $R^4$ | $R^5$ | $R^6$ | $R^7$ | $R^8$ | $R^9$ |
|---|---|---|---|---|---|---|---|---|---|
| G-1 | H | H | H | H | H | H | H | H | H |
| G-2 | H | H | H | H | H | H | H | $CH_3$ | $CH_3$ |
| G-3 | H | H | H | H | H | H | H | $CH_3$ | $C_{16}H_{33}$ |
| G-4 | H | OH | H | H | H | H | H | $CH_3$ | $C_{16}H_{33}$ |
| G-5 | H | H | H | $CH_3$ | $CH_3$ | H | H | $CH_3$ | $CH_3$ |
| G-6 | H | Cl | H | $CH_3$ | $CH_3$ | H | H | $CH_3$ | $CH_3$ |
| G-7 | Cl | Cl | H | $CH_3$ | $CH_3$ | H | H | $CH_3$ | $CH_3$ |
| G-8 | H | H | $CH_3$ | $CH_3$ | $CH_3$ | H | H | $CH_3$ | CH |
| G-9 | H | H | H | H | 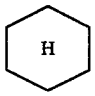 (condensate) | | H | H | H |
| G-10 | H | H | H | H | H | H | H | 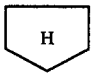 (spiro) | |
| G-11 | H | $C_3H_7$ | H | $CH_3$ | $CH_3$ | H | H | $CH_3$ | $CH_3$ |
| G-12 | H | (t)$C_8H_{17}$ | H | $CH_3$ | $CH_3$ | H | H | $CH_3$ | $CH_3$ |
| G-13 | H | 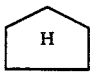 | H | $CH_3$ | $CH_3$ | H | H | $CH_3$ | $CH_3$ |

-continued

| | | | | | | | | |
|---|---|---|---|---|---|---|---|---|
| G-14 | H | H | H | 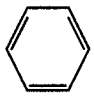 | $CH_3$ | H | $CH_3$ | $CH_3$ |
| G-15 | H | H | $CH_3O$ | $CH_3$ | $CH_3$ | H | $CH_3$ | $CH_3$ |
| G-16 | $CH_3H$ | H | H | H | 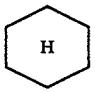 (Condensate) | H | H | H |
| G-17 | H | $CH_3SO_2NH$ | H | $CH_3$ | $CH_3$ | H | $CH_3$ | $CH_3$ |
| G-18 | H | $CH_3CO$ | H | $CH_3$ | $CH_3$ | H | $CH_3$ | $CH_3$ |
| G-19 | H | 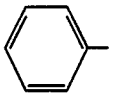 | H | $CH_3$ | $CH_3$ | H | $CH_3$ | $CH_3$ |
| G-20 | H | 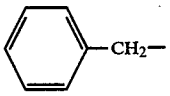 | H | $CH_3$ | $CH_3$ | H | $CH_3$ | $CH_3$ |
| G-21 | H | 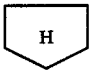 (Condensate) | | H | H | H | H | H |
| G-22 | H | 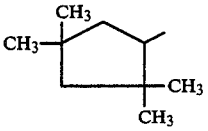 (Condensate) | | $CH_3$ | $CH_3$ | H | $CH_3$ | $CH_3$ |
| G-23 | H | 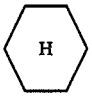 (Condensate) | | $CH_3$ | $CH_3$ | H | $CH_3$ | $CH_3$ |
| G-24 | $CH_3$ | 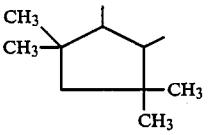 (Condensate) | | $CH_3$ | $CH_3$ | H | $CH_3$ | $CH_3$ |

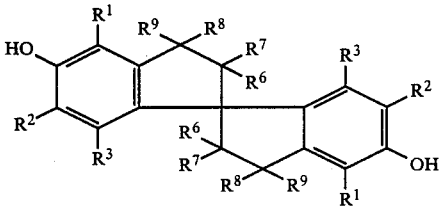

| Cpd. No. | $R^1$ | $R^2$ | $R^3$ | $R^6$ | $R^7$ | $R^8$ | $R^9$ |
|---|---|---|---|---|---|---|---|
| G-29 | H | H | H | H | H | $CH_3$ | $CH_3$ |
| G-32 | $CH_3$ | H | H | H | H | $CH_3$ | $CH_3$ |

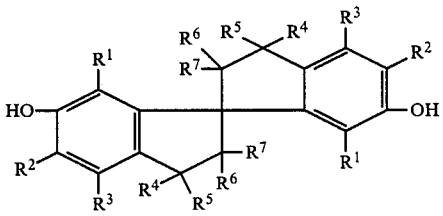

-continued

| Cpd. No. | $R^1$ | $R^2$ | $R^3$ | $R^4$ | $R^5$ | $R^6$ | $R^7$ |
|---|---|---|---|---|---|---|---|
| G-25 | H | $CH_3$ | H | $CH_3$ | $C_6H_5$ | H | H |
| G-26 | Cl | Cl | H | $CH_3$ | $CH_3$ | H | H |
| G-27 | H | OH | H | $CH_3$ | $CH_3$ | H | H |
| G-28 | H | $C_3H_7$ | H | $CH_3$ | $CH_3$ | H | H |
| G-30 | H | Cl | H | $CH_3$ | $CH_3$ | H | H |
| G-31 | H | $C_2H_5$ | H | $CH_3$ | $CH_3$ | H | H |
| G-33 | $CH_3$ | $CH_3$ | H | $CH_3$ | $CH_3$ | H | H |
| G-34 | H | 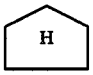 | H | $CH_3$ | $CH_3$ | H | H |
| G-35 | H | $CH_3$ | H | H | H | H | H |
| G-36 | H | H | H | 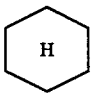 (spiro) | | H | H |
| G-37 | $CH_3$ | H | H | $CH_3$ | $CH_3$ | H | H |
| G-38 | H | $CH_3$ | H | $CH_3$ | $C_6H_5$ | H | H |
| G-39 | 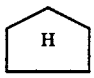 | H | H | $CH_3$ | $CH_3$ | H | H |
| G-40 | $CH_3$ | $CH_3$ | H | $C_2H_5$ | $C_2H_5$ | H | H |
| G-41 | H | H | H | H | H | $CH_3$ | $CH_3$ |
| G-42 | H | OH | H | 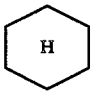 (spiro) | | H | H |
| G-43 | H | 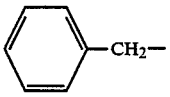 | H | H | H | H | H |
| G-44 | H | (t)$C_4H_9$ | H | $CH_3$ | $CH_3$ | H | H |
| G-45 | H | (t)$C_8H_{17}$ | H | $CH_3$ | $CH_3$ | H | H |

Formula [H]

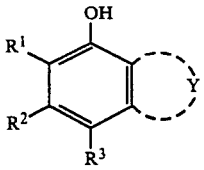

wherein $R^1$ and $R^2$ each is a hydrogen atom, a halogen atom, an alkyl, alkenyl, aryl, acyl, acylamino, acyloxy, sulfonamido, cycloalkyl or alkoxycarbonyl group, and $R^3$ is a hydrogen atom, a halogen atom, an alkyl, alkenyl, alkoxy, hydroxy, aryl, aryloxy, acyl, acylamino, acyloxy, sulfonamido, cycloalkyl or alkoxycarbonyl group.

The above groups each may be substituted by another substituent

Each pair of the $R^1$ and $R^2$ and the $R^2$ and $R^3$ may be allowed to close with each other to form a 5- or 6-member hydrocarbon ring, the hydrocarbon ring being allowed to be substituted by a halogen atom, an alkyl, cycloalkyl, alkoxy, alkenyl, hydroxy, aryl, aryloxy, heterocyclic or the like group.

Y is a group of atoms necessary to form an indan ring, and the indan ring may have a substituent that is allowed to substitute the above-mentioned hydrocarbon ring, and may further form a spiro ring.

Particularly useful compounds for this invention among the compounds having Formula [H] are those having the following Formulas [H-1] through [H-3]:

Formula [H-1]

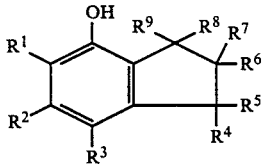

Formula [H-2]

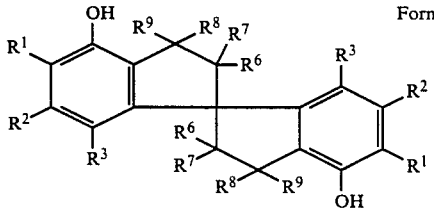

-continued

Formula [H-3]

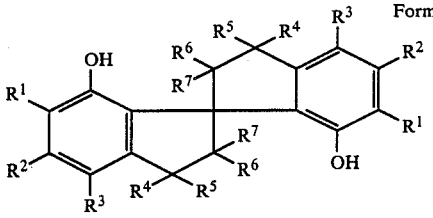

In Formulas [H-1] through [H-2], $R^1$, $R^2$ and $R^3$ are as defined in Formula [H], and $R^4$, $R^5$, $R^6$, $R^7$, $R^8$ and $R^9$ each is a hydrogen atom, a halogen atom, an alkyl, alkoxy, hydroxy, alkenyl, aryl, aryloxy or heterocyclic group, provided that each pair of the $R^4$ and $R^5$, the $R^5$ and $R^6$, the $R^6$ and $R^7$, the $R^7$ and $R^8$, and the $R^8$ and $R^9$ may be allowed to close with each other to form a hydrocarbon ring, and the hydrocarbon ring may further be substituted by an alkyl group.

Particularly useful compounds are those of Formulas [H-1] through [H-3] wherein the $R^1$ and $R^2$ each is a hydrogen atom, an alkyl group or a cycloalkyl group, and the $R^3$ is a hydrogen atom, an alkyl, alkoxy, hydroxy or cycloalkyl group, and the $R^4$, $R^5$, $R^6$, $R^7$, $R^8$ and $R^9$ each is a hydrogen atom, an alkyl group or a cycloalkyl group.

Synthesis methods of the compounds having the foregoing Formula [H] are of the prior art, which may be carried out in accordance with those as described in U.S. Pat. No. 3,057,929; Chem Ber. 1972, 95(5), 1673–1674; and Chemistry Letters, 1980, 739–742.

The using quantity of the compound having Formula [H] is preferably from 5 to 300 mole% of the magenta coupler, and more preferably from 10 to 200 mole%.

The following are typical examples of the compounds having Formula [H]:

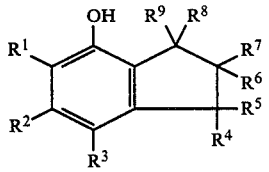

| Compound No. | $R^1$ | $R^2$ | $R^3$ | $R^4$ | $R^5$ | $R^6$ | $R^7$ | $R^8$ | $R^9$ |
|---|---|---|---|---|---|---|---|---|---|
| H-1 | H | H | H | H | H | H | H | H | H |
| H-2 | $CH_3$ | H | H | H | H | H | H | H | H |
| H-3 | H | H | H | H | H | H | H | $CH_3$ | $C_{16}H_{33}$ |
| H-4 | H | H | OH | H | H | H | H | H | H |
| H-5 | $CH_2{=}CHCH_2$ | H | Cl | H | H | H | H | H | H |
| H-6 | H | H | H | H | H | H | H | $CH_3$ | $CH_3$ |
| H-7 | H | H | H | $CH_3$ | $CH_3$ | H | H | H | H |
| H-8 | H | H | H | $CH_3$ | $CH_3$ | $CH_3$ | H | H | H |
| H-9 | $CH_2{=}CHCH_2$ | H | $CH_3O$ | H | H | H | H | H | H |
| H-10 | H | H | H | $CH_3$ | $CH_3$ | H | H | $CH_3$ | $CH_3$ |
| H-11 | H | $C_3H_7$ | H | $CH_3$ | $CH_3$ | H | H | $CH_3$ | $CH_3$ |
| H-12 | Cl | H | Cl | H | H | H | H | $CH_3$ | $CH_3$ |

| Compound No. | $R^1$ | $R^2$ | $R^3$ | $R^4$ | $R^5$ | $R^6$ | $R^7$ | $R^8$ | R8 |
|---|---|---|---|---|---|---|---|---|---|
| H-13 | H | H | H | H | 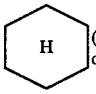 (Condensate) | | H | H | H |
| H-14 | H | H | H | H | H | H | H | 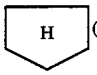 (spiro) | |
| H-15 | H | 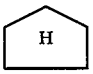 | H | $CH_3$ | $CH_3$ | H | H | $CH_3$ | $CH_3$ |
| H-16 | H | $CH_3SO_2NH$ | H | $CH_3$ | $CH_3$ | H | H | $CH_3$ | $CH_3$ |
| H-17 | H | $CH_3CO$ | H | H | H | H | H | $CH_3$ | $CH_3$ |
| H-18 | H | 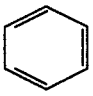 | H | $CH_3$ | $CH_3$ | H | H | $CH_3$ | $CH_3$ |
| H-19 | H | 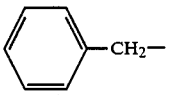 | H | $CH_3$ | $CH_3$ | H | H | $CH_3$ | $CH_3$ |

-continued

| | | | | | | | | | |
|---|---|---|---|---|---|---|---|---|---|
| H-21 | 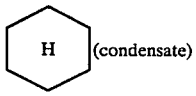 (condensate) | | $CH_3$ | H | H | H | H | $CH_3$ | $CH_3$ |
| H-22 | H | H | H | $CH_3$ | 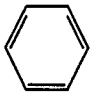 | H | H | $CH_3$ | $CH_3$ |

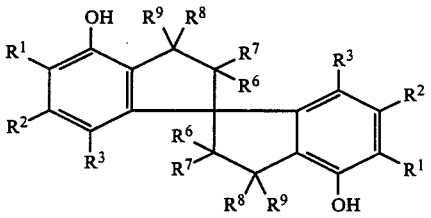

| Compound No. | $R^1$ | $R^2$ | $R^3$ | $R^6$ | $R^7$ | $R^8$ | $R_9$ |
|---|---|---|---|---|---|---|---|
| H-23 | H | H | H | H | H | H | H |
| H-24 | H | H | OH | H | H | H | H |
| H-25 | $CH_3$ | H | $CH_3$ | H | H | H | H |
| H-26 | H | H | $CH_3$ | H | H | H | H |
| H-27 | Cl | H | Cl | H | H | $CH_3$ | $CH_3$ |
| H-28 | H | H | H | H | H | H | 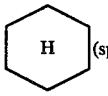 (spiro) |
| H-29 | H | H | H | H | H | $CH_3$ | 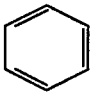 |
| H-30 | H | H | 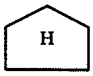 | H | H | H | H |
| H-31 | H | H | 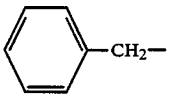 | H | H | $CH_3$ | $CH_3$ |
| H-36 | H | H | (t)$C_4H_9$ | H | H | $CH_3$ | $CH_3$ |

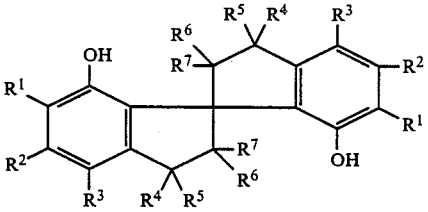

| Compound No. | $R^1$ | $R^2$ | $R^3$ | $R^4$ | $R^5$ | $R^6$ | $R^7$ |
|---|---|---|---|---|---|---|---|
| H-32 | H | H | H | H | H | H | H |
| H-33 | H | H | H | $CH_3$ | $CH_3$ | H | H |
| H-34 | H | H | (t)$C_4H_9$ | $CH_3$ | $CH_3$ | H | H |
| H-35 | H | H | (t)$C_8H_{17}$ | $CH_3$ | $CH_3$ | H | H |

In addition, H-20

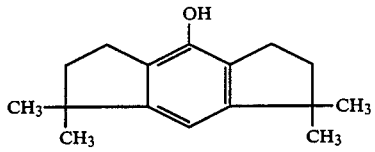

Formula [J]

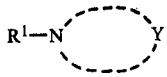

wherein $R^1$ is an aliphatic group, a cycloalkyl group or an aryl group, and Y is a group of nonmetallic atoms necessary to form a 5- to 7-member heterocyclic ring along with a nitrogen atom, provided that, if there are two or more hetero atoms among the heterocyclic ring-forming nonmetallic atoms including the nitrogen atom, the at least two hetero atoms are ones not adjacent to each other.

The aliphatic group represented by the $R^1$ is a saturated alkyl group which may have a substituent or a unsaturated alkyl group which may have a substituent.

The cycloalkyl group represented by the $R^1$ include a 5- to 7-member cycloalkyl group which may have a substituent.

The aryl group represented by the $R^1$ is a phenyl or naphthyl group which each may have a substituent.

Examples of the substituent to the aliphatic groups, cycloalkyl group and aryl group represented by the $R^1$ include alkyl, aryl, alkoxy, carbonyl, carbamoyl, acylamino, sulfamoyl, sulfonamido, carbonyloxy, alkylsulfonyl, arylsulfonyl, hydroxy, heterocyclic, alkylthio, arylthio, and the like groups.

In the foregoing Formula [J], the Y represents a group of nonmetallic atoms necessary to form a 5- to 7-member heterocyclic ring along with a nitrogen atom, and at least two out of the group of the nonmetallic atoms including the nitrogent atom for the formation of the heterocyclic ring must be hetero atoms. And the at least two hetero atoms are not allowed to be adjacent to each other. In the heterocyclic ring of the compound having Formula [J], if all the hetero atoms are adjacent to one another, the compound is unable to function as the stabilizer for a magenta dye image, so that their adjacence is unacceptable.

The foregoing 5- to 7-member heterocyclic ring of the compound having Formula [J] may be allowed to have a substituent such as, e.g., an alkyl, aryl, acyl, carbamoyl, alkoxycarbonyl, sulfonyl or sulfamoyl group. The 5- to 7-member heterocyclic ring may be an unsaturated one, and more preferably a saturated heterocyclic ring. Also, the heterocyclic ring may be a condensed ring with a benzene ring, and may also form a spirto ring.

The using quantity of the compound having Formula [J] is preferably from 5 to 300 mole% of the magenta coupler having the foregoing Formula [I] of this invention, and more preferably from 10 to 200 mole%.

The following are typical examples of the compounds having Formula [J]:

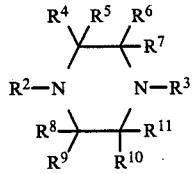

| Cpd. No. | $R^2$ | $R^3$ | $R^4$ | $R^5$ | $R^6$ | $R^7$ | $R^8$ | $R^9$ | $R^{10}$ | $R^{11}$ |
|---|---|---|---|---|---|---|---|---|---|---|
| J-1 | $C_{12}H_{12}$ | $C_{25}H_{25}$ | H | H | H | H | H | H | H | H |
| J-2 | $C_{14}H_{29}$ | $C_{14}H_{29}$ | H | H | H | H | H | H | H | H |
| J-3 | $C_{14}H_{29}$ | H | H | H | H | H | H | H | H | H |
| J-4 | $C_{14}H_{29}$ | $CH_3CO$ | H | H | H | H | H | H | H | H |
| J-5 | $C_{16}H_{33}$ | $C_{16}H_{33}$ | H | H | H | H | H | H | H | H |
| J-6 | $C_{14}H_{29}$ | $CH_3$ | H | H | H | H | H | H | H | H |
| J-7 | 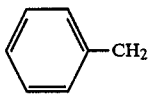 | 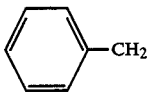 | H | H | H | H | H | H | H | H |
| J-8 | 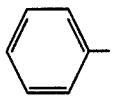 | 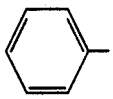 | H | H | H | H | H | H | H | H |
| J-11 | $CH_3$ | 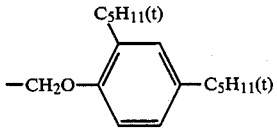 | H | H | H | H | H | H | H | H |
| J-13 | $C_{14}H_{29}$ | $C_4H_9NHCO$ | H | H | H | H | H | H | H | H |
| J-14 | $(t)C_8H_{17}$ | 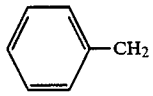 | H | H | H | H | H | H | H | H |

-continued

| | | | | | | | | | | |
|---|---|---|---|---|---|---|---|---|---|---|
| J-15 | $C_{14}H_{29}$ | $CF_3CO$ | H | H | H | H | H | H | H | H |
| J-16 | $C_{14}H_{29}$ | $C_2H_5OCO$ | H | H | H | H | H | H | H | H |
| J-17 | $CH_3$ | 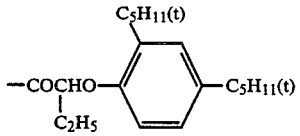 | H | H | H | H | H | H | H | H |
| J-18 | $C_{14}H_{29}$ | $C_{14}H_{29}$ | $CH_3$ | H | H | H | H | H | H | H |
| J-19 | $C_{14}H_{29}$ | $C_{14}H_{29}$ | $CH_3$ | H | H | H | H | H | $CH_3$ | H |
| J-20 | $C_{14}H_{29}$ | $C_{14}H_{29}$ | $CH_3$ | $CH_3$ | $CH_3$ | $CH_3$ | $CH_3$ | $CH_3$ | $CH_3$ | $CH_3$ |
| J-21 | $CH_3$ | 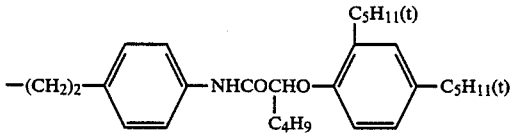 | H | H | H | H | H | H | H | H |
| J-22 | $C_{12}H_{25}$ | $CH_3$ | $CH_3$ | H | H | H | $CH_3$ | H | H | H |
| J-23 | $C_{12}H_{25}$ | $C_{12}H_{25}$ | $CH_3$ | H | H | H | H | H | $CH_3$ | H |
| J-24 | $C_{16}H_{33}$ | $C_{16}H_{33}$ | $CH_3$ | H | H | H | H | H | $CH_3$ | H |
| J-25 | $C_6H_5CH{=}CH{-}CH_2{-}$ | $C_{12}H_{25}$ | H | H | H | H | H | H | H | H |
| J-26 | $C_{12}H_{25}$ | $C_2H_5$ | $CH_3$ | H | H | H | H | H | H | H |
| J-27 | $C_{16}H_{33}$ | H | $C_2H_5$ | H | H | H | H | H | H | H |
| J-29 | $C_{14}H_{29}$ | $CH_2BrCH_2$ | H | H | H | H | H | H | H | |
| J-30 | $CH_3O(CH_2)_4{-}$ | $CH_3O(CH_2)_4$ | H | H | H | H | H | H | H | H |

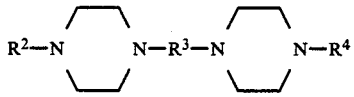

| Compound No. | $R^2$ | $R^3$ | $R^4$ |
|---|---|---|---|
| J-9 | $C_{14}H_{29}$ | $(CH_2)_2$ | $C_{14}H_{29}$ |
| J-10 | $(t)C_8H_{17}$ | $(CH_2)_6$ | $(t)C_8H_{17}$ |
| J-12 | $C_{14}H_{29}$ | $CH_2$ | $C_{14}H_{29}$ |
| J-28 | $C_{12}H_{25}$ | 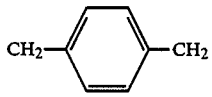 | $C_{12}H_{25}$ |

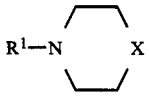

| Compound No. | X | $R^1$ |
|---|---|---|
| J-31 | O | $C_{12}H_{25}$ |
| J-32 | O | $C_{14}H_{29}$ |
| J-33 | O | $C_6H_5CH{=}CH{-}$ |
| J-34 | O | 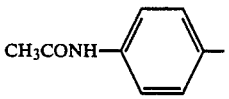 |
| J-35 | O | α-naphthyl |
| J-36 | O | 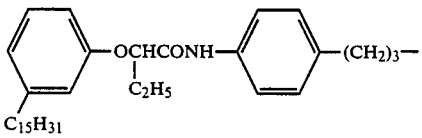 |

-continued
| | | |
|---|---|---|
| J-37 | O | 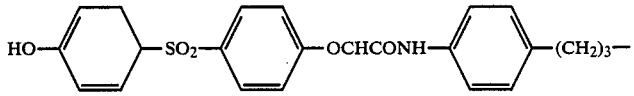 |
| J-38 | O | 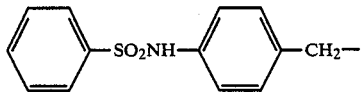 |
| J-39 | O | 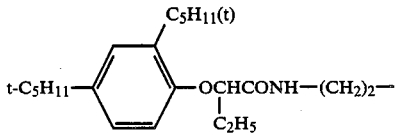 |
| J-40 | O | 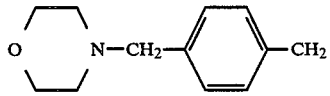 |
| J-41 | S | $C_{14}H_{29}$ |
| J-42 | S | 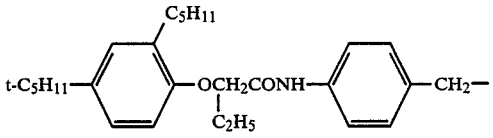 |
| J-43 | S | 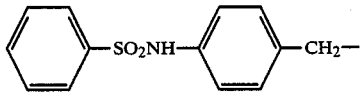 |
| J-44 | S | 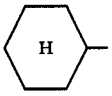 |
| J-45 | S | 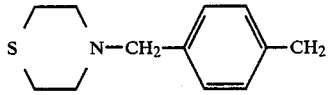 |
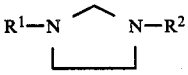
| Compound No. | $R^1$ | $R^2$ |
|---|---|---|
| J-46 | $C_{12}H_{25}$ | $C_{12}H_{25}$ |
| J-47 | $C_{14}H_{29}$ | $C_{14}H_{29}$ |
| J-48 | $C_6H_5CH_2$ | $C_6H_5CH_2$ |
| J-49 | $C_{16}H_{33}$ | H |
| J-50 | $C_{16}H_{33}$ | $CH_3CO$ |
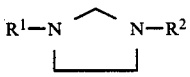
| | | |
|---|---|---|
| J-51 | $C_{16}H_{33}$ | $C_{16}H_{33}$ |
| J-52 | $C_{14}H_{29}$ | $C_{14}H_{29}$ |
| J-53 | $C_{12}H_{25}$ | $C_{12}H_{25}$ |
| J-54 | $C_{14}H_{29}$ | $CH_3CO$ |
| J-55 | $C_{14}H_{29}$ | $CF_3CO$ |

-continued
| | | |
|---|---|---|
| J-56 | $C_2H_5$ | 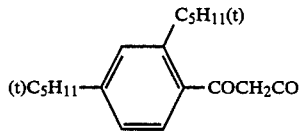 |
| J-57 | $C_{14}H_{29}$ | $C_2H_5OCO$ |
| J-58 | $C_{14}H_{29}$ | $CH_3NHCO$ |
| J-59 | $C_{14}H_{29}$ | $C_4H_9SO_2$ |
| J-60 | $C_{14}H_{29}$ | $(CH_3)_2NSO_2$ |
| J-61 | $C_{12}H_{25}$ | 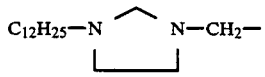 |
| J-62 | H | 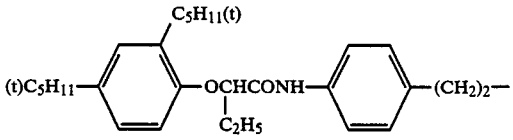 |
| J-63 | | 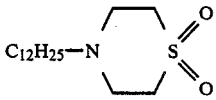 |
| J-64 | | 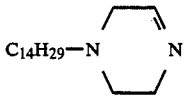 |
| J-65 | | 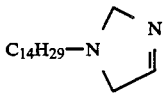 |
| J-66 | | 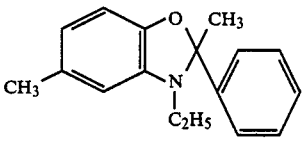 |
| J-67 | | 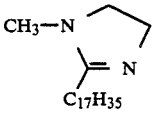 |
| J-68 | | 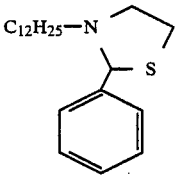 |
| J-69 | | 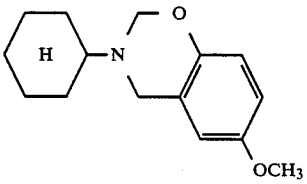 |

-continued

J-70

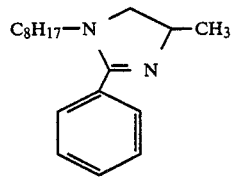

J-71

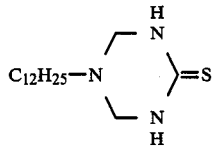

J-72

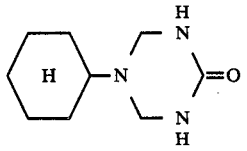

J-73

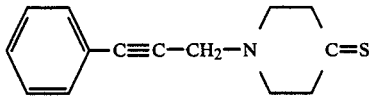

J-74

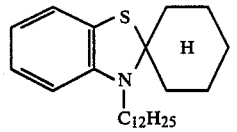

Among the compounds having the foregoing Formula [J] these piperazine and homopiperazine compounds are particularly preferred, and the more preferred are those compounds having the following Formula [J-1] or [J-2]:

Formula [J-1]

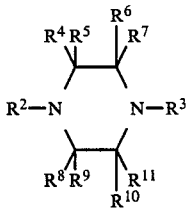

Formula [J-2]

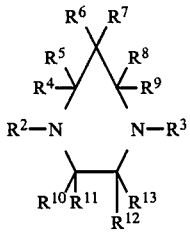

wherein $R^2$ and $R^3$ each is a hydrogen atom, an alkyl group or an aryl group, provided that the $R^2$ and $R^3$ are not allowed to be hydrogen at the same time, and $R^4$ through $R^{13}$ each is a hydrogen atom, an alkyl group or an aryl group.

The total number of the carbon atoms of the $R^2$ and $R^3$ (including the substituent) is preferably from 6 to 40.

Particular examples of the compounds having the foregoing Formulas [J-1] and [J-2] are as have been described in exemplified piperazine-type compounds (J-1) through (J-30) and exemplified homopiperazine-type compounds (J-51) through (J-62).

Formula [K]

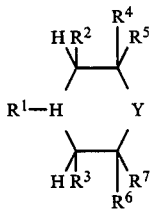

wherein $R^1$ is an aliphatic group, a cycloalkyl group or an aryl group, Y is a simple bond or divalent hydrocarbon group necessary to form a 5- to 7-member heterocyclic ring along with a nitrogen atom, $R^2$, $R^3$, $R^4$, $R^5$, $R^6$ and $R^7$ each is a hydrogen atom, an aliphatic group, a cycloalkyl group or an aryl group, provided that the $R^2$ and $R^4$ and the $R^3$ and $R^6$ each pair may combine with each other to form a simple bond to thereby form an unsaturated 5- to 7-member heterocyclic ring along with the nitrogen atom and Y. And where the Y is a simple bond, the $R^5$ and $R^7$ may combine with each other to form a simple bond to thereby form an unsaturated 5-member heterocyclic ring along with the Y.

While when the Y is a divalent hydrocarbon group; e.g., a methylene group, the $R^1$ and Y or the $R^7$ and Y may form unsaturated bonding to thereby form an unsaturated 6-member heterocyclic ring, and if it is a methylene group, the $R^5$ and Y, the $R^7$ and Y or the Y itself may form unsaturated bonding to thereby form an unsaturated 7-member heterocyclic ring. Further, the divalent hydrocarbon group may have a substituent.

The compound having Formula [K] is more desirable to be one having a saturated 5- to 7-member heterocyclic ring than to be one having an unsaturated 5- to 7-member heterocyclic ring.

The using quantity of the compound having Formula [K] is preferably from 5 to 300 mole% of the magenta coupler having Formula [I] of this invention, and more preferably from 10 to 200 mole%.

The following are typical examples of the compounds having Formula [K]:

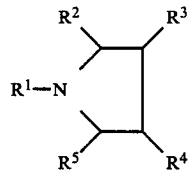

| Cpd. No. | $R^1$ | $R^2$ | $R^3$ | $R^4$ | $R^5$ |
|---|---|---|---|---|---|
| K-1 | $C_8H_{17}$ | H | H | H | H |
| K-2 | 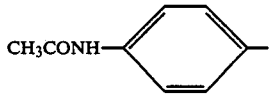 | H | H | H | H |
| K-3 | 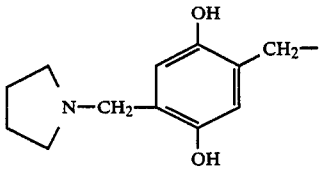 | H | H | H | H |
| K-4 | $C_{12}H_{25}$ | H | H | H | H |
| K-5 | $C_{14}H_{29}$ | H | H | H | H |
| K-6 | $C_{16}H_{33}$ | H | H | H | H |
| K-7 | $C_{14}H_{29}$ | H | 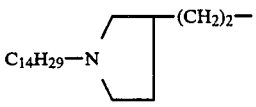 | H | H |
| K-8 | 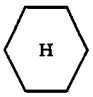 | $CH_3$ | $CH_3$ | H | H |
| K-9 | $C_6H_5CH{=}CHCH_2-$ | H | H | H | H |
| K-10 | 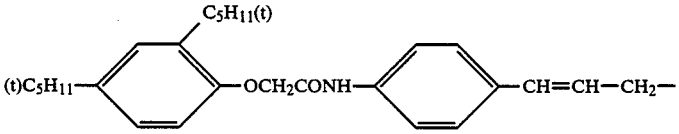 | H | H | H | H |

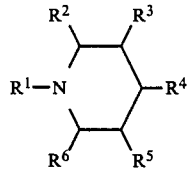

| Cpd. No. | $R^1$ | $R^2$ | $R^3$ | $R^4$ | $R^5$ | $R^6$ |
|---|---|---|---|---|---|---|
| K-11 | $(t)C_8H_{17}$ | H | H | H | H | H |
| K-12 | 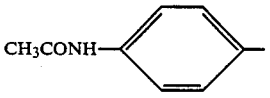 | H | H | H | H | H |
| K-13 | $C_{12}H_{25}$ | H | H | H | H | H |
| K-14 | $C_{14}H_{29}$ | H | H | H | H | H |

-continued
| | | | | | | |
|---|---|---|---|---|---|---|
| K-15 | $C_{16}H_{33}$ | H | H | H | H | H |
| K-16 | $C_{14}H_{29}$ | H | H | H | H | H |
| K-17 | 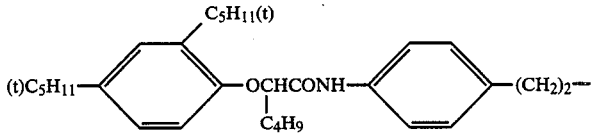 | | | H | H | H |
| K-18 | $C_8H_{17}$ | $CH_3$ | $CH_3$ | H | $CH_3$ | $CH_3$ |
| K-19 | 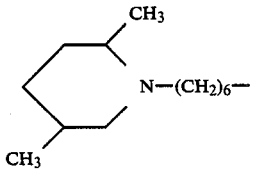 | $CH_3$ | H | H | $CH_3$ | H |
| K-20 | $CH_3$ | H | H | $C_{12}H_{25}OCOCH_2$— | H | H |
| K-21 | $CH_3$ | $CH_3$ | H | $C_{16}H_{33}OCOCH_2$— | H | $CH_3$ |
| K-22 | $CH_3$ | $C_{16}H_{33}$ | H | H | H | H |
| K-23 | $C_6H_5$ | H | H | $C_{12}H_{25}OCO$— | H | H |
| K-24 | $CH_3$ | $C_6H_5$ | H | H | H | H |
| K-25 | 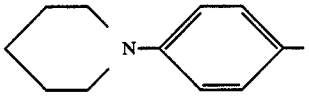 | H | H | H | H | H |
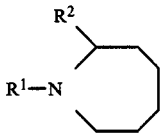
| Cpd. No. | $R^1$ | $R^2$ |
|---|---|---|
| K-26 | $C_8H_{17}$ | H |
| K-27 | 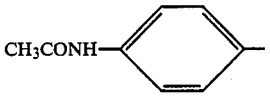 | H |
| K-28 | 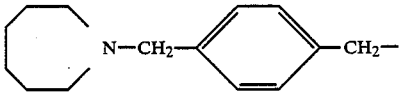 | H |
| K-29 | $C_{14}H_{29}$ | H |
| K-30 | 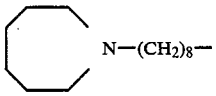 | H |
| K-31 | $C_{16}H_{33}$ | $CH_3$ |
| K-32 | 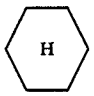 | H |
| K-33 | 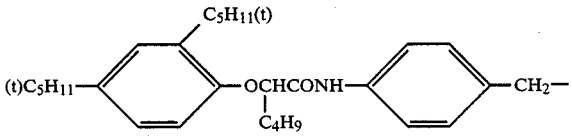 | H |

-continued

K-34

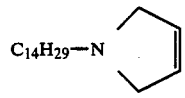

K-35

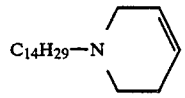

K-36

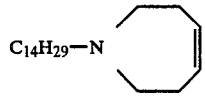

K-37

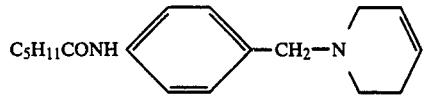

K-38

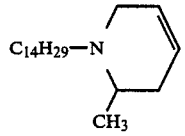

K-39

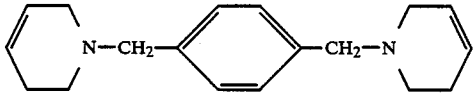

K-40

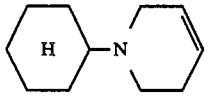

K-41

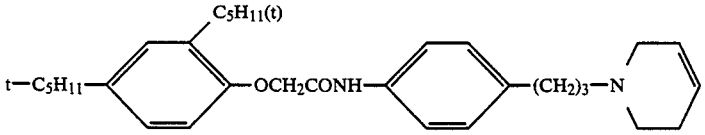

The silver halide color photographic light-sensitive material of this invention may contain an ultraviolet absorbing agent in the hydrophilic colloid layers thereof including the protective layer, interlayers, etc., for the purpose of preventing the fog possibly produced by the discharge due to the frictional charging of the light-sensitive material.

Compounds suitably usable as the ultraviolet agent for this invention are those having the following Formula [VII]:

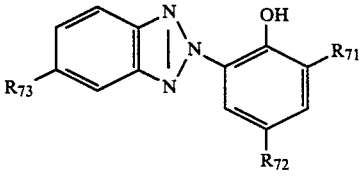

Formula [VII]

wherein $R_{71}$, $R_{72}$ and $R_{73}$ each is a hydrogen atom, a halogen atom, an alkyl, aryl, alkoxy, aryloxy, alkenyl, nitro or hydroxyl group.

Further, out of the compounds having the foregoing Formula [VII] those being in the liquid form at normal temperature, since also usable as the high-boiling organic solvent for hydrophobic compounds such as the coupler of this invention, may be advantageously used in respect of their capability of lowering the oil ratio in the coated layer as well as of their deposition property.

The 'being in the liquid form at normal temperature' implies that it requires they be in the liquid form under the temperature condition in the process for incorporating a compound having Formula [VII] into the silver halide color photographic light-sensitive material of this invention; the melting point thereof is preferably not more than 30° C., and more preferably not more than 15° C.

In this instance, if in the liquid form under the above condition, any of those 2-(2'-hydroxyphenyl)benzotriazole-type compounds may be used alone or in a mixture thereof. As the mixture, those comprised of constitutional isomers may be suitably used.

The following are typical examples of the compounds having the foregoing Formula [VII], baut the present invention is not restricted by the examples:

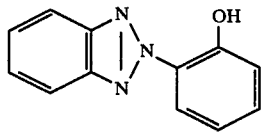
(UV-1)
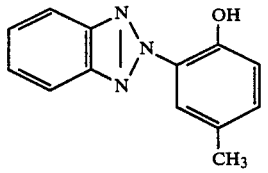
(UV-2)
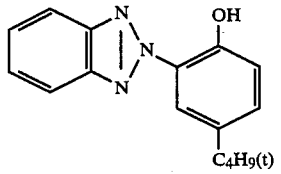
(UV-3)
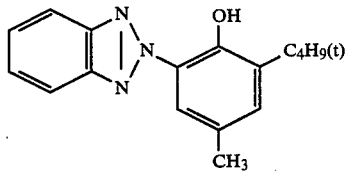
(UV-4)
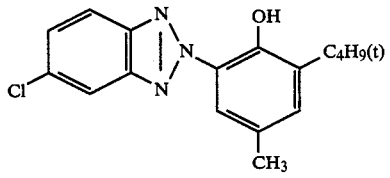
(UV-5)
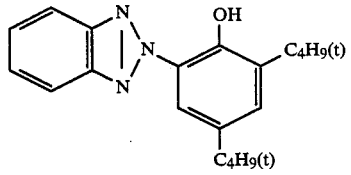
(UV-6)
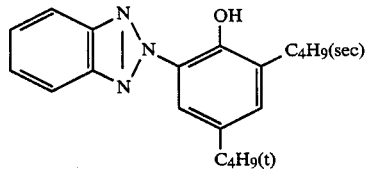
(UV-7)
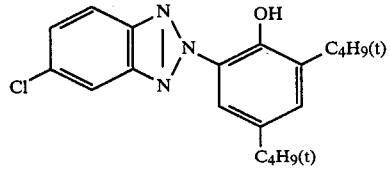
(UV-8)

-continued
(UV-9)
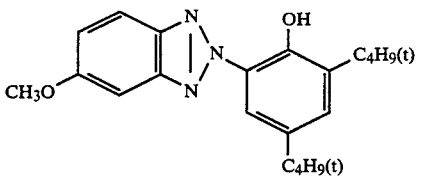
(UV-10)
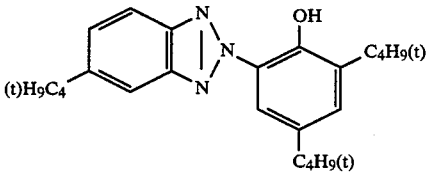
(UV-11)
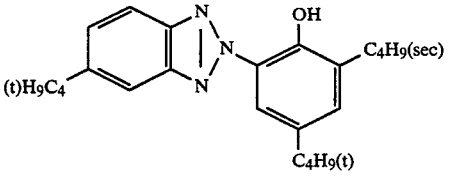
(UV-12)
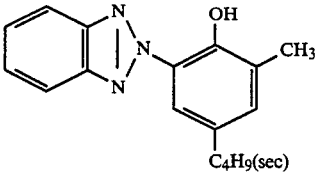
(UV-13)
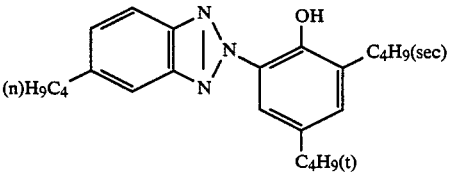
(UV-14)
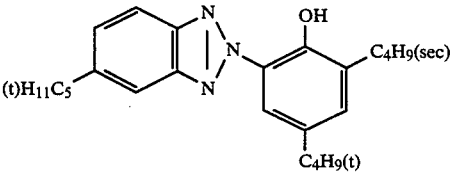
(UV-15)
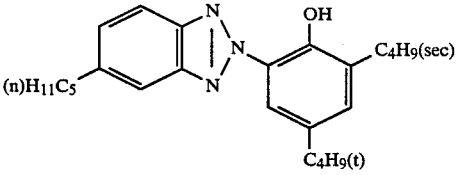
(UV-16)
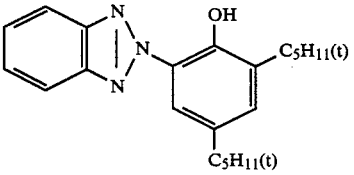

-continued
(UV-17)
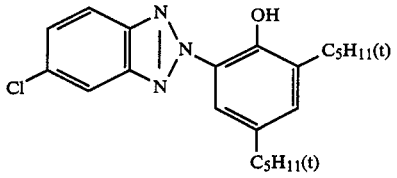
(UV-18)
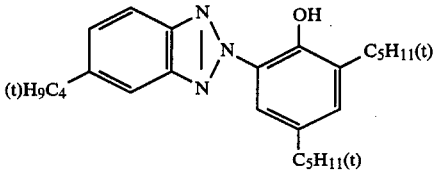
(UV-19)
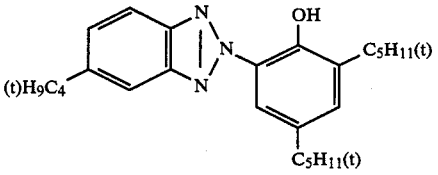
(UV-20)
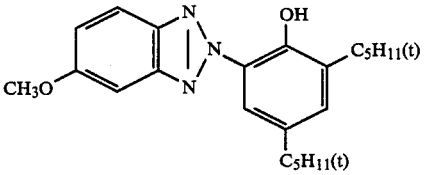
(UV-21)
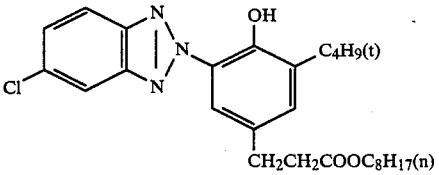
(UV-22)
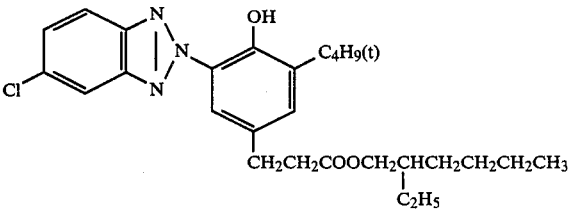
(UV-23)
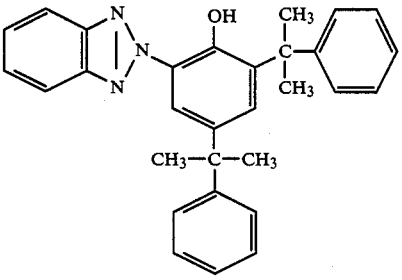

-continued (UV-24)

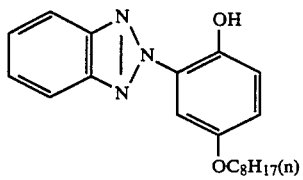

These ultraviolet absorbing agents may be used in any quantity, but the adding quantity thereof should be preferably from 1 to 50 mg/dm$^2$, and more preferably from 2 to 30 mg/dm$^2$ to the coupler.

The silver halide photographic light-sensitive materials of the invention may be arbitrarily added with additives such as a hardener, a plasticizer, a latex, a surfactant, a matting agent, a lubricant, an antistatic agent and the like.

The silver halide photographic light-sensitive materials of the invention may be able to reproduce images through any color developing processes well-known in the art.

In the invention, the color developing agents capable of being used in a color developer include the derivatives of aminophenol type and p-phenylenediamine type which are being widely used in a variety of color photographic processes.

The silver halide photographic light-sensitive materials of the invention are color-developed and are then bleached and fixed, provided that the bleaching and fixing treatments may be carried out simultaneously.

After completing the fixing treatment, a washing treatment is normally carried out. And, for a substitution of the washing treatment, it is also allowed to carries out a stabilizing treatment or a combination of the washing and stabilizing treatments.

As has been described above, the silver halide color photographic light-sensitive material of this invention is capable of forming a dye image which is excellent in the overall discoloration color balance of the yellow, magenta and cyan dyes in the light or dark discoloration even when stored being exposed to light or stored in the dark over an extensive period of time and also excellent in the image quality thereof with little of no yellow stain even when stored over a long period of time.

EXAMPLE

The present invention will be described further in detail below, but the embodiments of this invention are not limited to the examples.

EXAMPLE-1

A silver halide color photographic light-sensitive material was produced by coating in order from the support side the respective layers thereof which were prepared so as to be of the compositions as shown in the following Table-1.

The yellow, magenta and cyan couplers and the high boiling organic solvents used therein are shown in Table-2, respectively.

TABLE 1

| layer | Composition |
|---|---|
| Third layer (green-sensitive layer) | Gelatin (1.5 g/m$^2$)<br>Silver chlorobromide emulsion *(silver equivalent 0.2 g/m$^2$, and 0.4 g/m$^2$ for the sample containing a comparative coupler)<br>Magenta coupler* (0.40 g/m$^2$)<br>Compound of Formula [VI] HQ-2 (0.01 g/m$^2$)<br>High-boiling organic solvent *(0.25 g/m$^2$) |
| Second layer (First inter-layer) | Gelatin (1.0 g/m$^2$)<br>Compound of Formula [VI] HQ-2 (0.07 g/m$^2$)<br>High-boiling organic solvent<br>Isodecyl phthalate (0.04 g/m$^2$) |
| First layer (Blue-sensitive layer) | Gelatin (2.0 g/m$^2$)<br>Silver chlorobromide emulsion [containing 90 mole % AgBr] (silver equivalent 0.3 g/m$^2$)<br>Yellow coupler *(0.8 g/m$^2$)<br>Compound of Formula [VI] HQ-2 (0.02 g/m$^2$)<br>High-boiling organic solvent *(0.3 g/m$^2$) |
| Support | Polyethylene-coated paper |
| Seventh layer (Protective layer) | Gelatin (1.0 g/m$^2$) |
| Sixth layer (Third inter-layer) | Gelatin (1.0 g/m$^2$)<br>Ultraviolet absorbing agent<br>UV-6 (0.2 g/m$^2$)<br>UV-16 (0.1 g/m$^2$)<br>Compound of Formula [VI] HQ-2 (0.02 g/m$^2$)<br>High-boiling organic solvent<br>Dinonyl phthalate (0.2 g/m$^2$) |
| Fifth layer (Red-sensitive layer) | Gelatin (1.2 g/m$^2$)<br>Silver chlorobromide emulsion [containing 70 mole % AgBr] (silver equivalent 0.25 g/m$^2$)<br>Cyan coupler *(0.4 mole per mole of silver halide)<br>Compound of Formula [VI] HQ-2 (0.01 g/m$^2$)<br>High-boiling organic solvent (0.2 g/m$^2$) |
| Fourth layer (Second inter-layer) | Gelatin (1.5 g/m$^2$)<br>Ultraviolet absorbing agent<br>UV-6 (0.5 g/m$^2$)<br>UV-16 (0.2 g/m$^2$)<br>Compound of Formula [VI] HQ-2 (0.03 g/m$^2$)<br>High-boiling organic solvent<br>Dinonyl phthalate (0.2 g/m$^2$) |

Note:
The parenthesized values are adding quantities.
The asterisked are given in Table 2.

The structures of the comparative yellow coupler (YC-1), comparative magenta coupler (MC-1) and comparative cyan coupler (CC-1), and the comparative high-boiling organic solvents DBP and TCP, which are given in Table 2, are as follows:

Comparative Yellow Coupler

YC-1

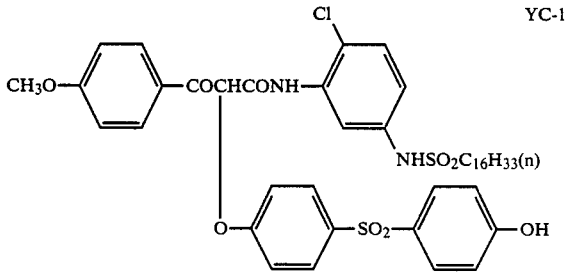

Comparative Magenta Coupler

-continued

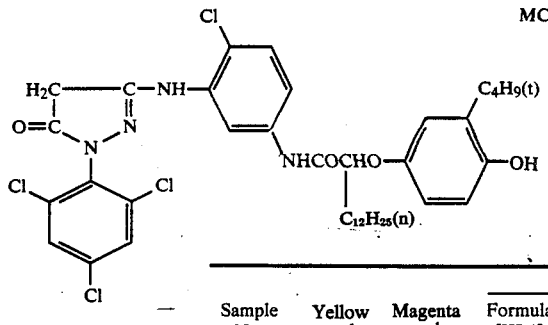

MC-1

-continued

| High-boiling organic solvent No. | Dielectric constant |
|---|---|
| 12 | 4.6 |

TABLE 2

| Sample No. | Yellow coupler | Magenta coupler | Cyan coupler Formula [III-1] | Cyan coupler Formula [III-2] | Cyan coupler (III-1/III-2) molar ratio | Y-layer high-boiling organic solv. | M layer high-boiling organic solv. | C layer high-boiling organic solv. |
|---|---|---|---|---|---|---|---|---|
| 1(com.) | YC-1 | MC-1 | CC-1 | | — | DBP | DBP | DBP |
| 2(com.) | Y-7 | 59 | C-29 | — | — | DBP | DBP | DBP |
| 3(com.) | Y-7 | 59 | — | C-36 | — | DBP | DBP | DBP |
| 4(com.) | Y-7 | 59 | CC-1, C-29 | | 50/50 | DBP | DBP | DBP |
| 5(com.) | Y-7 | 59 | CC-1, C-36 | | 50/50 | DBP | DBP | DBP |
| 6(com.) | Y-7 | 59 | C-29 | C-36 | 50/50 | DBP | DBP | DBP |
| 7(com.) | Y-7 | 59 | C-29 | C-36 | 50/50 | TCP | TCP | TCP |
| 8(com.) | YC-1 | MC-1 | CC-1 | | — | 2 | 2 | 2 |
| 9(com.) | Y-7 | 59 | C-29 | — | — | 2 | 2 | 2 |
| 10(com.) | Y-7 | 69 | — | C-36 | — | 2 | 2 | 2 |
| 11(com.) | Y-7 | 59 | CC-1, C-29 | | 50/50 | 2 | 2 | 2 |
| 12(com.) | Y-7 | 59 | CC-1, C-36 | | 50/50 | 2 | 2 | 2 |
| 13(com.) | Y-7 | 59 | C-29 | C-36 | 50/50 | 2 | 2 | DBP |
| 14(com.) | Y-7 | 59 | C-29 | C-36 | 50/50 | 2 | TCP | 2 |
| 15(com.) | Y-7 | 59 | C-29 | C-36 | 50/50 | DBP | 2 | 2 |
| 16(com.) | Y-7 | 59 | C-29 | C-36 | 50/50 | TCP | 2 | TCP |
| 17(com.) | Y-7 | 59 | C-29 | C-36 | 50/50 | TCP | DBP | 2 |
| 18(com.) | Y-7 | 59 | C-29 | C-36 | 50/50 | 2 | DBP | DBP |
| 19(inv.) | Y-7 | 59 | C-29 | C-36 | 50/50 | 2 | 2 | 2 |
| 20(inv.) | Y-7 | 59 | C-29 | C-36 | 50/50 | 6 | 6 | 6 |
| 21(inv.) | Y-7 | 59 | C-29 | C-36 | 50/50 | 8 | 8 | 8 |
| 22(inv.) | Y-7 | 59 | C-29 | C-36 | 50/50 | 12 | 12 | 12 |
| 23(inv.) | Y-7 | 59 | C-29 | C-36 | 50/50 | 2 | 12 | 8 |
| 24(inv.) | Y-7 | 59 | C-29 | C-36 | 50/50 | 6 | 8 | 6 |
| 25(inv.) | Y-7 | 59 | C-29 | C-36 | 50/50 | 8 | 6 | 12 |
| 26(inv.) | Y-7 | 59 | C-29 | C-36 | 50/50 | 12 | 2 | 2 |
| 27(inv.) | Y-7 | 59 | C-29 | C-36 | 50/50 | 2 + 8* | 2 + 6 | 8 + 12* |

Note:
The asterisked is a mixture of two different high-boiling solvents in the same quantity.

Comparative Cyan Coupler

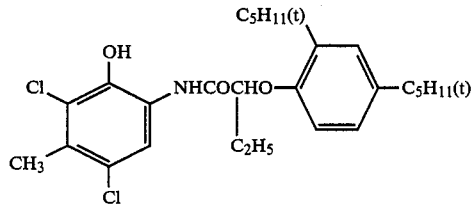

CC-1

DBP: Dibutyl phthalate Dielectric constant (6.5)

TCP: Tricresyl phosphate Dielectric constant (6.9)

The dielectric constant values of the high-boiling organic solvents of this invention used in the examples are as follows:

| High-boiling organic solvent No. | Dielectric constant |
|---|---|
| 2 | 5.1 |
| 6 | 4.6 |
| 8 | 4.4 |

The above obtained samples each was exposed through an optical wedge to a white light using a sensitometer (Model KS-7, manufactured by Konishiroku Photo Industry Co., Ltd.), and was then processed in accordance with the following processing procedure:

| Processing step | Processing temperature | Processing time |
|---|---|---|
| [1] Color developing | 38° C. | 3 min. 30 sec. |
| [2] Bleach-fix | 33° C. | 1 min. 30 sec. |
| [3] Washing | 25–30° C. | 3 min. |
| [4] Drying | 75–80° C. | About 2 min. |

Compositions of the processing solutions:

| | |
|---|---|
| Color developer | |
| Benzyl alcohol | 15 ml |
| Ethylene glycol | 15 ml |
| Potassium sulfite | 2.0 g |
| Potassium bromide | 0.7 g |
| Sodium chloride | 0.2 g |
| Potassium carbonate | 30.0 g |
| Hydroxyamine sulfate | 3.0 g |
| Polyphosphoric acid (TPPS) | 2.5 g |
| 3-methyl-4-amino-N—ethyl-N—(β-methanesulfonamidoethyl)-aniline sulfate | 5.5 g |
| Brightening agent (4,4'-diaminostilbensulfonic acid derivative) | 1.0 g |
| Potassium hydroxide | 2.0 g |
| Add water to make 1 liter. Adjust the pH to 10.20 | |
| Bleach-fix bath | |
| Ferric-ammonium ethylenediaminetetraacetate, dihydrated | 60.0 g |
| Ethylenediaminetetraacetic acid | 3.0 g |
| Ammonium thiosulfate (70% solution) | 100 ml |

-continued

| | |
|---|---|
| Ammonium sulfite (40% solution | 27.5 ml |
| Use potassium carbonate or glacial acetic acid to adjust the pH to 7.1, and add water to make 1 liter. | |

The above Samples 1 through 27 were evaluated with respect to the following items:

(a) The color-forming balance of the respective couplers.

(b) The discoloration color balance of the respective couplers.

Firstly, in order to evaluate the color-forming balance of the respective couplers, each sample that was prepared under the usual condition of using the coupler-dispersed liquids without retention was processed in the above processes, and the maximum reflection densities of the respective yellow, magenta and cyan color formed dyes were measured by using a densitometer PDA-65 (manufactured by Konishiroku Photo Industry Co., Ltd.). The results are shown in Table 3.

In order to examine the stability of each coupler-dispersed liquid, the samples were prepared in the same manner except that the respective coupler-dispersed liquids were used after being allowed to stand for 48 hours at 40° C., and processed, and measured in like manner for the maximum reflection densities of the respective color-formed dyes to examine changes in the densities. The results are shown in Table-3.

TABLE 3

| | Coupler-dispersed liquid without retention | | | Coupler-dispersed liquid with retention (48 hrs at 40° C.) | | |
|---|---|---|---|---|---|---|
| Sample No. | Y $D^B$max | M $D^G$max | C $D^R$max | Y $D^B$max | M $D^G$max | C $D^R$max |
| 1 (com.) | 2.31 | 2.20 | 2.63 | 2.10 | 2.09 | 2.31 |
| 2 (com.) | 2.41 | 2.41 | 2.08 | 2.21 | 2.05 | 1.95 |
| 3 (com.) | 2.40 | 2.42 | 2.49 | 2.20 | 2.04 | 2.21 |
| 4 (com.) | 2.41 | 2.41 | 2.20 | 2.20 | 2.03 | 1.99 |
| 5 (com.) | 2.41 | 2.41 | 2.52 | 2.21 | 2.04 | 2.20 |
| 6 (com.) | 2.40 | 2.41 | 2.35 | 2.20 | 2.03 | 2.10 |
| 7 (com.) | 2.41 | 2.42 | 2.32 | 2.21 | 2.05 | 2.05 |
| 8 (com.) | 2.21 | 1.91 | 2.52 | 2.21 | 1.80 | 2.28 |
| 9 (com.) | 2.22 | 2.23 | 1.93 | 2.15 | 2.15 | 1.81 |
| 10 (com.) | 2.21 | 2.22 | 2.46 | 2.16 | 2.17 | 2.20 |
| 11 (com.) | 2.22 | 2.22 | 2.07 | 2.15 | 2.17 | 1.98 |
| 12 (com.) | 2.22 | 2.21 | 2.43 | 2.16 | 2.16 | 2.19 |
| 13 (com.) | 2.21 | 2.23 | 2.36 | 2.15 | 2.17 | 2.13 |
| 14 (com.) | 2.22 | 2.42 | 2.21 | 2.16 | 2.03 | 2.17 |
| 15 (com.) | 2.40 | 2.21 | 2.22 | 2.21 | 2.17 | 2.16 |
| 16 (com.) | 2.41 | 2.22 | 2.32 | 2.20 | 2.17 | 2.09 |
| 17 (com.) | 2.41 | 2.43 | 2.20 | 2.21 | 2.02 | 2.15 |
| 18 (com.) | 2.21 | 2.44 | 2.31 | 2.16 | 2.03 | 2.01 |
| 19 (inv.) | 2.22 | 2.21 | 2.22 | 2.16 | 2.17 | 2.16 |
| 20 (inv.) | 2.22 | 2.20 | 2.21 | 2.15 | 2.16 | 2.15 |
| 21 (inv.) | 2.21 | 2.21 | 2.22 | 2.15 | 2.17 | 2.15 |
| 22 (inv.) | 2.22 | 2.21 | 2.22 | 2.16 | 2.16 | 2.16 |
| 23 (inv.) | 2.21 | 2.20 | 2.21 | 2.16 | 2.16 | 2.15 |
| 24 (inv.) | 2.22 | 2.21 | 2.22 | 2.16 | 2.17 | 2.15 |
| 25 (inv.) | 2.21 | 2.20 | 2.21 | 2.15 | 2.17 | 2.16 |
| 26 (inv.) | 2.21 | 2.21 | 2.22 | 2.16 | 2.16 | 2.17 |
| 27 (inv.) | 2.21 | 2.21 | 2.21 | 2.16 | 2.16 | 2.17 |

As is apparent from Table-3, the samples in the combination of this invention are satisfactory in the formed color balance of Y, M, C even when the coupler-dispersed liquids were left for 48 hours at 40° C., and even after the retention, the densities are hardly lowered and there is almost no change in the formed color balance, thus showing good results as compared to the comparative samples.

On the other hand, in order to evaluate the discoloration color balance of the respective couplers, the samples obtained under the condition of using the coupler-dispersed liquids without retention and by being processed in the foregoing processing procedure were subjected to the following examinations:

Light Discoloration Test

The samples were placed in a glass-covered outdoor exposure stand to be exposed to sunlight for 15 days, and the residual rate to the initial density Do=1.0 of each of the Y, M and C of each of the samples was found.

Residual rate=$(D/Do)\times 100$ (D=density after discoloration)

Dark Discoloration Test

The samples were allowed to stand for 14 days in a high-temperature, high-moisture atmosphere at 70° C./80%RH, and after that, the residual rate to the initial density Do=1.0 of each of the Y, M and C of each of the samples was found.

Residual rate=$(D/Do)\times 100$ (D=density after discoloration)

Yellow Stain

The yellow stain (hereinafter also called YS) in the non-color-formed area in each of the light and dark discoloration tests was found in the following manner:

Yellow stain $\Delta D^B = D^B - Do^B$ $D^B$=Density to blue light after the test.

$Do^B$=Density to blue light prior to the test.

These samples were measured by using an optical densitometer PDA-65.

Secondary Absorption of the Magenta Color-Formed Dye

Further, a color analyzer Type 677 (manufactured by Hitachi Ltd.) was used to measure the spectral absorption density of the magenta monochromatic dye of each sample to thereby find the relative value ΔM of the secondary absorption density at 430 nm to the maximum absorption density.

Fog

An optical desnitometer PDA-65 was used to measure the fog densities of each of the processed samples.

Yellow fog is shown in the following table, being regarded as $D^B$min, magenta fog as $D^G$min, and cyan fog as $D^R$min.

The obtained results are shown in Table-4.

TABLE 4

| Sample | Light discoloration Residual rate % | | | $\Delta D^B$ | Dark discoloration Residual rate % | | | $\Delta D^B$ | Secondary absorption | | | |
|---|---|---|---|---|---|---|---|---|---|---|---|---|
| No. | Y | M | C | YS | Y | M | C | YS | ΔM | $D^B$min | $D^G$min | $D^R$min |
| 1(com.) | 51 | 79 | 61 | 0.29 | 65 | 78 | 44 | 0.35 | 0.41 | 0.06 | 0.06 | 0.06 |
| 2(com.) | 58 | 65 | 43 | 0.08 | 79 | 80 | 65 | 0.10 | 0.08 | 0.06 | 0.06 | 0.06 |

TABLE 4-continued

| Sample No. | Light discoloration Residual rate % Y | M | C | $\Delta D^B$ YS | Dark discoloration Residual rate % Y | M | C | $\Delta D^B$ YS | Secondary absorption $\Delta M$ | $D^B$min | $D^G$min | $D^R$min |
|---|---|---|---|---|---|---|---|---|---|---|---|---|
| 3(com.) | 57 | 65 | 62 | 0.09 | 80 | 81 | 66 | 0.11 | 0.07 | 0.06 | 0.06 | 0.06 |
| 4(com.) | 58 | 66 | 53 | 0.08 | 80 | 80 | 48 | 0.10 | 0.08 | 0.06 | 0.06 | 0.06 |
| 5(com.) | 57 | 66 | 60 | 0.08 | 80 | 82 | 49 | 0.11 | 0.07 | 0.06 | 0.06 | 0.06 |
| 6(com.) | 59 | 65 | 55 | 0.09 | 79 | 80 | 65 | 0.10 | 0.08 | 0.06 | 0.06 | 0.06 |
| 7(com.) | 57 | 66 | 54 | 0.08 | 79 | 81 | 65 | 0.11 | 0.07 | 0.09 | 0.09 | 0.09 |
| 8(com.) | 58 | 81 | 63 | 0.27 | 79 | 78 | 46 | 0.36 | 0.42 | 0.06 | 0.06 | 0.06 |
| 9(com.) | 78 | 84 | 42 | 0.05 | 85 | 87 | 67 | 0.08 | 0.07 | 0.06 | 0.06 | 0.06 |
| 10(com.) | 77 | 84 | 65 | 0.05 | 84 | 88 | 68 | 0.07 | 0.07 | 0.06 | 0.06 | 0.06 |
| 11(com.) | 78 | 85 | 55 | 0.06 | 85 | 89 | 49 | 0.07 | 0.08 | 0.06 | 0.06 | 0.06 |
| 12(com.) | 79 | 85 | 61 | 0.06 | 85 | 89 | 50 | 0.07 | 0.07 | 0.06 | 0.06 | 0.06 |
| 13(com.) | 78 | 84 | 55 | 0.06 | 84 | 88 | 65 | 0.07 | 0.07 | 0.06 | 0.06 | 0.06 |
| 14(com.) | 79 | 65 | 78 | 0.09 | 84 | 79 | 83 | 0.08 | 0.08 | 0.06 | 0.09 | 0.06 |
| 15(com.) | 58 | 84 | 79 | 0.05 | 79 | 88 | 84 | 0.11 | 0.07 | 0.06 | 0.06 | 0.06 |
| 16(com.) | 57 | 84 | 55 | 0.05 | 79 | 89 | 65 | 0.08 | 0.07 | 0.10 | 0.06 | 0.10 |
| 17(com.) | 57 | 66 | 78 | 0.08 | 80 | 81 | 85 | 0.07 | 0.07 | 0.06 | 0.06 | 0.06 |
| 18(com.) | 58 | 67 | 56 | 0.09 | 79 | 80 | 63 | 0.11 | 0.07 | 0.06 | 0.06 | 0.06 |
| 19(inv.) | 79 | 85 | 78 | 0.05 | 84 | 88 | 83 | 0.07 | 0.08 | 0.06 | 0.06 | 0.06 |
| 20(inv.) | 78 | 84 | 77 | 0.05 | 85 | 89 | 84 | 0.07 | 0.07 | 0.06 | 0.06 | 0.06 |
| 21(inv.) | 79 | 85 | 78 | 0.06 | 84 | 89 | 84 | 0.08 | 0.08 | 0.06 | 0.06 | 0.06 |
| 22(inv.) | 78 | 85 | 79 | 0.05 | 85 | 88 | 82 | 0.07 | 0.07 | 0.10 | 0.11 | 0.11 |
| 23(inv.) | 78 | 84 | 78 | 0.06 | 85 | 88 | 84 | 0.08 | 0.08 | 0.06 | 0.10 | 0.06 |
| 24(inv.) | 79 | 84 | 78 | 0.06 | 84 | 89 | 84 | 0.07 | 0.07 | 0.06 | 0.06 | 0.06 |
| 25(inv.) | 79 | 85 | 79 | 0.06 | 84 | 89 | 83 | 0.08 | 0.08 | 0.06 | 0.06 | 0.10 |
| 26(inv.) | 79 | 85 | 79 | 0.05 | 85 | 88 | 83 | 0.07 | 0.07 | 0.10 | 0.06 | 0.06 |
| 27(inv.) | 78 | 85 | 78 | 0.06 | 85 | 89 | 82 | 0.07 | 0.07 | 0.06 | 0.06 | 0.09 |

As is apparent from Table 4, Samples No. 1 through No. 18 prepared by using in combination the comparative couplers and high-boiling organic solvents are inferior in any of the discoloration of the yellow, magenta and cyan images, the appearance of yellow stain, the discoloration color balance of the yellow, magenta and cyan images, or the secondary absorption.

Particularly, regarding the discoloration of the cyan image, it is understood that the combination of the two different cyan couplers of this invention and a high-boiling organic solvent having a dielectric constant of not more than 6.0 is required for satisfying the discoloration color balance of Comparative Samples Nos. 4, 5, 6, 7, 11 and 12, and also that the high-boiling organic solvent having a dielectric constant of not more than 6.0 is necessary for all the respective couplers-containing layers by comparison of Comparative Samples Nos. 13, 14, 15, 16, 17 and 18 with the samples of this invention.

Further, it is also understood from Samples No. 20 through No. 27 that similar effects can be obtained depending on the kind and combined use of such high-boiling organic solvents, and particularly phthalate-type high-boiling solvents are satisfactory in respect of giving little fog.

EXAMPLE-2

Samples were prepared in the same manner as in Example-1 by using the couplers and high-boiling organic solvents given in Table-5, and then examined with respect to the light and dark discoloration characteristics thereof.

The obtained results are as given in Table-6.

TABLE 5

| Sample No. | Yellow coupler | Magenta coupler | Cyan coupler Formula [III-1] | Formula [III-2] | (III-1/III-2) molar ratio | Y layer high-boiling organic solv. | M layer high-boiling organic solv. | C layer high-boiling organic solv. |
|---|---|---|---|---|---|---|---|---|
| 28(inv.) | Y-4 | 1 | C-1 | C-33 | 50/50 | 12 | 12 | 12 |
| 29(inv.) | Y-6 | 5 | C-3 | C-35 | 50/50 | 2 | 2 | 2 |
| 30(inv.) | Y-11 | 22 | C-4 | C-37 | 50/50 | 6 | 6 | 6 |
| 31(inv.) | Y-14 | 44 | C-13 | C-41 | 50/50 | 8 | 8 | 8 |
| 32(inv.) | Y-20 | 54 | C-15 | C-42 | 50/50 | 12 | 2 | 6 |
| 33(inv.) | Y-36 | 99 | C-20 | C-45 | 50/50 | 2 | 6 | 8 |
| 34(inv.) | Y-37 | 130 | C-25 | C-49 | 50/50 | 6 | 8 | 12 |
| 35(inv.) | Y-39 | 157 | C-26 | C-50 | 50/50 | 6 | 12 | 2 |
| 36(inv.) | Y-41 | 172 | C-31 | C-52 | 50/50 | 8 | 2 | 6 |
| 37(inv.) | Y-4 | 59 | C-31 | C-52 | 15/85 | 12 | 12 | 12 |
| 38(inv.) | Y-4 | 59 | C-31 | C-52 | 50/50 | 12 | 12 | 12 |
| 39(inv.) | Y-4 | 59 | C-31 | C-52 | 85/15 | 12 | 12 | 12 |
| 40(com.) | YC-1 | MC-1 | CC-1 | | — | 12 | 12 | 12 |

TABLE 6

| Sample No. | Light discoloration Residual ratio (%) Y | M | C | Dark discoloration Residual ratio (%) Y | M | C |
|---|---|---|---|---|---|---|
| 28 (inv.) | 78 | 85 | 76 | 82 | 88 | 83 |
| 29 (inv.) | 77 | 86 | 77 | 83 | 89 | 84 |
| 30 (inv.) | 79 | 84 | 77 | 82 | 87 | 82 |
| 31 (inv.) | 77 | 85 | 76 | 84 | 89 | 83 |
| 32 (inv.) | 79 | 85 | 75 | 83 | 89 | 84 |
| 33 (inv.) | 78 | 84 | 76 | 83 | 88 | 83 |
| 34 (inv.) | 79 | 84 | 77 | 82 | 89 | 82 |
| 35 (inv.) | 78 | 86 | 75 | 82 | 89 | 84 |
| 36 (inv.) | 77 | 85 | 76 | 84 | 88 | 83 |
| 37 (inv.) | 78 | 84 | 72 | 82 | 89 | 80 |
| 38 (inv.) | 78 | 84 | 76 | 83 | 87 | 83 |
| 39 (inv.) | 78 | 85 | 73 | 83 | 88 | 81 |
| 40 (com.) | 55 | 76 | 60 | 64 | 80 | 45 |

It is apparent from Table-6 that similar effects can be obtained even when the combination of the respective yellow, magenta and cyan couplers is varied. (Samples 28–36)

It is also understood that the satisfying results are also shown in any of Samples 37, 38 and 39, prepared by varying the using quantitative proportion of the cyan coupler of Formula [III-1] to the cyan coupler of Formula [III-2].

EXAMPLE-3

In the same manner as in Example-1, samples were prepared by, as shown in Table-7, further adding the compounds having Formula [a] and [b] to both yellow coupler-containing layer and cyan coupler-containing layer, and then subjected to the light and dark discoloration examinations. The obtained results are shown in Table 8.

TABLE 7

| Sample No. | Yellow coupler | Magenta coupler | Cyan coupler Formula [III-1] | Cyan coupler Formula [III-2] | Cyan coupler (III-1/III-2) molar ratio | High-boiling organic solv. Y,M,C layers | Cpd of formulas [a] and [b] Y layer | Cpd of formulas [a] and [b] C layer |
|---|---|---|---|---|---|---|---|---|
| 41(inv.) | Y-7 | 59 | C-29 | C-36 | 50/50 | 12 | — | — |
| 42(inv.) | Y-7 | 59 | C-29 | C-36 | 50/50 | 12 | 25 | — |
| 43(inv.) | Y-7 | 59 | C-29 | C-36 | 50/50 | 12 | — | 47 |
| 44(inv.) | Y-7 | 59 | C-29 | C-36 | 50/50 | 12 | 25 | 47 |
| 45(inv.) | Y-7 | 59 | C-29 | C-36 | 50/50 | 2 | 26 | 49 |
| 46(inv.) | Y-7 | 59 | C-29 | C-36 | 50/50 | 6 | 43 | 80 |
| 47(inv.) | Y-7 | 59 | C-29 | C-36 | 50/50 | 8 | 25 | 80 |
| 48(inv.) | Y-7 | 59 | C-29 | C-36 | 50/50 | 12 | 69 | — |
| 49(inv.) | Y-7 | 59 | C-29 | C-36 | 50/50 | 12 | — | 141 |
| 50(inv.) | Y-7 | 59 | C-29 | C-36 | 50/50 | 12 | 81 | 123 |
| 51(inv.) | Y-7 | 59 | C-29 | C-36 | 50/50 | 12 | 25 | 141 |
| 52(inv.) | Y-7 | 59 | C-29 | C-36 | 50/50 | 12 | 69 | 80 |

TABLE 8

| Sample No. | Light discoloration Residual ratio (%) Y | M | C | Dark discoloration Residual ratio (%) Y | M | C |
|---|---|---|---|---|---|---|
| 41 (invention) | 78 | 86 | 79 | 85 | 90 | 82 |
| 42 (invention) | 88 | 86 | 78 | 90 | 89 | 82 |
| 43 (invention) | 78 | 86 | 87 | 84 | 90 | 90 |
| 44 (invention) | 88 | 86 | 88 | 91 | 89 | 90 |
| 45 (invention) | 87 | 87 | 88 | 90 | 90 | 89 |
| 46 (invention) | 88 | 86 | 87 | 90 | 91 | 89 |
| 47 (invention) | 87 | 87 | 88 | 91 | 90 | 90 |
| 48 (invention) | 83 | 86 | 78 | 88 | 89 | 82 |
| 49 (invention) | 78 | 87 | 82 | 84 | 89 | 85 |
| 50 (invention) | 83 | 86 | 82 | 88 | 90 | 85 |
| 51 (invention) | 88 | 86 | 82 | 91 | 91 | 84 |
| 52 (invention) | 82 | 86 | 88 | 87 | 90 | 90 |

As is apparent from Table-8, the addition of the compounds having Formulas [a] and [b] to both yellow coupler-containing layer and cyan coupler-containing layer satisfactorily results in the further improvement of the light and dark discoloration color balance.

EXAMPLE-4

An internal latent image-forming type emulsion comprising cubic silver chlorobromide (containing AgBr of 64.8 mol%) having an average grain size of 0.60 μm was prepared in such a manner that a cubic silver bromide emulsion having an average grain size of 0.40 μm was served as the cores and, over each of the core surfaces, silver chlorobromide (containing AgBr of 50 mol%) was precipitated and grown up.

Next, each of a blue-sensitive emulsion, a green-sensitive emulsion and a red-sensitive emulsion was prepared by adding a blue-sensitive spectral sensitizer, a green-sensitive spectral sensitizer and a red-sensitive spectral sensitizer, respectively.

Then, the coating solutions for each layer were prepared by making use of the above-mentioned emuslions so as to have the composition shown in Tables 9 and 10.

Finally, a silver halide color photographic light-sensitive material was prepared by coating the above-mentioned coating solutions in order from a paper support coated with a polyethylene on the both sides thereof.

TABLE 9

| Layer | Composition | |
|---|---|---|
| 8th layer | Gelatin | (2.0) |
| (Protective layer) | UV absorbing agent [UV-16] | (0.3) |
| 7th layer (Blue-sensitive layer) | Gelatin | (2.0) |
| | Blue-sensitive emulsion <Equivalent in Silver> | (0.68) |
| | Yellow coupler* | (0.89) |
| | A compoud having Formula [a] or [b]* | (0.45) |
| | A high boiling organic solvent* | (0.3) |
| 6th layer (3rd interlayer) | Gelatin | (0.8) |
| 5th layer (Yellow filter layer) | Gelatin | (1.2) |
| | Yellow colloidal silver | (0.09) |
| 4th layer (2nd interlayer) | Gelatin | (0.8) |
| 3rd layer (Green-sensitive layer | Gelatin | (1.5) |
| | Green-sensitive emulsion <Equivalent in Silver> | (0.5) |
| | Magenta coupler* | (0.4) |
| | A compound having Formula [A] to [K]* | (0.6) |
| | A high boiling organic solvent* | (0.4) |
| 2nd layer 1st interlayer) | Gelatin | (0.8) |
| | Compound having Formula [VI], HQ-2 | (0.06) |
| 1st layer (Red-sensitive layer | Gelatin | (1.8) |
| | Red-sensitive emulsion <Equivalent in Silver> | (0.6) |
| | Cyan coupler* | (0.68) |
| | A compound having Formula [a] or [b]* | (0.35) |
| | A high boiling organic solvent* | (0.3) |
| Support | Polyethylene-coated paper | |

Note:
The parenthesized values are coating quantities per a unit of $g/m^2$.
The asterisked are given in Table 10.

TABLE 10

| Sample No. | Blue-sensitive layer: Yellow coupler | Compound having Formula [a] or [b] | High boiling organic solvent | Green-sensitive layer: Magenta coupler | Compound having Formula [A] to [K] | High boiling organic solvent | Red-sensitive layer: Cyan coupler | Compound having Formula [a] or [b] | High boiling organic solvent |
|---|---|---|---|---|---|---|---|---|---|
| 53 (Comparative) | YC-1 | 124 | DBP | MC-1 | B-24/J-1 | DBP | CC-1 | 65 | DBP |
| 54 (Invention) | Y-7 | " | 2 | M-59 | " | 2 | C-29/C-36 | " | 2 |

The above obtained were exposed to light through a photosensitometer and were then treated in the following processing steps:

| Processing Steps | (Temperature) | (Time) |
|---|---|---|
| [1] Color developing step | 35° C. | 2 min 10 sec |
| [2] Bleach-fixing step | 35° C. | 1 min 30 sec |
| [3] Stabilizing step | 35° C. | 1 min 30 sec |

In the above-mentioned steps, every light-sensitive materials were totally exposed to white light of one lux for a period of 10 seconds from the time 10 seconds to the time 20 seconds after the starting the color developing step.

Composition of every processing solution:

| | Unit (g/liter) |
|---|---|
| [Color Developing Solution] | |
| Potassium carbonate | 28.9 |
| Potassium sulfite | 2.6 |
| Sodium bromide | 0.26 |
| Benzyl alcohol | 12.8 |
| Ethylene glycol | 3.4 |
| Hydroxylamine sulfate | 2.6 |
| 1,8-dihydroxy-3,6-dithiaoctane | 0.1 |
| Diaminopropanol tetraacetic acid | 0.09 |
| Sodium chloride | 3.2 |
| Nitrilotriacetic acid | 0.4 |
| 3-methyl-4-amino-N—ethyl-N—(β-methanesulfonamidoethyl)-aniline sulfate | 4.25 |
| pH (adjusted with potassium hydroxide) | 10.2 |
| [Bleach-Fixing Solution] | |
| Ammonium thiosulfate | 110.0 |
| Sodium hydrogensulfite | 10.0 |
| Iron ammonium ethylenediamine-tetraacetic acid | 60.0 |
| Diammonium ethylenediaminetetraacetic acid | 5.0 |
| Bisthiourea | 2.0 |
| pH (adjusted with aqueous ammonia) | 6.5 |
| [Stabilizer] | |
| Glacial acetic acid | 20.0 |
| Anhydrous sodium acetate | 5.0 |

The samples obtained in the above-mentioned process were tested for light discoloration and dark discoloration, similar to the case of Example-1. The results thereof are shown in Table 11.

TABLE 11

| Sample No. | Light discoloration: Y | M | C | Dark discoloration: Y | M | C |
|---|---|---|---|---|---|---|
| 53 (Comparative) | 51 | 62 | 68 | 87 | 88 | 43 |
| 54 (Invention) | 82 | 83 | 82 | 93 | 95 | 95 |

As is apparent from Table-11, the samples of the invention were improved both on the light and dark discoloration properties and the discoloration balance of Y, M and C, so that the excellent results were enjoyed.

What is claimed is:

1. A silver halide color photographic light-sensitive material which comprises a support having thereon a silver halide emulsion layer containing a yellow dye-forming coupler represented by the following Formula [I], a silver halide emulsion layer containing a magenta dye-forming coupler represented by the following Formula [II], a silver halide emulsion layer containing both of a cyan dye-forming coupler represented by following Formula [III-1] and a cyan due-forming coupler represented by the following Formula [III-2], said emulsion layers containing said couplers and further containing a high-boiling organic solvent having a dielectric constant of not more than 6.0:

Formula [I]

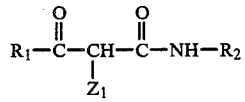

wherein $R_1$ is an alkyl group, $R_2$ is an aryl group and $Z_1$ is a hydrogen atom or a group capable of being splitted off from the coupler residue upon reaction with an oxidized product of a color developing agent, Formula [II]

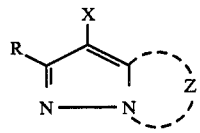

wherein R is a hydrogen atom or a substituent, Z is a group of non-metallic atoms necessary to form a nitrogen-containing heterocyclic ring, provided that said heterocyclic ring formed by Z is allowed to have a substituent, X is a group capable of being split off from the coupler residue upon reaction with an oxidized product of a color developing agent, Formula [III-1]

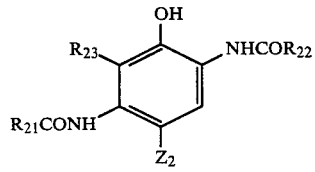

wherein $R_{21}$ is an alkyl group, or an aryl group, $R_{22}$ is an alkyl group, acycloalkyl group, an aryl group or a heterocyclic group, $R_{23}$ is a hydrogen atom, a halogen atom, an alkyl group or an alkoxy group, said $R_{23}$ being allowed to combine with said $R_{21}$ to form a cyclic ring, and $Z_2$ is a group capable of being split off from the coupler residue upon reaction with an oxidized product of a color developing agent, Formula [III-2]

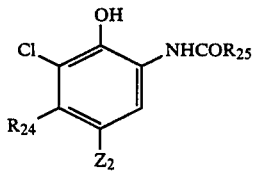

wherein $R_{24}$ is a straight-chain or branched-chain alkyl group having from 2 to 4 carbon atoms, $R_{25}$ is a ballasting group, and $Z_2$ is as defined in said $Z_2$ of formula [III-1].

2. The silver halide color photographic light-sensitive material of claim 1, wherein said high-boiling organic solvent has a dielectric constant within the range of from 1.9 to 6.0.

3. The silver halide color photographic light-sensitive material of claim 1, wherein said high-boiling organic solvent is a phthalate.

4. The silver halide color photographic light-sensitive material of claim 1, wherein said silver halide emulsion layer containing said yellow dye-forming coupler represented by Formula [I] and said silver halide emulsion layer containing said cyan-dye forming coupler represented by Formula [III-1] and said cyan-dye forming coupler represented by Formula [III-2], said layers further contain at least one of the compound represented by each of the following Formula [a] and [b], respectively, Formula [a]

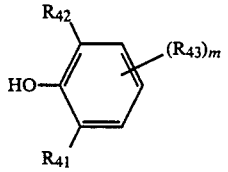

wherein $R_{41}$ and $R_{42}$ each is an alkyl group, $R_{43}$ is an alkyl group, a —NR′ R″ group, a —SR′ group or a —COOR″ group, wherein R′ is a monovalent organic group and R″ is a hydrogen atom or a monovalent organic group, and n is an integer of from zero to 3, Formula [b]

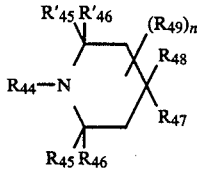

wherein $R_{44}$ is a hydrogen atom, a hydroxy group, an oxy radical (Ȯ), a —SOR′, an alkyl group, an alkenyl group, an alkinyl group or a COR″ group, werein R′ is a monovalent organic group and R″ is a hydrogen atom or a monovalent organic group, $R_{45}$, $R_{46}$, $R'_{45}$, $R'_{46}$ and $R_{49}$ each is an alkyl group, $R_{47}$ and $R_{48}$ each is a hydrogen atom or a —$OCOR_{50}$, wherein $R_{50}$ is a monovalent organic group, or $R_{47}$ and $R_{48}$ are allowed to form a heterocyclic group in cooperation with each other, and n is an integer of from zero to 4.

5. The silver halide color photographic light-sensitive material of claim 1, wherein said cyan eye-forming coupler represented by Formula [III-1] and said cyan dye-forming coupler represented by Formula [III-2] are used in the proportional range of from 10:90 to 90:10.

* * * * *